US007735750B2

(12) United States Patent
Kaneko et al.

(10) Patent No.: US 7,735,750 B2
(45) Date of Patent: Jun. 15, 2010

(54) LIQUID EJECTION HEAD

(75) Inventors: Yasuhisa Kaneko, Kanagawa (JP); Shuji Takahashi, Kanagawa (JP); Yoshinori Hotta, Aichi (JP); Toshiaki Fukunaga, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 1048 days.

(21) Appl. No.: 11/290,695

(22) Filed: Dec. 1, 2005

(65) Prior Publication Data

US 2006/0115598 A1 Jun. 1, 2006

(30) Foreign Application Priority Data

Dec. 1, 2004 (JP) ..... 2004-348696
Dec. 21, 2004 (JP) ..... 2004-369145
Dec. 21, 2004 (JP) ..... 2004-369494

(51) Int. Cl.
*B05B 1/08* (2006.01)

(52) U.S. Cl. ..... 239/102.2; 239/102.1

(58) Field of Classification Search ..... 239/102.1, 239/102.2, 690, 690.1, 696, 589, 548, 554, 239/558, 566, 553.3; 428/141, 172, 173
See application file for complete search history.

(56) References Cited

U.S. PATENT DOCUMENTS 4,991,774 A * 2/1991 Kelly ..... 239/3
5,324,566 A 6/1994 Ogawa et al.
5,381,166 A 1/1995 Lam et al.
5,599,749 A * 2/1997 Hattori ..... 216/11
5,976,380 A * 11/1999 Moya ..... 210/650
6,304,384 B1 * 10/2001 Nishikawa ..... 359/619
6,467,876 B1 10/2002 Karasawa et al.
6,621,637 B2 * 9/2003 Uchiyama et al. ..... 359/619
6,761,433 B2 * 7/2004 Moon et al. ..... 347/62
6,800,405 B2 * 10/2004 Kobayashi ..... 430/5
2001/0024219 A1 9/2001 Kanda et al.
2002/0122095 A1 9/2002 Sanada et al.
2004/0183860 A1 9/2004 Furukawa

FOREIGN PATENT DOCUMENTS

EP 1138499 A2 10/2001

(Continued)

OTHER PUBLICATIONS

Japanese Office Action dated Feb. 16, 2010 corresponding to Japanese Patent Application No. 2004-369494.

*Primary Examiner*—Davis Hwu
(74) *Attorney, Agent, or Firm*—Sughrue Mion, PLLC

(57) ABSTRACT

The repellency increasing structure includes a substrate, if a surface of the substrate is flat, a flat surface of which shows lyophilic property with respect to a liquid having a surface tension lower than that of water and multiple recesses multiple and/or projections that are formed in the surface of the substrate. Inner walls of the recesses and outer walls of the projections are substantially parallel to a thickness direction of the substrate. The structure further includes a repellent layer that covers the recesses and the projections. In the liquid ejection head, a solution ejection surface around multiple through-holes of a ejection substrate corresponds to the surface of the substrate of the repellency increasing structure in which the recesses and/or the projections are formed. In the stain-resistant film, the substrate of the repellency increasing structure is a support film.

4 Claims, 39 Drawing Sheets

FOREIGN PATENT DOCUMENTS

| | | | |
|---|---|---|---|
| JP | 61-57345 | A | 3/1986 |
| JP | 1-97656 | A | 4/1989 |
| JP | 1-128840 | A | 5/1989 |
| JP | 2809889 | B | 7/1998 |
| JP | 2000-79692 | A | 3/2000 |
| JP | 2000-229410 | A | 8/2000 |
| JP | 2001-246753 | A | 9/2001 |
| JP | 2001-260361 | A | 9/2001 |
| JP | 3239137 | B | 10/2001 |
| JP | 2004-044990 | A | 2/2004 |
| JP | 44990 | A | 2/2004 |
| JP | 2004-216747 | A | 8/2004 |
| JP | 2004-230653 | A | 8/2004 |
| WO | WO 99/12740 | | 3/1999 |

* cited by examiner

LIQUID EJECTION HEAD

The entire contents of literatures cited in this specification are incorporated herein by reference.

BACKGROUND OF THE INVENTION

The present invention relates to: a repellency increasing structure with which the contact angle increases with respect to a liquid having a surface tension lower than that of water such as an organic solvent, oil, or a liquid having a surface tension of 40 mN/m or less even if the contact angle on a flat surface is equal to or less than 90° (the flat surface is lyophilic) and a method of producing the repellency increasing structure; a liquid ejection head capable of consistently ejecting a liquid whose surface tension is lower than that of water like an organic solvent, oil, or a liquid having a surface tension of 40 mN/m or less and a method of producing the liquid ejection head; and a stain-resistant film for preventing contamination.

Methods of obtaining a material and a surface structure exhibiting repellency with respect to water have been already established, and a contact angle of 150° or more has been obtained. In contrast, a material and a structure exhibiting repellency with respect to a liquid having a low surface tension such as an organic solvent or oil have not been fully examined yet.

Most of the conventionally known repellent materials mainly exhibit repellency with respect to water (also called water repellency). Water repellent materials have been used for rain apparel, instruments used at home such as kitchen utensils, industrial products, and the like.

A material having repellency is industrially applicable to an ink-jet system for performing recording by ejecting and flying ultra-fine ink droplets and by causing the droplets to adhere to recording paper. In the ink-jet system, the formation of a repellent film around each ejection orifice is significantly important for improving ejection performance.

It has been conventionally known that the formation of a repellent film around each ink ejection orifice is significantly important for improving ejection performance in an ink-jet recording apparatus that performs recording by ejecting and flying ultra-fine ink droplets and by causing the droplets to adhere to recording paper.

A super water repellent polytetrafluoroethylene (PTFE) film formed by nickel eutectoid plating and having a contact angle with respect to water in excess of 150° has been realized as such repellent material exhibiting water repellency.

It is important to examine both the properties of a material (as to whether the material has a low surface tension) and surface structure in order to improve repellency.

A compound containing fluorine has been well known to be a material having a low surface tension that enhances repellency (see, for example, JP 2809889 B).

A method involving anodizing an aluminum member and a method involving forming fine recesses and projections on the surface of the aluminum member by a photolithographic technique have been known as the method of improving repellency by a surface structure (see, for example, WO 99/12740).

JP 2809889 B discloses a water repellent and oil repellent coating obtained by forming, on the surface of a substrate on which recesses and projections each having a size in the range of 0.4 to 20 μm have been formed in advance, a coating which is a fluorine-containing monomolecular film formed via siloxane bonds. The uneven profile on the surface of the substrate in the water repellent and oil repellent coating of JP 2809889 B is a fractal structure having regularities of various sizes and depths.

WO 99/12740 discloses a porous structure. In the porous structure, recesses and projections are formed on the surface of a substrate. The projections on the surface have a uniform height. The recesses and the projections are each formed to have such a size as to allow a droplet to contact an air layer in a recess without falling into the recess. A water repellent film is formed on the surfaces the recesses and the projections. The porous structure is provided on an ink ejection surface of an ink-jet recording head except ink ejection holes. The recesses and projections in the porous structure are artificially formed so as to have a uniform size and a uniform height by a photolithographic technique, a dry etching technique, or a wet etching technique. Examples of the uneven profile pattern include a lattice pattern, a dot pattern, and a line pattern.

Other documents than JP 2809889 B and WO 99/12740 have also conventionally proposed repellency increasing structures each using anodization for the purpose of improving repellency (see, for example, JP 3239137 B and JP 2000-79692 A).

JP 3239137 B discloses an aluminum or aluminum alloy sheet 260 as shown in FIG. 43. In the aluminum or aluminum alloy sheet 260, a porous oxide film 268 including a barrier layer 264 and a bulk layer 266 is formed on the surface of an aluminum substrate 262. A perfluoroalkyl compound 269 having, at side chain thereof, an alkyl group having 1 to 5 carbon atoms adsorbs to the entire surface of the porous oxide film 268 and is filled into holes 266*a*.

JP 2000-79692 A discloses an ink-jet recording head including an aluminum substrate and a surface treatment layer which is provided on the peripheries of ejection holes and has a treatment layer made of sulfuric acid-based alumite and a treatment layer made of a water repellent material.

JP 2809889 B illustrates by way of examples that the water repellent and oil repellent coating can provide sufficient repellency with respect to water. However, this patent has neither example nor sufficient examination as to whether sufficient repellency can be achieved when an organic solvent, oil, or the like adheres to the surface of the coating.

WO 99/12740 illustrates by way of examples that the porous structure can provide sufficient repellency with respect to water. However, this document has neither example nor sufficient examination as to whether sufficient repellency can be achieved when a liquid having a surface tension lower than that of water such as an organic solvent or oil having a surface tension of 40 mN/m or less adheres to the surface of the porous structure.

In addition, in the aluminum or aluminum alloy sheet 260 in JP 3239137 B, the perfluoroalkyl compound is embedded in the holes 266*a* of the porous oxide film 268, so its surface has a flat profile and the inherent surface profile of the porous oxide film 268 is lost. Therefore, the surface profile of the porous oxide film 268 does not contribute to the sheet repellency. In addition, the number of F is as low as 3 to 9, and the repellent material used is also low in repellency.

JP 3239137 B can achieve sufficient water repellency, but has neither example nor sufficient examination as to whether sufficient repellency can be achieved when an organic solvent, oil, or the like adheres to the surface of the aluminum or aluminum alloy sheet.

In JP 2000-79692 A, a sulfuric acid-based alumite treatment is carried out to form a porous coating, which in turn is densely coated with the water repellent material such as a fluorine- or silicone-based material and the corrosion resistance is thus increased. However, the surface profile of the porous film is lost. That is, even in JP 2000-79692 A, the porous film has a flat surface profile and thus does not contribute to the repellency of the head, and only the water repellency the water repellent material has contributes thereto.

JP 2000-79692 A can achieve sufficient water repellency, but has neither example nor sufficient examination as to whether sufficient repellency can be achieved when an organic solvent, oil, or the like adheres to the surface of the treatment layer.

As described above, it has been conventionally known that sufficient repellency can be achieved with respect to water. It has been also known that an organic solvent, oil, or the like having adhered to a surface may deteriorate the repellency. Therefore, a material exhibiting repellency with respect to an organic solvent and oil has been desired.

At present, however, the material exhibiting repellency with respect to an organic solvent, oil, and the like has been rarely investigated. This is mainly because the organic solvent and oil have a surface tension considerably lower than that of water, so sufficient repellency cannot be easily achieved.

Hereinafter, the reason why repellency with respect to an organic solvent or oil cannot be easily achieved will be described in detail.

As shown in FIG. 44, the contact angle θ formed between a surface 150*a* of a smooth solid 150 and a liquid 152 placed thereon is represented by the following expression 1 showing the relationship among the surface tension $\gamma_L$ of the liquid 152, the surface tension $\gamma_S$ of the solid 150, and the interaction (interfacial tension) $\gamma_{SL}$ between the solid 150 and the liquid 152.

$$\gamma_S=\gamma_{SL}+\gamma_L\cdot\cos\theta \quad (1)$$

In addition, the solid-liquid interfacial tension $\gamma_{SL}$ is represented by the following expression 2.

$$\gamma_{SL}=\gamma_S+\gamma_L-2\sqrt{\gamma_S\gamma_L} \quad (2)$$

The following expression 3 is derived by combining the expressions 1 and 2. The expression 3 means that the contact angle showing repellency is derived from a magnitude relationship between the surface tension $\gamma_S$ of the solid and the surface tension $\gamma_L$ of the liquid.

$$\theta=\cos^{-1}\left(\sqrt{\frac{4\gamma_S}{\gamma_L}}-1\right) \quad (3)$$

Here, a contact angle of 90° or more is generally defined as exhibiting "repellency", while a contact angle of less than 90° is generally defined as exhibiting "lyophilic property" ("Kou Hassui Gijutsu no Saishin Doko" (Latest Trends in High Repellency Technique), TORAY RESEARCH CENTER, Inc., p1). A relationship capable of realizing the repellency is represented by the following expression 4.

$$\gamma_S<\frac{\gamma_L}{4} \quad (4)$$

That is, the surface tension $\gamma_S$ of the solid must be equal to or less than one fourth of the surface tension $\gamma_L$ of the liquid. The surface tension of water is 74 mN/m. The surface tension $\gamma_S$ of the solid must be equal to or less than one fourth of 74 mN/m, that is, equal to or less than 19 mN/m in order that the solid may exhibit repellency with respect to water. Table 1 below shows the surface tension of each substance. Examples of a solid material having a surface tension of 19 mN/m or less includes Teflon (registered trademark) and Cytop (registered trademark), and each of the materials provides a contact angle θ of 90° or more.

TABLE 1

| Material | Surface tension (mN/m) |
|---|---|
| Perfluorolauric acid | 6 |
| Fluoroalkylsilane | 10 |
| Teflon (registered trademark) | 18 |
| Cytop (registered trademark) | 19 |
| Polytrifluoroethylene | 22 |
| Polyimide | 23 |
| Silicone (polydimethylsiloxane) | 24 |
| Polyvinylidene fluoride | 25 |
| Polyvinyl fluoride | 28 |
| Polyethylene | 31 |
| Polystyrene | 33 |
| PMMA | 39 |
| Polyvinylidene chloride | 40 |
| Polyethylene terephthalate | 43 |
| Nylon (registered trademark) | 46 |
| Cellophane | 80 |

Meanwhile, an organic solvent, oil or the like has a surface tension much lower than that of water. For example, decane has a surface tension of 24 mN/m, so a solid having a surface tension of 6 mN/m or less is needed to exhibit repellency with respect to such liquid. An example of the solid includes perfluorolauric acid. In actuality, however, this solid is not practical because only a monomolecular film of the order of an atomic layer can be formed from the solid and because the solid exhibits no repellency with respect to water.

Introduction of a surface structure has been known as another method of improving repellency. Models for the surface structure are roughly classified into two models. One model is a Wentzel model shown in FIG. 45 in which microscopic regularities 156 are formed on the surface of a solid 154 to increase a surface area so that the contact angle increases.

In FIG. 45, θ represents the true contact angle (contact angle θ when the surface is smooth (see FIG. 44)) and $\theta_f$ represents the apparent contact angle.

The relationship between the contact angle θ and the apparent contact angle $\theta_f$ is represented by the following expression 5. In the following expression 5, r represents a surface multiplication factor and is represented by a ratio between the true surface area and the apparent surface area.

$$\cos\theta_f=r\cdot\cos\theta \quad (5)$$

In the Wentzel model, one which is lyophilic becomes more lyophilic, and one which is repellent becomes more repellent.

FIG. 46 is a graph showing the relationship between the contact angle θ and the apparent contact angle $\theta_f$ in the Wentzel model in which the axis of ordinates indicates $\cos\theta_f$ and the axis of abscissas indicates cos θ.

As shown in FIG. 46, in the Wentzel model, unless a material itself has a contact angle of 90° or more (cos θ<0) with respect to a target liquid, it is difficult to further increase the contact angle.

In addition, in the Wentzel model, a straight line L shown in FIG. 46 is obtained when the surface does not have recesses, projections or other surface structure. The surface multiplication factor r in the straight line L is 1 (r=1). On the other hand, a straight line M shown in FIG. 46 is obtained when the surface has recesses, projections or other surface structure. Introduction of a surface structure to the surface increases a surface area, thereby increasing the surface multiplication factor r in the straight line M to be larger than 1 (r>1).

A Cassie model is another surface structure model. As shown in FIG. 47, in the Cassie model, recesses 160 are formed on a solid 158. The recesses 160 are filled with a substance 159 different from the solid 158. When the surface portion is constituted by two kinds of materials (the solid 158 and the substance 159) having different surface tensions, the apparent contact angle $\theta_f$ is determined by the relationship among the two kinds of materials (the solid 158 and the substance 159) exposed to a surface 158*a*, a liquid 162, and true contact angles $\theta_1$ and $\theta_2$ (not shown). The relationship is represented by the following expression 6. In the following expression 6, $A_1$ and $A_2$ each represent a coefficient showing the area ratio of each substance in a composite surface. Those coefficients $A_1$ and $A_2$ have the relationship represented by the following expression 7.

$$\cos\theta_f = A_1 \cdot \cos\theta_1 + A_2 \cdot \cos\theta_2 \quad (6)$$

$$A_1 + A_2 = 1 \quad (7)$$

Suppose that one of the two kinds of materials is air, that is, fine recesses and projections are formed on the surface of one kind of material (the solid 158) in the Cassie model. As shown in FIG. 48A, when the solid 158 itself exhibits repellency with respect to the target liquid 162 ($\theta_1$>90°), the liquid 162 cannot enter the recesses 160, so an air layer is present in the recesses 160.

Here, the contact angle $\theta_2$ with respect to the air is 180°. Therefore, the apparent contact angle $\theta_f$ represented by the expression 6 can be newly represented by the following expression 8.

$$\cos\theta_f = (1 - A_2)\cos\theta_1 - A_2 \ (\theta_1 > 90°, \theta_2 = 180°) \quad (8)$$

On the other hand, when the single solid 158 exhibits lyophilic property with respect to the target liquid ($\theta_1$<90°), as shown in FIG. 48B, the liquid 162 enters the recesses 160, so the recesses 160 are filled with the liquid 162. At this time, the contact angle of the recesses 160 with respect to the liquid is 0°. Therefore, the apparent contact angle $\theta_f$ represented by the expression 6 can be newly represented by the following expression 9.

$$\cos\theta_f = (1 - A_2)\cos\theta_1 + A_2 \ (\theta_1 < 90°, \theta_2 = 0°) \quad (9)$$

FIG. 49 is a graph showing the relationship between the contact angle $\theta_1$ and the apparent contact angle $\theta_f$ in the Cassie model in which the axis of ordinates indicates cos $\theta_f$ and the axis of abscissas indicates cos $\theta_1$.

In the Cassie model as well, as shown in FIG. 49, one which is lyophilic becomes more lyophilic, and one which is repellent becomes more repellent.

It should be noted that there is a description that the Wentzel model is applicable to a sharp change at a contact angle of around 90° in the Cassie model.

A Wentzel-Cassie integrated model obtained by integrating the Wentzel model and the Cassie model has been proposed. The Wentzel-Cassie integrated model shows the properties of both the Wentzel model and the Cassie model.

As shown in FIG. 50, the relationship between the contact angle θ and the apparent contact angle $\theta_f$ in the Wentzel-Cassie integrated model is represented by a polygonal line K. In the Wentzel-Cassie integrated model, the value of the apparent contact angle $\theta_f$ with respect to the contact angle θ represented by the polygonal line K falls within a first A quadrant $D_{11}$ as an upper half of a first quadrant $D_1$ and a third A quadrant $D_{31}$ of a third quadrant $D_3$ with the line of cos $\theta_f$=cos θ as a boundary. The first A quadrant $D_{11}$ is a region in which lyophilic property increases and the contact angle reduces. The third A quadrant $D_{31}$ is a region in which repellency increases and the contact angle increases. In the Wentzel-Cassie integrated model, as shown in FIG. 50, the value of the apparent contact angle θ with respect to the contact angle $\theta_1$ remains within the first A quadrant $D_{11}$ and the third A quadrant $D_{31}$.

Thus, as shown in FIGS. 46, 49, and 50, in each of the Wentzel model, the Cassie model, and the Wentzel-Cassie integrated model, introduction of a surface structure to a solid does not lead to increase in repellency unless the solid itself exhibits repellency with respect to a target liquid, that is, unless the contact angle is more than 90°. Therefore, there is no repellent material capable of forming a contact angle of 90° or more with respect to a liquid having a low surface tension such as an organic solvent or oil. As a result, repellency with respect to an organic solvent or oil cannot be realized.

SUMMARY OF THE INVENTION

An object of the present invention is to solve the conventional problems, and to provide a repellency increasing structure exhibiting repellency with respect to a liquid having a surface tension lower than that of water such as an organic solvent, oil, or a liquid having a surface tension of 40 mN/m or less and a method of producing the repellency increasing structure.

Another object of the present invention is to provide a liquid ejection head capable of consistently ejecting a liquid having a surface tension lower than that of water such as an organic solvent, oil, or a liquid having a surface tension of 40 mN/m or less and a method of producing the liquid ejection head.

Still another object of the present invention is to provide a stain-resistant film capable of preventing contamination.

In order to attain the object described above, a first aspect of the present invention provides a repellency increasing structure comprising: a substrate, if a surface of the substrate is flat, a flat surface of which shows lyophilic property with respect to a liquid having a surface tension lower than that of water; and multiple recesses that are formed in the surface of the substrate, wherein inner walls of the multiple recesses are substantially parallel to a thickness direction of the substrate.

Here, in each aspect of the present invention, the liquid having the surface tension lower than that of water is an organic solvent, oil, or a liquid having a surface tension of 40 mN/m or less, for example. That is, preferably, the liquid having the surface tension lower than that of water is an organic solvent, oil, or a liquid having a surface tension of 40 mN/n or less. And, in each aspect of the present invention, preferably, the surface tension of the substrate is equal to or more than one fourth of the surface tension of the liquid having the surface tension lower than that of water, and the surface tension of the flat surface of the substrate is equal to or more than one fourth of the surface tension of an organic solvent, oil, or a liquid having a surface tension of 40 mN/m or less.

In the first aspect of the present invention, preferably, an angle α formed between the surface of the substrate and each of the inner walls of the multiple recesses is smaller than 126°.

And, in the first aspect of the present invention, preferably, a radius of curvature at a boundary between the surface of the substrate and each of the inner walls of the multiple recesses is smaller than the smaller one of a diameter or an equivalent diameter of each of the multiple recesses and a depth thereof.

Further, preferably, a radius of curvature at a boundary between the surface of the substrate and each of the inner walls of the multiple recesses is equal to or less than one half of the smaller one of a diameter or an equivalent diameter of each of the multiple recesses and a depth thereof.

Further, in the first aspect, preferably, an area ratio of the multiple recesses to the substrate is 18% or more.

Moreover, a second aspect of the present invention provides a repellency increasing structure comprising: a substrate, if a surface of the substrate is flat, a flat surface of which shows lyophilic property with respect to a liquid having a surface tension lower than that of water; and multiple projections that are formed in the surface of the substrate, wherein outer walls of the multiple projections are substantially parallel to a thickness direction of the substrate.

In the second aspect, preferably, an angle β formed between an upper surface of each of the multiple projections and an outer wall thereof is smaller than 126°.

In the second aspect of the present invention, preferably, a radius of curvature at a boundary between an upper surface of each of the multiple projections and an outer wall thereof is smaller than the smaller one of a diameter or an equivalent diameter of each of the multiple projections and a depth thereof.

Here, preferably, a radius of curvature at a boundary between an upper surface of each of the multiple projections and an outer wall thereof is equal to or less than one half of the smaller one of a diameter or an equivalent diameter of each of the multiple projections and a depth thereof.

In the second aspect of the present invention, preferably, an area ratio of the multiple projections to the substrate is 64% or less.

Here, the first and second aspects of the present invention provide a repellency increasing structure comprising: a substrate, if a surface of the substrate is flat, a flat surface of which shows lyophilic property with respect to a liquid having a surface tension lower than that of water; and multiple recesses and/or multiple projections that are formed in the surface of the substrate, wherein inner walls of the multiple recesses and/or outer walls of the multiple projections are substantially parallel to a thickness direction of the substrate.

In the first and second aspects, it is preferable that the repellency increasing structure further comprise a lower substrate that is arranged on a rear surface of the substrate.

Further, in each of the aspects, preferably, a surface of the lower substrate that is in contact with the rear surface of the substrate is not exposed.

And, in each of the aspects, it is preferable that the repellency increasing structure further comprise a coating layer composed of a material containing fluorine that is formed on the surface of the substrate.

In each of the first and second aspects, preferably, the substrate is made of a polymeric material containing fluorine, a fluororesin, an amorphous fluoropolymer, polytetrafluoroethylene, or ethylene tetrafluoroethylene.

And, preferably, the substrate is mainly composed of a hydrocarbon-based polymeric material, glass, a metal, or an alloy, and a material containing fluorine is previously added to the substrate.

A third aspect of the present invention provides a method of producing a repellency increasing structure comprising: a step of preparing a substrate, if a surface of the substrate is flat, a flat surface of which shows lyophilic property with respect to a liquid having a surface tension lower than that of water; and a step of forming multiple recesses and/or multiple projections in the surface of the substrate in such a manner that inner walls of the multiple recesses and/or outer walls of the multiple projections are substantially parallel to a thickness direction of the substrate, wherein an angle α formed between the surface of the substrate and each of the inner walls of the multiple recesses and/or an angle β formed between an upper surface of each of the multiple projections and an outer wall thereof is smaller than 126°.

Moreover, a fourth aspect of the present invention provides a method of producing a repellency increasing structure comprising a step of preparing a substrate, if a surface of the substrate is flat, a flat surface of which shows lyophilic property with respect to a liquid having a surface tension lower than that of water; and a step of forming multiple recesses and/or multiple projections in the surface of the substrate in such a manner that inner walls of the multiple recesses and/or outer walls of the multiple projections are substantially parallel to a thickness direction of the substrate, wherein a radius of curvature at a boundary between the surface of the substrate and each of the inner walls of the multiple recesses and/or a boundary between an upper surface of each of the multiple projections and an outer wall thereof is smaller than the smaller one of a diameter or an equivalent diameter of each of the multiple recesses and a depth thereof and/or the smaller one of a diameter or an equivalent diameter of each of the multiple projections and a depth thereof.

In the fourth aspect of the present invention, preferably, the forming step of the multiple recesses and/or the multiple projections in the surface of the substrate comprises: a step of forming a metal film on the surface of the substrate; a step of subjecting the metal film to patterning; a step of etching the substrate using the patterned metal film as a mask to form the multiple recesses and/or the projections in the surface of the substrate; a step of removing the metal film on the surface of the substrate; and a step of performing a heat-treatment on the substrate.

In the fourth aspect, preferably, dry etching is used in the step of etching the substrate.

And, preferably, the step of performing the heat-treatment on the substrate is heat-treated at a temperature in a range of from 100° C. to 180° C.

Moreover, in the fourth aspect of the present invention, preferably, the forming step of the multiple recesses and/or the multiple projections in the surface of the substrate comprises: a step of pressing a die in which the multiple recesses and/or the multiple projections are formed, against the substrate.

And, preferably, the forming step of the multiple recesses and/or the multiple projections in the surface of the substrate comprises: a step of applying a photosensitive material to the substrate; a step of forming the multiple recesses and/or the multiple projections in the photosensitive material by means of a photolithographic technique; and a step of treating the photosensitive material in which the multiple recesses and/or the multiple projections are formed with heat to cure the photosensitive material.

Further, in the fourth aspect of the present invention, it is preferable that the method of producing the repellency increasing structure further comprise: subsequent to the forming step of the multiple recesses and/or the multiple projections in the surface of the substrate, a step of cleaning the substrate; and a step of forming a coating layer composed of a material containing fluorine on the surface of the substrate, and each of the inner walls of the multiple recesses and/or each of outer walls of the multiple projections.

Here, preferably, the step of cleaning the substrate is a step of performing a plasma treatment using a gas containing oxygen.

And, it is preferable that the method of producing the repellency increasing structure further comprise: a step of forming the substrate on a lower substrate.

A fifth aspect of the present invention provides a liquid ejection head for ejecting droplets of a solution, comprising: an ejection substrate in which multiple through-holes through which the droplets are ejected are formed; and droplet ejection means for allowing the droplets to eject through at least one of the multiple through-holes, wherein a repellency increasing structure according to the first aspect or the second aspect, or a repellency increasing structure produced by a method of producing a repellency increasing structure according to the third aspect or the fourth aspect is arranged in such a manner that a solution ejection surface around the multiple through-holes of the ejection substrate corresponds to the surface of the substrate of the repellency increasing structure in which the multiple recesses and/or the multiple projections are formed.

In the fifth aspect, preferably, the solution is mainly composed of an organic solvent, oil, or a liquid having a surface tension of 40 mN/m or less.

In the fifth aspect of the present invention, preferably, the solution is prepared by dispersing charged particles, and wherein the droplet ejection means comprises: ejection electrodes for exerting an electrostatic force on the solution, the ejection electrodes being arranged in correspondence with the respective multiple through-holes, and a solution guide passing through each of the multiple through-holes and extending toward a droplet ejection side of the ejection substrate, wherein the droplets are ejected by the electrostatic force generated by the ejection electrodes.

Moreover, in the present invention, preferably, the droplet ejection means comprises a droplet ejection unit of a piezoelectric system or a thermal system for ejecting the droplets from the multiple through-holes of the ejection substrate, and the droplets are ejected by the droplet ejection unit.

A sixth aspect of the present invention provides a stain-resistant film including: a repellency increasing structure according to the first or second aspect described above, or a repellency increasing structure produced by a method of producing a repellency increasing structure according to the third or fourth aspect described above, wherein the substrate is a support film.

A seventh aspect of the present invention provides a repellency increasing structure comprising: a substrate composed of a metal, an alloy, or an insulating member, if a surface of the substrate being flat, a flat surface of the substrate showing repellent property with respect to a liquid having a surface tension lower than that of water; an anodized film in which multiple holes are formed, the anodized film being formed on the surface of the substrate; and a repellent layer composed of a repellent material containing fluorine, the repellent layer being formed to cover the anodized film, wherein a thickness of the repellent layer is equal to or less than one half of a diameter of each of the multiple holes.

In the seventh aspect of the present invention, preferably, the substrate is composed of aluminum or an aluminum alloy.

In the seventh aspect, an angle $\alpha$ formed between the surface of the substrate and each of the inner walls of the multiple holes is preferably smaller than 126°, more preferably 90°.

Here, preferably, a radius of curvature at a boundary between the surface of the substrate and each of the inner walls of the multiple holes is smaller than the smaller one of a diameter of each of the multiple holes and a depth thereof, and further preferably, a radius of curvature at a boundary between the surface of the substrate and each of the inner walls of the multiple holes is equal to or less than one half of the smaller one of a diameter of each of the multiple holes and a depth thereof.

An eighth aspect of the present invention provides a method of producing a repellency increasing structure, comprising: a step of preparing a substrate composed of a metal, an alloy, or an insulating member, if a surface of the substrate being flat, a flat surface of the substrate showing repellent property with respect to a liquid having a surface tension lower than that of water; a step of forming an anodized film on the surface of the substrate; a step of forming multiple holes in the anodized film; and a step of forming a repellent layer composed of a repellent material containing fluorine on the anodized film in such a manner a thickness of the repellent layer is equal to or less than one half of a diameter of each of the multiple holes.

A ninth aspect of the present invention provides a liquid ejection head for ejecting droplets of a solution, comprising: an ejection substrate in which multiple through-holes through which the droplets are ejected are formed; and droplet ejection means for allowing the droplets to eject through at least one of the multiple through-holes, wherein a repellency increasing structure according to the seventh aspect described above, or a repellency increasing structure produced by a method of producing a repellency increasing structure according to the eighth aspect described above is arranged in such a manner that a solution ejection surface around the multiple through-holes of the ejection substrate corresponds to the surface of the substrate of the repellency increasing structure in which the multiple recesses and/or the multiple projections are formed.

In the ninth aspect of the present invention, preferably, the solution is prepared by dispersing charged particles, and wherein the droplet ejection means comprises: ejection electrodes for exerting an electrostatic force on the solution, the ejection electrodes being arranged in correspondence with the respective multiple through-holes, and a solution guide passing through each of the multiple through-holes and extending toward a droplet ejection side of the ejection substrate, wherein the droplets are ejected by the electrostatic force generated by the ejection electrodes.

And, in the ninth aspect, preferably, the droplet ejection means comprises a droplet ejection unit of a piezoelectric system or a thermal system for ejecting the droplets from the multiple through-holes of the ejection substrate, and the droplets are ejected by the droplet ejection unit.

Further, in the ninth aspect of the present invention, the diameter of each of the multiple holes is preferably 10 μm or less, more preferably 1 μm or less, and further more preferably 100 nm or less.

Moreover, in the ninth aspect of the present invention, preferably, a surface tension $\gamma_S$ of the anodized film is equal to or more than one fourth of a surface tension $\gamma_L$ of the liquid having the surface tension lower than that of water. Here, preferably, the liquid having the surface tension lower than that of water is an organic solvent, oil, or a liquid having a surface tension of 40 mN/m or less. That is, preferably, a surface tension $\gamma_S$ of the anodized film is equal to or more than one fourth of a surface tension $\gamma_L$ of organic solvent, oil, or the liquid having the surface tension lower than that of water.

Here, preferably, an area ratio A of openings of the multiple holes to the surface of the substrate is 18% or more.

Further, a tenth aspect of the present invention provides a stain-resistant film including: a repellency increasing structure according to the seventh aspect described above, or a repellency increasing structure produced by a method of producing a repellency increasing structure according to the eighth aspect described above, wherein the substrate is a support film.

An eleventh aspect of the present invention provides a liquid ejection head for ejecting droplets of a solution, comprising: an ejection substrate in which multiple through-holes through which the droplets are ejected are formed; and droplet ejection means for allowing the droplets to eject through at least one of the multiple through-holes, wherein the ejection substrate has an uneven portion arranged on the surface of the ejection substrate, the uneven portion has multiple recesses and multiple projections, each of which has a concentric shape in plan view substantially similar to that of each of the multiple through-holes, are alternately formed at a predetermined interval with respect to a direction distant from centers of the multiple through-holes so that they surround surroundings of the multiple through-holes.

In the eleventh aspect of the present invention, preferably, the solution is prepared by dispersing charged particles, and wherein the droplet ejection means comprises: ejection electrodes for exerting an electrostatic force on the solution, the ejection electrodes being arranged in correspondence with the respective multiple through-holes, and a solution guide passing through each of the multiple through-holes and extending toward a droplet ejection side of the ejection substrate, wherein the droplets are ejected by the electrostatic force generated by the ejection electrodes.

Also in the eleventh aspect, preferably, the droplet ejection means comprises a droplet ejection unit of a piezoelectric system or a thermal system for ejecting the droplets from the multiple through-holes of the ejection substrate, and the droplets are ejected by the droplet ejection unit.

Further, in the eleventh aspect, preferably, the ejection substrate has a repellent layer formed on a surface of the uneven portion of the ejection substrate, and a thickness of the repellent layer is equal to or less than one half of a length of each of the multiple recesses in the direction distant from the centers of the multiple through-holes.

Here, preferably, the predetermined interval at which the multiple recesses and the multiple projections are formed is shorter than a diameter of each of the multiple through-holes.

And, preferably, the solution is an organic solvent, oil, or a liquid having a surface tension of 40 mN/m or less.

A twelfth aspect of the present invention provides a method of producing a liquid ejection head including an ejection substrate in which multiple through-holes through which droplets are ejected are formed, comprising: a process of producing the ejection substrate; a process of producing droplet ejection means for allowing droplets of a solution to eject through at least one of the multiple through-holes, wherein the process of producing the ejection substrate comprises: a step of forming a repellent support layer on a surface of a substrate; a step of forming a resist film on a surface of the repellent support layer; a step of forming, in the resist film, a pattern in which multiple recesses and multiple projections, each of which has a concentric shape in plan view substantially similar to that of each of the multiple through-holes, are alternately formed on regions where the multiple through-holes are to be formed in the repellent support layer at a predetermined interval with respect to a direction distant from centers of the multiple through-holes; a step of using as a mask the resist film in which the pattern is formed to form an uneven portion having the multiple recesses and the projections on the surface of the repellent support layer; and a step of forming the multiple through-holes in the regions where the multiple through-holes are to be formed.

In the twelfth aspect of the present invention, it is preferable that the method of producing the liquid ejection head further comprise, prior to the step of forming the multiple through-holes, a step of forming, on a surface of the uneven portion, a repellent layer having a thickness equal to or less than one half of a length of each of the multiple recesses in the direction distant from the centers of the multiple through-holes.

According to the repellency increasing structure according to the first aspect of the present invention, multiple recesses are formed on the surface of the substrate, and the inner walls of the recesses are substantially parallel to the thickness direction of the substrate. As a result, even a substrate exhibiting lyophilic property in its flat surface portion with respect to a liquid having a surface tension lower than that of water such as an organic solvent, oil, or a liquid having a surface tension of 40 mN/m or less can form a contact angle of 90° or more with respect to the liquid having a surface tension lower than that of water such as an organic solvent, oil, or a liquid having a surface tension of 40 mN/m or less. Alternatively, the substrate can increase the contact angle with the liquid, although the contact angle is equal to or less than 90°.

According to the repellency increasing structure according to the second aspect of the present invention, multiple projections are formed on the surface of the substrate, and the outer walls of the projections are substantially parallel to the thickness direction of the substrate. As a result, even a substrate exhibiting lyophilic property in its flat surface portion with respect to a liquid having a surface tension lower than that of water such as an organic solvent, oil, or a liquid having a surface tension of 40 mN/m or less can form a contact angle of 90° or more with respect to the liquid having a surface tension lower than that of water such as an organic solvent, oil, or a liquid having a surface tension of 40 mN/m or less. Alternatively, the substrate can increase the contact angle with the liquid, although the contact angle is equal to or less than 90°.

According to the method of producing a repellency increasing structure according to the third aspect of the present invention, multiple recesses or projections are formed on the surface of the substrate in such a manner that: the inner walls of the recesses or the outer walls of the projections are substantially parallel to the thickness direction of the substrate; and each of the angle $\alpha$ formed between the surface of the substrate and the inner wall of each of the recesses and the angle $\beta$ formed between the upper surface of each of the projections and the outer wall of the projection is smaller than 126°. As a result, even a substrate exhibiting lyophilic property in its flat surface portion with respect to a liquid having a surface tension lower than that of water such as an organic solvent, oil, or a liquid having a surface tension of 40 mN/m or less can form a contact angle of 90° or more with respect to the liquid having a surface tension lower than that of water such as an organic solvent, oil, or a liquid having a surface tension of 40 mN/m or less. Alternatively, the substrate can increase the contact angle with the liquid, although the contact angle is equal to or less than 90°.

According to the method of producing a repellency increasing structure according to the fourth aspect of the present invention, multiple recesses or projections are formed on the surface of the substrate in such a manner that the inner walls of the recesses or the outer walls of the projections are substantially parallel to the thickness direction of the substrate and that the radius of curvature at the boundary between the surface of the substrate and the inner wall of each of the recesses is smaller than the smaller one of: the diameter of each of the recesses or an equivalent diameter; and the depth of each of the recesses, or is smaller than the smaller one of: the diameter of each of the projections or an equivalent diameter; and the depth of each of the projections. As a result, even a substrate exhibiting lyophilic property in its flat surface portion with respect to a liquid having a surface tension lower than that of water such as an organic solvent, oil, or a liquid having a surface tension of 40 mN/m or less can form a contact angle of 90° or more with respect to the liquid having a surface tension lower than that of water such as an organic solvent, oil, or a liquid having a surface tension of 40 mN/m or less. Alternatively, the substrate can increase the contact angle with the liquid, although the contact angle is equal to or less than 90°.

According to the liquid ejection head according to the fifth aspect of the present invention, the repellency increasing structure according to the first or second aspect of the present invention is arranged in such a manner that the surface of the substrate of the repellency increasing structure corresponds to a solution ejection surface around the through-holes of the ejection substrate. As a result, the contact angle of a liquid having a surface tension lower than that of water such as an organic solvent, oil, or a liquid having a surface tension of 40 mN/m or less can be increased, and a meniscus can be stabilized. Therefore, even when a liquid having a surface tension lower than that of water such as an organic solvent, oil, or a liquid having a surface tension of 40 mN/m or less is used for ink, the ink can be ejected consistently. Thus, a high-quality image can be obtained.

According to the stain-resistant film according to the sixth aspect of the present invention, the repellency increasing structure according to the first or second aspect of the present invention is arranged on the surface of the support. As a result, the contact angle of a liquid having a surface tension lower than that of water such as an organic solvent, oil, or a liquid having a surface tension of 40 mN/m or less can be increased, and oil of which contamination is mainly composed can be repelled. Therefore, oil or the like can be easily removed. As a result, contamination due to the adhesion of a fingerprint, sebum, sweat, cosmetics, and the like can be prevented, and contamination can be easily removed. As described above, the stain-resistant film according to the sixth aspect of the present invention can prevent contamination due to a fingerprint, sebum, sweat, cosmetics, and the like, so the film can be suitably used for, for example, a touch panel or a filter to be attached to the surface of any one of various monitors.

According to the repellency increasing structure according to the seventh aspect of the present invention and the method of producing a repellency increasing structure according to the eighth aspect of the present invention, the repellent layer made of a fluorine-containing repellent material is formed to cover the anodized film having formed thereon a large number of holes, and the thickness of the repellent layer is equal to or less than one half of the diameter of each of the holes. As a result, a localized uneven surface profile of the anodized film is maintained. Such surface structure having the localized uneven profile provides two effects: an effect that the contact angle can be made equal to or more than 90° or can be increased even when a substrate exhibiting lyophilic property in its flat surface portion with respect to a liquid having a surface tension lower than that of water is used and the other effect is imparted by the repellent layer. As a result, the contact angle can be made equal to or more than 90° with respect to a liquid having a surface tension lower than that of water such as an organic solvent, oil, or a liquid having a surface tension of 40 mN/m or less. Alternatively, the contact angle can be increased with the liquid, although the contact angle is equal to or less than 90°.

According to the liquid ejection head according to the ninth aspect of the present invention, the repellency increasing structure according to the first aspect of the present invention which includes the repellent layer made of a fluorine-containing repellent material to cover the anodized film having formed thereon a large number of holes, the repellent layer having a thickness equal to or less than one half of the diameter of each of the holes, is arranged in such a manner that the surface of the substrate corresponds to a solution ejection surface around the through-holes of the ejection substrate. As a result, a localized uneven surface profile of the anodized film is maintained. The surface structure having the localized uneven profile provides two effects: an effect that the contact angle can be made equal to or more than 90° or can be increased even when a substrate exhibiting lyophilic property in its flat surface portion with respect to a liquid having a surface tension lower than that of water is used and the other effect is imparted by the repellent layer. As a result, the contact angle can be made equal to or more than 90° with respect to a liquid having a surface tension lower than that of water such as an organic solvent, oil, or a liquid having a surface tension of 40 mN/m or less. Alternatively, the contact angle can be increased with the liquid, although the contact angle is equal to or less than 90°. Thus, a meniscus can be stabilized. Therefore, even when a liquid having a surface tension lower than that of water such as an organic solvent, oil, or a liquid having a surface tension of 40 mN/m or less is used for ink, the ink can be ejected consistently. Thus, a high-quality image can be obtained.

According to the stain-resistant film according to the tenth aspect of the present invention, the repellency increasing structure according to the seventh aspect of the present invention is arranged on the surface of the support. As a result, the contact angle of a liquid having a surface tension lower than that of water such as an organic solvent, oil, or a liquid having a surface tension of 40 mN/m or less can be increased, and oil of which contamination is mainly composed can be repelled. Therefore, oil or the like can be easily removed. As a result, contamination due to the adhesion of a fingerprint, sebum, sweat, cosmetics, and the like can be prevented, and contamination can be easily removed. As described above, the stain-resistant film according to the tenth aspect of the present invention can prevent contamination due to a fingerprint, sebum, sweat, cosmetics, and the like, so the film can be suitably used for, for example, a touch panel or a filter to be attached to the surface of any one of various monitors.

According to the liquid ejection head according to the eleventh aspect of the present invention and the method of producing a liquid ejection head according to the twelfth aspect of the present invention, recesses and projections are formed on the surface of the ejection substrate having formed therein multiple through-holes through which the droplets are ejected. The recesses and projections, each of which has a shape in plan view substantially similar to that of each of the through-holes, are alternately formed at predetermined intervals in the radial direction from the center of each through-hole so that they surround the through-holes. As a result, the contact angle with the solution can be increased even when the solution is an organic solvent, oil, or a liquid having a surface tension of 40 mN/m or less. In addition, the solution can be collected in a circular shape in the through-holes because the uneven portion is formed around the through-holes. Thus, a meniscus can be stabilized without being changed with time. Therefore, even when an organic solvent, oil, or a liquid having a surface tension of 40 mN/m or less each having a low surface tension is used for ink, the ink can be ejected consistently. Thus, a high-quality image can be obtained.

DETAILED DESCRIPTION OF THE PREFERRED EMBODIMENTS

Hereinafter, the repellency increasing structure and the method of producing the same, the liquid ejection head and the method of producing the same, and the stain-resistant film of the present invention will be described in detail on the basis of preferred embodiments shown in the accompanying drawings.

Figure 1:
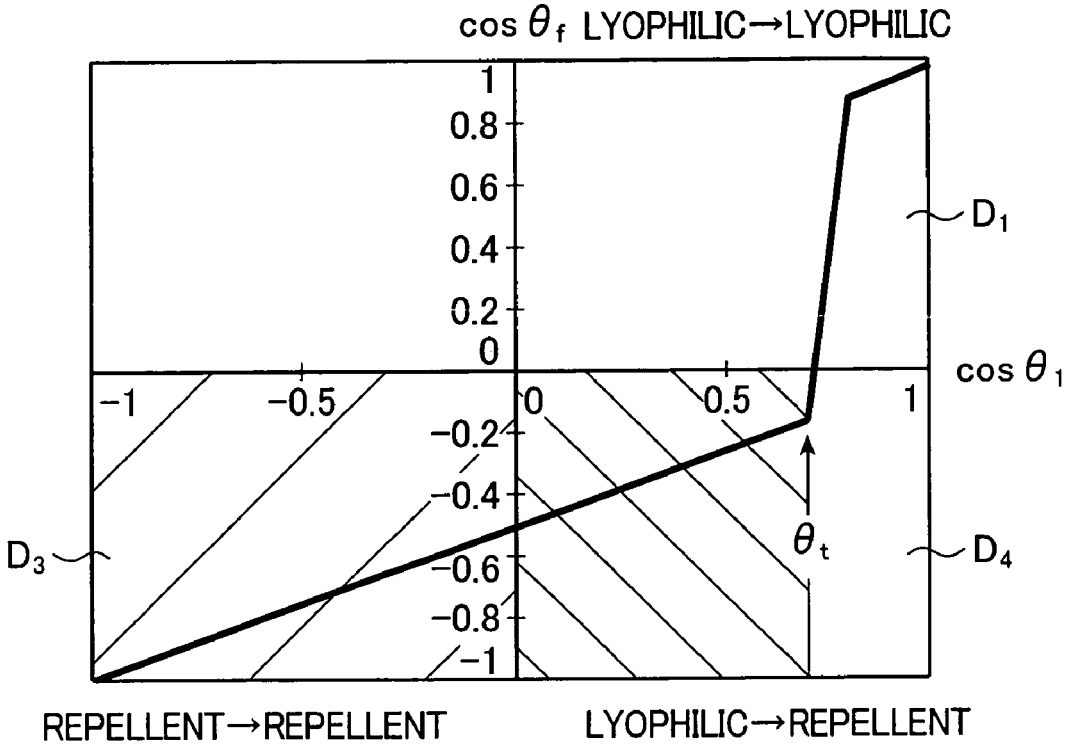
FIG. 1 is a graph showing a relationship between the contact angle $\theta_1$ and the apparent contact angle $\theta_f$ in a surface structure model of the present invention in which the axis of ordinates indicates cos $\theta_f$ and the axis of abscissas indicates cos $\theta_1$.

FIG. 1 is a graph showing a relationship between the contact angle $\theta_1$ and the apparent contact angle of in a surface structure model of the present invention in which the axis of ordinates indicates cos $\theta_f$ and the axis of abscissas indicates cos $\theta_1$.

The inventors of the present invention have made extensive studies about a surface structure and a repellent material. As a result, they have found that improvement from lyophilic property to repellency is possible through the effect of air inclusion in recesses based on the modification of the Cassie model owing to the optimized surface structure and repellent material. That is, they have found that even in a solid having a contact angle of 90° or less (a lyophilic material), the contact angle can be increased to 90° or more, or increased to some extent although the contact angle is not more than 90° depending on the surface structure. Thus, they have found means for increasing the contact angle with respect to even a liquid having a low surface tension such as an organic solvent or oil, thereby achieving the present invention.

Figure 46:
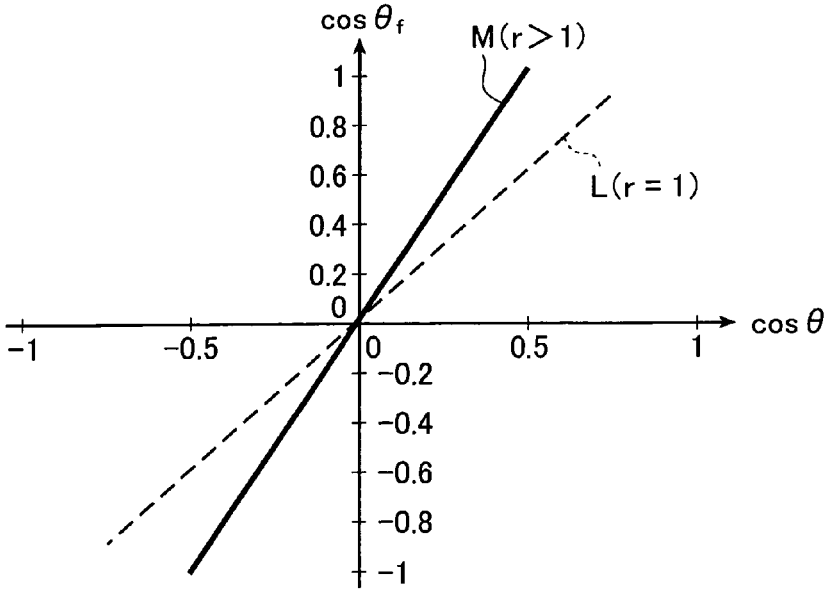
FIG. 46 PRIOR ART
FIG. 46 is a graph showing a relationship between the contact angle $\theta$ and the apparent contact angle $\theta_f$ in the Wentzel model in which the axis of ordinates indicates cos $\theta_f$ and the axis of abscissas indicates cos $\theta$.
Figure 47:
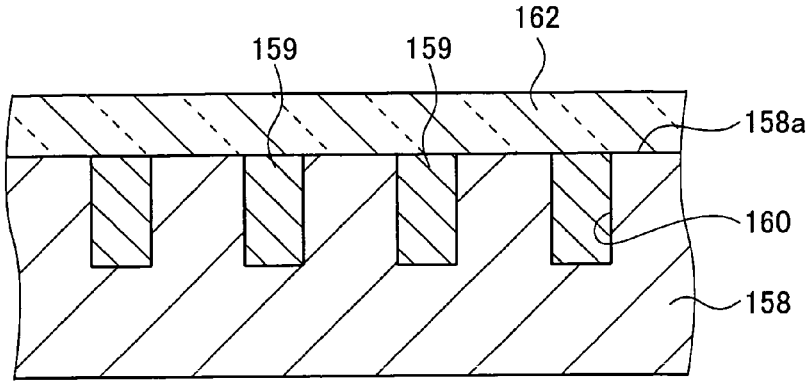
FIG.47 PRIOR ART
FIG. 47 is a schematic view showing a Cassie model.
Figure 49:
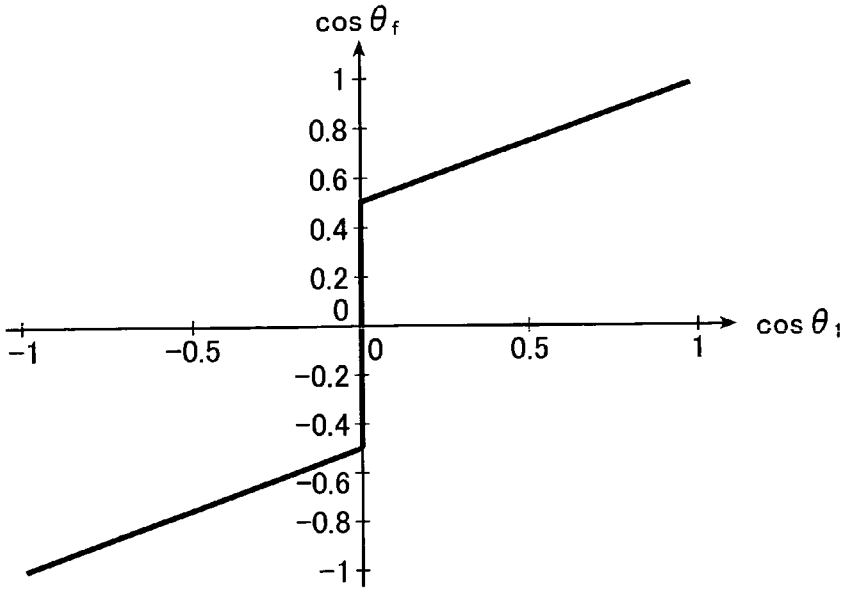
FIG.49 PRIOR ART
FIG. 49 is a graph showing a relationship between the contact angle $\theta_1$ and the apparent contact angle $\theta_f$ in the Cassie model in which the axis of ordinates indicates cos $\theta_f$ and the axis of abscissas indicates cos $\theta_1$.
Figure 50:
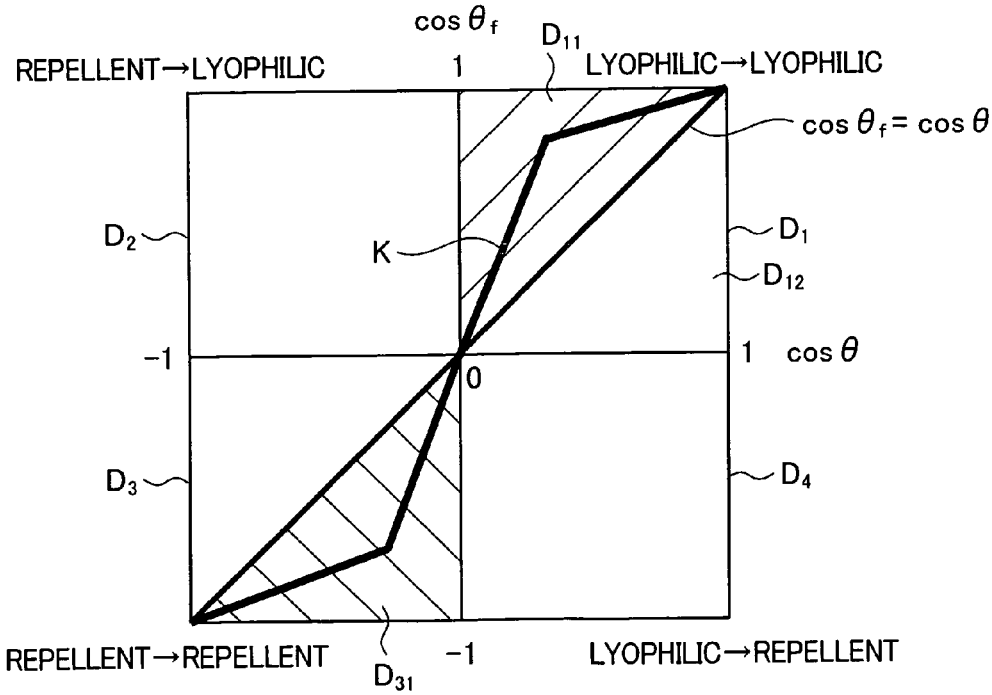
FIG.50 PRIOR ART
FIG. 50 is a graph showing a relationship between the contact angle $\theta$ and the apparent contact angle $\theta_f$ in a Wentzel-Cassie integrated model in which the axis of ordinates indicates cos $\theta_f$ and the axis of abscissas indicates cos $\theta_1$.

In a generally well known model (such as a Wentzel model or a Cassie model), it is impossible to improve repellency unless a solid material itself has repellency (see FIG. 46, FIG. 49, and FIG. 50). According to such models, it can be easily expected that a large contact angle is obtained with respect to a liquid having a high surface tension such as water, but the solid material has a small contact angle with respect to a liquid having a low surface tension such as an organic solvent or oil and hence has no repellency. In many reports, high repellency has been reported based on the experimental results obtained with water, but no experiment has been conducted using an organic solvent, oil, or the like. In addition, many inventions show examples (experimental results) on the repellency with respect to water and no additional experiments have been conducted. Furthermore, a description indicating repellency with respect to an organic solvent, oil, or the like can also be found, although lack of repellency can be expected from a conventional model. Those inventions cannot be said to be obtained from correct findings.

In view of the foregoing, the inventors of the present invention have made detailed studies about the shape of an uneven surface structure. As a result, they have found that a Cassie model may be modified. That is, even if a material has by nature a contact angle of 90° or less, the contact angle can be increased through introduction of a surface structure in the material. When a material has by nature a contact angle of 90° or less in a conventional model, the contact angle is reduced through introduction of a surface structure. That is, a lyophilic material is made more lyophilic.

Figure 48A:
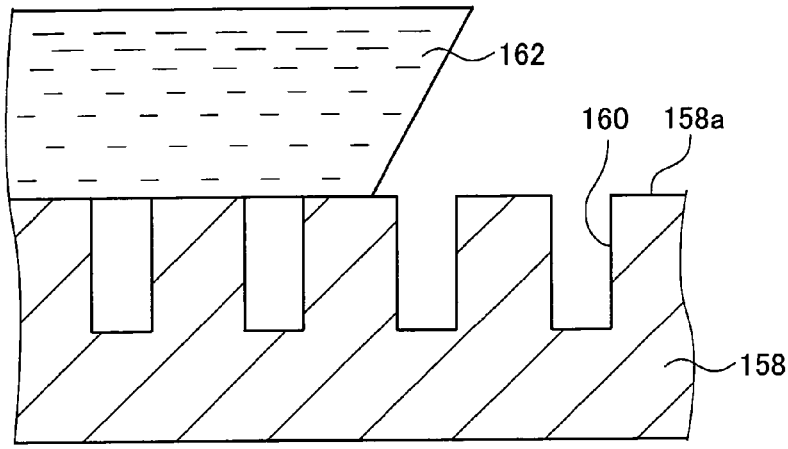
FIG.48A PRIOR ART
FIG. 48A is a schematic sectional view showing a state where a solid has repellency in the Cassie model.
Figure 48B:
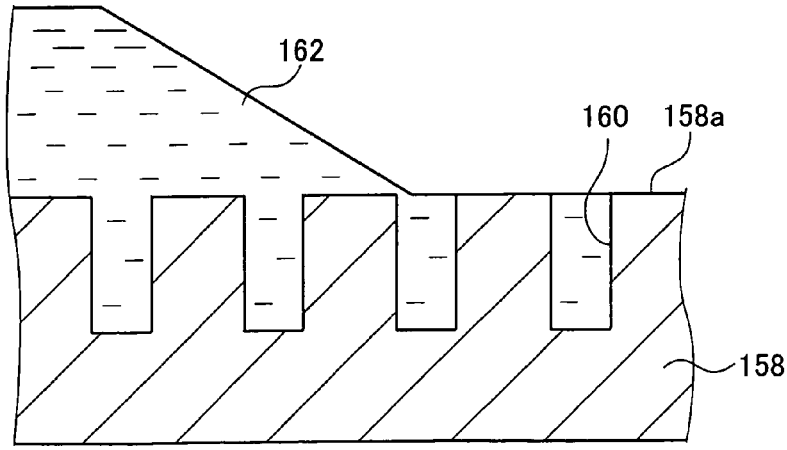
FIG.48B PRIOR ART
FIG. 48B is a schematic sectional view showing a state where the solid has lyophilic property in the Cassie model.

Even when the contact angle $\theta_1$ determined by the properties of a material is 90° or less ($\cos\theta_1>0$), the state where the recesses 160 are filled with air is maintained (see FIG. 48 and the expression 8), and, as shown in FIG. 1, the contact angle $\theta_f$ increases. In this case, the contact angle $\theta_f$ is represented by the following expression 10.

$$\cos\theta_f=(1-A_2)\cos\theta_1-A_2\ (\theta_1<90°,\theta_t>90°,\theta_2=180°) \quad (10)$$

Then, when a certain value ($\theta_1=\theta_t$ (transition angle)) is exceeded, lyophilic property is exhibited in accordance with the Cassie model (see FIG. 49 and the expression 9). The transition angle $\theta_t$ in the Cassie model is 90° but it has been found that by providing the solid with an uneven surface profile, the transition angle $\theta_t$ is shifted to 90° or less.

In the present invention, a solid that is lyophilic with respect to a predetermined liquid at an angle smaller than the transition angle $\theta_t$ is allowed to be repellent with respect to the predetermined liquid. The transition angle is related to, for example, the sharpness of the recesses or projections and the angle formed by the recesses or projections.

In general, lyophilic property and repellency are distinguished from each other at a contact angle of 90° as a reference. However, there are no grounds for the distinction thermodynamically. In each of the Wentzel model and the Cassie model, lyophilic property and repellency are separately treated, and the boundary between the two properties is not taken into consideration at all. In the Wentzel model, when a material has by nature a contact angle of 90°, the contact angle remains unchanged (is 90°) even if a surface structure is introduced. In the Cassie model, a sharp change is supposed to occur around 90°. In an actual surface, behaviors represented by both the models should be simultaneously present, so detailed examination at a contact angle of around 90° is needed. As a result of the detailed examination, it has been found that, in a surface structure according to the Cassie model, the transition angle at which a sharp change occurs varies depending on the surface structure and even a lyophilic material may be rendered repellent owing to the surface structure.

In FIG. 1, the first quadrant $D_1$ is a region in which a solid which is repellent with respect to a predetermined liquid becomes repellent. The third quadrant $D_3$ is a region in which a solid which is lyophilic with respect to a predetermined liquid becomes lyophilic. The fourth quadrant $D_4$ is a region in which a solid which is lyophilic with respect to a predetermined liquid becomes repellent.

The inventors of the present invention have made extensive studies about a surface structure and a repellent material. As a result, they have found that repellency is increased by the effect based on the modification of the Wentzel model or the Cassie model owing to the optimized surface structure and repellent material, which enables improvement from lyophilic property to repellency. That is, they have found that even in a solid whose contact angle is 90° or less (a lyophilic material), the contact angle is increased to 90° or more, or is increased to some extent although the contact angle is not more than 90° by introducing a surface structure in the solid. Thus, they have found means for imparting repellency to the solid so that the solid is repellent with respect to a liquid having a low surface tension such as an organic material or oil.

As shown in FIG. 50, in the Wentzel-Cassie integrated model, the value of the apparent contact angle $\theta_f$ with respect to the contact angle $\theta$ falls within the first A quadrant $D_{11}$ of the first quadrant $D_1$ and the third A quadrant $D_{31}$ of the third quadrant $D_3$ with the line of $\cos\theta_f=\cos\theta$ as a boundary, and moves only in the first A quadrant $D_{11}$ and the third A quadrant $D_{31}$. The first A quadrant $D_{11}$ is a region in which lyophilic property increases and the contact angle reduces. The third A quadrant $D_{31}$ is a region in which repellency increases and the contact angle increases. In the Wentzel-Cassie integrated model, it can also be easily expected that, even when a large contact angle is obtained with respect to a liquid having a high surface tension such as water, the contact angle with respect to a liquid having a low surface tension such as an organic solvent or oil is small and hence no repellency is exhibited.

The other regions of FIG. 50 are seen next. A first B quadrant $D_{12}$ is a region in which lyophilic property is reduced (that is, repellency is increased) by introducing a surface structure to a solid material having lyophilic property. In the first B quadrant $D_{12}$, the contact angle is increased by introducing a surface structure; provided, however, that the contact angle is 90° or less.

The fourth quadrant $D_4$ is a region in which a solid material having lyophilic property is changed to a repellent material by introducing a surface structure to the solid material. This means that the introduction of a surface structure increases the contact angle of a solid material of 90° or less to be 90° or more.

Figure 2:
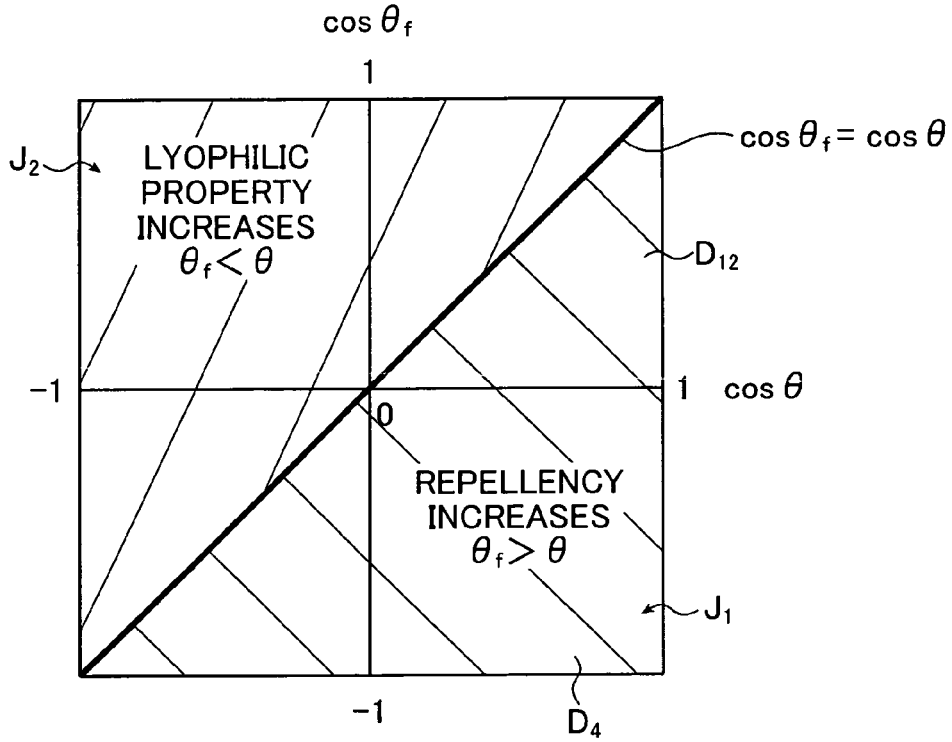
FIG. 2 is a graph showing a repellency increasing region and a lyophilic property increasing region in which the axis of ordinates indicates cos $\theta_f$ and the axis of abscissas indicates cos $\theta_1$.

Therefore, each of the third A quadrant $D_{31}$, the first B quadrant $D_{12}$, and the fourth quadrant $D_4$ can be said to be a region in which repellency increases. As shown in FIG. 2, a region $J_1$ in a lower half and a region $J_2$ in an upper half with respect to the line of $\cos\theta_f=\cos\theta$ as a boundary can be defined as a repellency increasing region and a lyophilic property increasing region, respectively.

In view of the foregoing, the inventors of the present invention have made detailed studies about the uneven surface profile. As a result, they have found that the conventional Wentzel-Cassie integrated model may be modified. That is, even when the contact angle is 90° or less due to the properties of a material, the contact angle can be increased by introducing a surface structure. This means that the value of the apparent contact angle $\theta_f$ with respect to the contact angle $\theta$ can move to the first B quadrant $D_{12}$ and the fourth quadrant $D_4$ of FIG. 2 depending on a surface structure.

Figure 3:
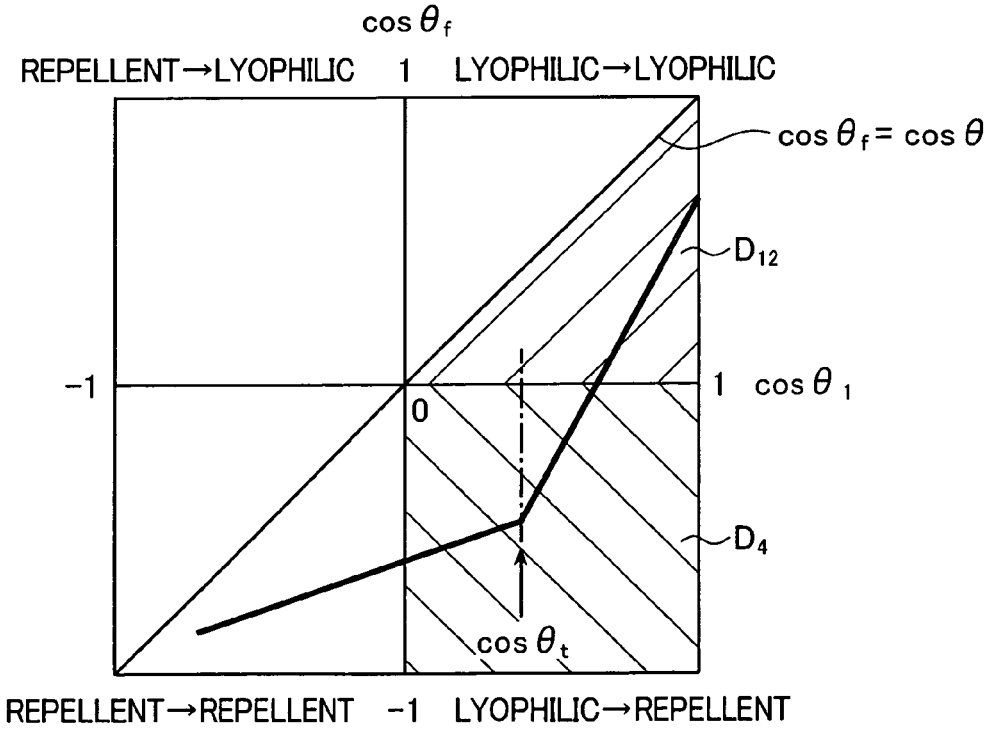
FIG. 3 is a graph showing a further detailed relationship between the contact angle $\theta_1$ and the apparent contact angle $\theta_f$ in the surface structure model of the present invention in which the axis of ordinates indicates cos $\theta_f$ and the axis of abscissas indicates cos $\theta_1$.

FIG. 3 is a graph showing results obtained by making the detailed studies.

Even when the contact angle $\theta_1$ determined by the properties of a material is 90° or less ($\cos\theta_1>0$), the state where the recesses 160 are filled with air is maintained (see FIG. 48 and the expression 8), and the contact angle $\theta$ increases.

In this case, the contact angle $\theta_f$ is represented by the following expressions 11 and 13. The expression 11 holds true even when there is no restriction ($\theta_1>90°$) on the repellency in the Cassie model (the expression 8) and the contact angle $\theta_1$ is 90° or less. The expression 11 holds true when the contact angle $\theta_1$ is larger than the transition angle $\theta_t$ obtained from the expression 12.

$$\cos\theta_f=(1-A)\cos\theta_1-A(\theta_t<90°,\theta_1>\theta_t) \quad (1)$$

$$\theta_t=\cos^{-1}\left(\frac{b-A}{r+A-1}\right) \quad (12)$$

In addition, a modified Wentzel model (the following expression 13) holds true when the contact angle $\theta_1$ is smaller than $\theta_t$. In the expression 13, an additional factor b is added. The additional factor b is a coefficient that mainly depends on A.

According to the expression 13, the value of the apparent contact angle $\theta_f$ with respect to the contact angle $\theta_1$ remains within the fourth quadrant $D_4$ and the first B quadrant $D_{12}$ as repellency increasing regions even at an angle equal to or larger than the transition angle $\theta_t$. This phenomenon can be observed as if the transition angle at which the transition from a Cassie model to a Wentzel model occurs in a conventional Wentzel-Cassie integrated model shifted toward the right direction (toward $\cos\theta_1=1$).

$$\cos\theta_f = r\cos\theta_1 - b(\theta_t<90°, \theta_1<\theta_t) \quad (13)$$

In the present invention, even if a solid is lyophilic with respect to a predetermined liquid, the solid is allowed to be repellent with respect to the predetermined liquid or the contact angle is allowed to be increased although the solid remains lyophilic. Such tendency is related to the angle of an recess or projection and the pattern shape.

As described above, in each of the Wentzel model and the Cassie model, lyophilic property and repellency are separately treated, and the boundary between the two properties is not taken into consideration at all. In the actual solid surface, behaviors represented by both the Wentzel model and the Cassie model should be simultaneously present, so detailed examination at an contact angle of around 90° is needed. As a result of the detailed examination made by the inventors of the present invention, it has been found that, in an uneven surface profile which has however substantially flat, properties as shown in FIG. 3 are obtained depending on the pattern and angle of a recess or a projection by the estimation from a conventional model and that the introduction of a surface structure allows even a lyophilic solid to exhibit repellency.

Figure 4A:
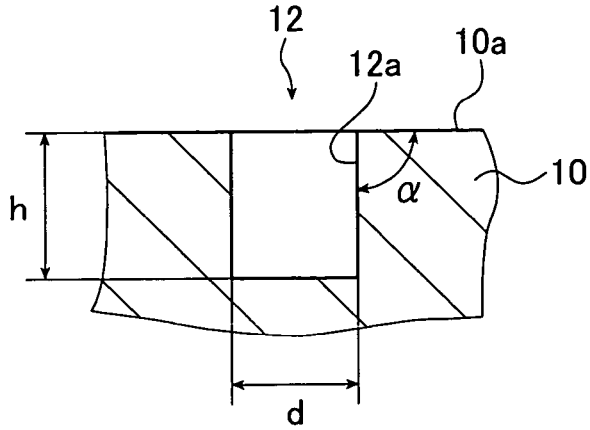
FIGS. 4A to 4C are schematic sectional views each showing the shape of a recess in the surface structure model of the present invention.

At first, a solid having recesses will be described. In the present invention, as shown in FIG. 4A, a recess 12 having a circular opening is formed in a solid (substrate) 10. In the recess 12, the side wall (inner wall) 12*a* of the recess 12 is formed so as to be substantially parallel to the thickness direction of the solid 10.

When the boundary between the side wall (inner wall) 12*a* of the recess 12 and the surface 10*a* of the solid 10 discontinuously changes, a droplet hardly enters the recess 12. The reason for this is as follows: In order that the droplet may enter the recess 12, air inside the recess 12 must be expelled and exchanged for the droplet. The same holds true for the case where the solid 10 has lyophilic property with respect to the droplet. The transition angle is determined by the ease with which air is exchanged for the droplet. The ease with which air is exchanged for the droplet varies depending on the angle $\alpha$ formed between the side wall 12*a* in the recess 12 and the surface 10*a* of the solid 10.

Figure 4B:
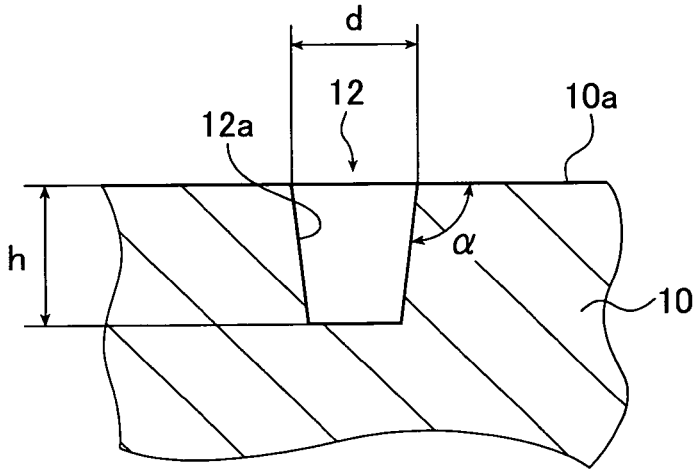

In addition, as shown in FIG. 4B, as the angle $\alpha$ increases, the ease with which air is exchanged for the droplet increases, and the transition angle $\theta_t$ becomes 90° or more. The angle $\alpha$ capable of reducing the transition angle $\theta_t$ is 126° or less, or desirably 115° or less.

Figure 4C:
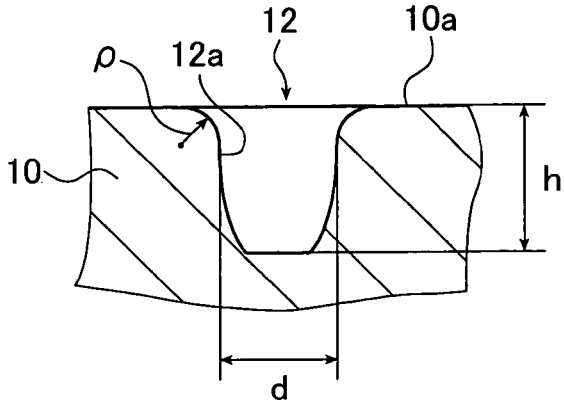

In addition, as shown in FIG. 4C, even when the boundary between the side wall 12*a* in the recess 12 and the surface 10*a* of the solid 10 continuously changes, the ease with which air is exchanged for the droplet increases. The radius of curvature at the boundary between the side wall 12*a* and the surface 10*a* of the solid 10 is denoted by $\rho$. The ease with which air is exchanged for the droplet increases depending on the relationship among the radius of curvature $\rho$, the diameter d of the recess 12, and the depth h of the recess 12, and hence the transition angle $\theta_t$ becomes 90° or more. To reduce the transition angle $\theta_t$, the radius of curvature $\rho$ should be smaller than the smaller one of the diameter d of the recess 12 and the depth h of the recess 12, or desirably equal to or less than one half of the smaller one of the diameter d of the recess 12 and the depth h of the recess 12. The depth h is desirably 1 μm or more, or more desirably 2 μm or more.

The diameter d of each recess 12 has only to be negligibly small as compared to a droplet, and is desirably 50 μm or less, more desirably 10 μm or less, or still more desirably 5 μm or less.

Figure 5A:
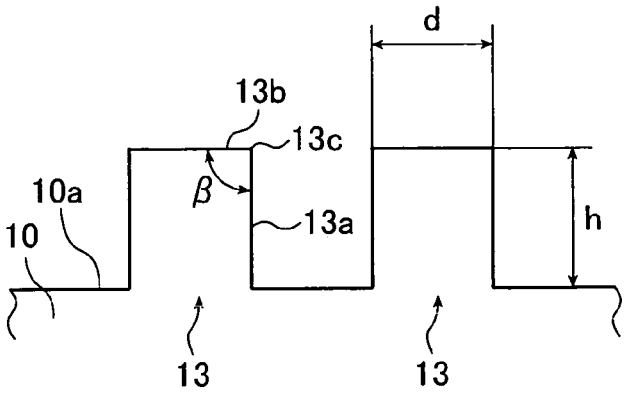
FIGS. 5A to 5C are schematic sectional views each showing the shape of a projection in the surface structure model of the present invention.

Next, a solid having projections will be described. In the present invention, as shown in FIG. 5A, two cylindrical projections 13 are independently formed on a solid (substrate) 10. The outer wall 13*a* of each of the projections 13 is formed so as to be substantially parallel to the thickness direction of the solid 10.

When the boundary between the outer walls 13*a* of the respective projections 13 discontinuously changes, a droplet hardly enters a gap between the projections 13. The reason for this is as follows: In order that the droplet may enter the gap between the projections 13, air inside the gap between the projections 13 must be expelled and exchanged for the droplet. The same holds true for the case where the solid 10 has lyophilic property with respect to the droplet. The transition angle is determined by the ease with which air is exchanged for the droplet. The ease with which air is exchanged for the droplet varies depending on the angle $\beta$ formed between the outer wall 13*a* in the projection 13 and the upper surface 13*a* of the projection 13 (hereinafter also referred to as the angle $\beta$ of a corner 13*c*).

Figure 5B:
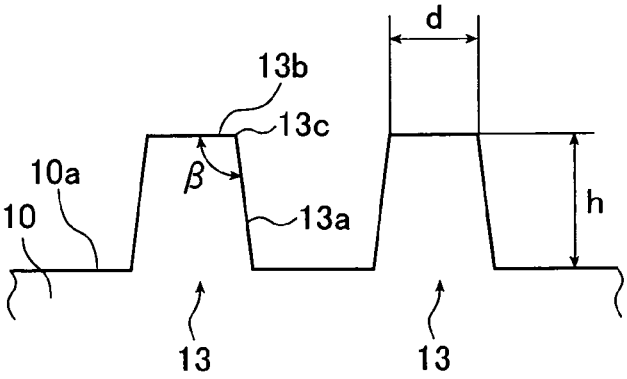

In addition, as shown in FIG. 5B, as the angle $\beta$ of the corner 13*c* increases, the ease with which air is exchanged for the droplet increases, and the transition angle $\theta_t$ becomes 90° or more. The angle $\beta$ capable of reducing the transition angle $\theta_t$ is 126° or less, or desirably 115° or less.

Figure 5C:
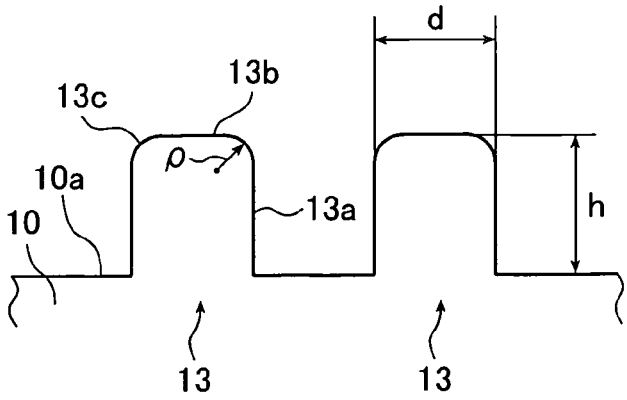

In addition, as shown in FIG. 5C, even when the boundary between the outer wall 13*a* and upper surface 13*b* of the projection 13 continuously changes, the ease with which air is exchanged for the droplet increases. The radius of curvature at the boundary between the outer wall 13*a* and upper surface 13*b* of the projection 13 (the corner 13*c*) is denoted by $\rho$. The ease with which air is exchanged for the droplet increases depending on the relationship among the radius of curvature $\rho$, the diameter d of the projection 13, and the height (depth) h of the projection 13, and hence the transition angle $\theta_t$ becomes 90° or more. To reduce the transition angle $\theta_t$, the radius of curvature $\rho$ should be smaller than the smaller one of the diameter d of the projection 13 and the height (depth) h of the projection 13, or desirably equal to or less than one half of the smaller one of the diameter d of the projection 13 and the height (depth) h of the projection 13. The height h of the projection 13 is desirably 1 μm or more, or more desirably 2 μm or more.

The diameter d of each projection 13 has only to be negligibly small as compared to a droplet, and is desirably 50 μm or less, more desirably 10 μm or less, or still more desirably 5 μm or less. In the present invention, the height of the projection 13 is treated as the same as the depth of the recess, and the same reference numeral is given to the height and the depth.

Conditions under which an uneven surface profile is introduced to a lyophilic solid to increase repellency differ depending on the uneven pattern. In addition, the ratio at which the contact angle increases owing to the surface structure varies depending on the area ratio of recesses and the surface tension of the solid itself. At first, a pattern in which multiple recesses 12 each having a circular opening or multiple cylindrical projections 13 are formed on the surface of a solid will be described.

Based on the expressions 1 and 10, the relationship among the apparent contact angle $\theta_f$, the area ratio A, the surface tension of a liquid, and the surface tension of a solid is represented by the following expression 14. In the following expression 14, the relationship by which the apparent contact angle $\theta_f$ becomes 90° or more is represented by the following expression 15. Even when the contact angle on a flat surface is 90° or less, the contact angle can be made equal to or more than 90°, or can be increased although the contact angle is equal to or less than 90°, by determining a solid material satisfying the relationship with a target liquid and the area ratio A of recesses.

$$\theta_f = \cos^{-1}\left[(1-A)\left(\sqrt{\frac{4\gamma_S}{\gamma_L}}-1\right)-A\right] \tag{14}$$

$$A > 1-\sqrt{\frac{\gamma_L}{4\gamma_S}} \tag{15}$$

Figure 6A:
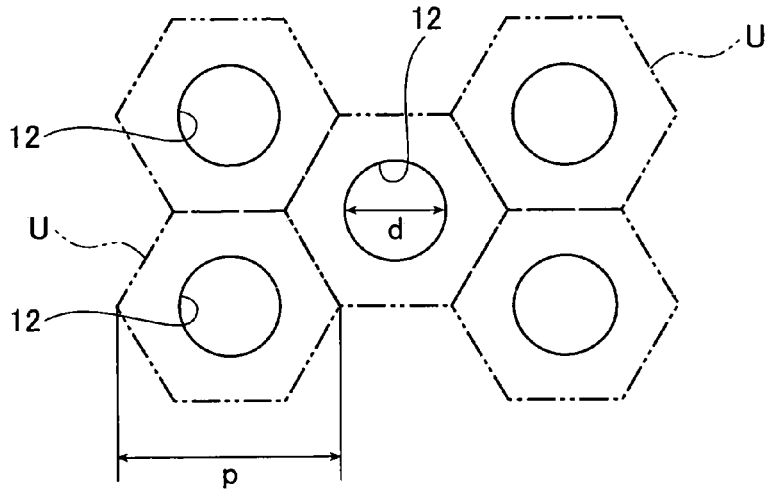
FIG. 6A is a schematic view showing a model for calculating the area ratio of a recess having a circular opening in the surface structure model of the present invention.

The area ratio A of the recesses 12 in the expressions 14 and 15 is the area ratio of the recesses 12 calculated on the basis of the assumption that the cylindrical recesses 12 having the same size are formed at the centers of virtual hexagons U as shown in FIG. 6A. That is, the area ratio refers to an area ratio in the case where the recesses 12 are formed most densely. The area ratio A is represented by the following expression 16. In the following expression 16, d represents the diameter of each recess 12 and p represents the size of each hexagon U.

$$A = \frac{2\sqrt{3}\pi}{9}\left(\frac{d}{p}\right)^2 \tag{16}$$

The area ratio A of the recesses 12 is preferably 18% or more, more preferably 40% or more, or still more preferably 60% or more. Increase in the area ratio A of the recesses 12 allows the frequency at which a liquid contacts air to be increased, thereby increasing the apparent contact angle $\theta_f$.

Figure 6B:
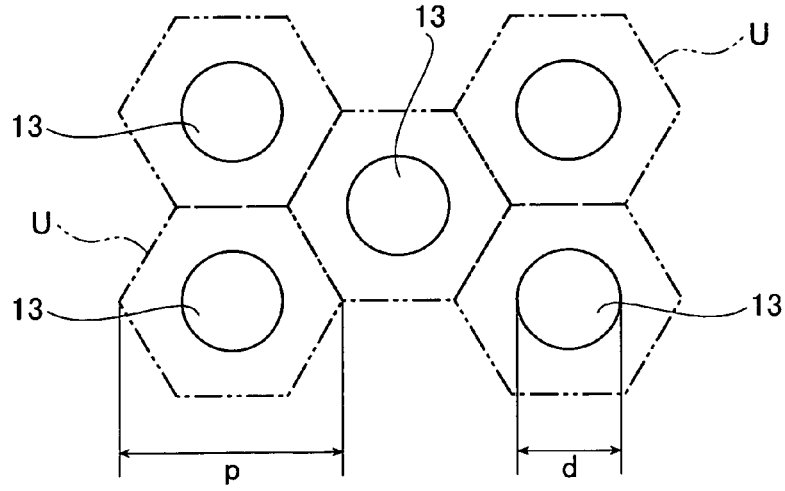
FIG. 6B is a schematic view showing a model for calculating the area ratio of a columnar projection in the surface structure model of the present invention.

The area ratio A of the projections 13 in a projection pattern including the projections 13 is the area ratio of the projections 13 calculated on the basis of the assumption that the cylindrical projections 13 having the same size are formed at the centers of virtual hexagons U as shown in FIG. 6B. That is, the area ratio refers to an area ratio in the case where the projections 13 are formed most densely. The area ratio A is represented by the following expression 17. In the following expression 17, d represents the diameter of each projection 13 and p represents the size of each hexagon U.

$$A = 1-\frac{2\sqrt{3}\pi}{9}\left(\frac{d}{p}\right)^2 \tag{17}$$

The area ratio A of the projections 13 to the surface 10*a* of the solid 10 is preferably 64% or less, or more preferably 40% or less. Decrease in the area ratio A of the projections 13 to the surface 10*a* of the solid 10 allows the frequency at which liquid contacts air to be increased, thereby increasing the apparent contact angle $\theta_f$.

In the present invention, the recess 12 is not limited to one having a circular opening. A recess having a square opening is also adopted. In this case as well, a substrate having a flat surface is formed, and multiple recesses each having a square opening are formed on the surface of the substrate. In such pattern, respective recesses, that is, regions in which air is included are independent of each other.

Conditions including: the angle α causing an increase in repellency; values for the length d of one side of each recess and the depth h of each recess; and the radius of curvature ρ at a corner (boundary) in each recess having a square opening are the same as those in the recess 12 having a circular opening.

Figure 7A:
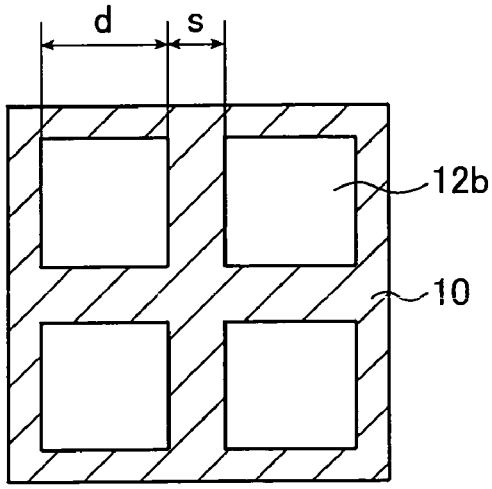
FIG. 7A is a schematic view showing a model for calculating the area ratio of a recess having a square opening in the surface structure model of the present invention.

The area ratio A of recesses 12*b* each having a square sectional shape is the area ratio calculated on the basis of the assumption that the square recesses 12*b* are formed in a matrix fashion as shown in FIG. 7A. The area ratio A of the recesses 12*b* is represented by the following expression 18. In the following expression 18, d represents the length of one side of each recess 12*b* and *s* represents the interval between adjacent recesses 12*b*. When the recess 12 is of an elliptical shape or a polygonal shape, the equivalent diameter can be used instead of the diameter d for the recess having a circular opening.

The term "equivalent diameter" as used herein refers to the length represented by "4×area/total length of sides (or total perimeter)". In a square, the equivalent diameter is $(4\times d^2)/(4\times d)=d$. Therefore, the length of one side represents the equivalent diameter in a square.

$$A = \left(\frac{d}{d+s}\right)^2 \tag{18}$$

The area ratio A is preferably 20% or more, more preferably 40% or more, or still more preferably 60% or more. Increase in the area ratio A of the recesses 12 allows the frequency at which a liquid contacts air to be increased, thereby increasing the apparent contact angle $\theta_f$.

When multiple square prism-shaped projections 13*d* are formed on the surface of a substrate, the projections 13*d* are independent of each other and gaps (recesses) are communicate with each other. Accordingly, air is present in the gaps (recesses) and the regions are commonly present without being separated from each other. Conditions including: the angle β of the corner of each projection 13*d* causing an increase in repellency; values for the length d of one side of each projection 13*d* and the height h of each projection 13*d*; and the radius of curvature ρ at a corner (boundary) are the same as those in the cylindrical projection 13.

The length d of one side of each projection 13*d* has only to be negligibly small as compared to a droplet as in the case of the cylindrical projection 13, and is desirably 50 μm or less, or more desirably 10 μm or less. In addition, the height h of the projection 13*d* is desirably 2 μm or more, or more desirably 4 μm or more.

Figure 7B:
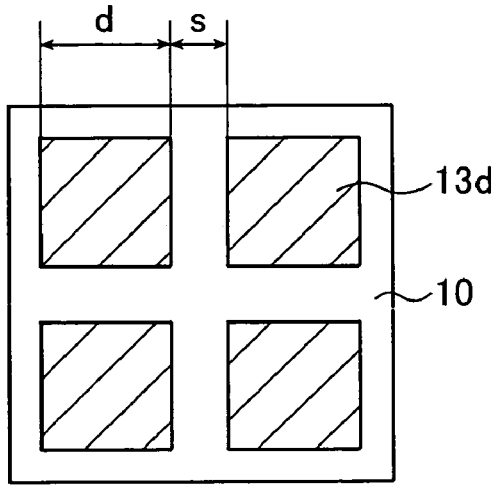
FIG. 7B is a schematic view showing a model for calculating the area ratio of a square prism-shaped projection in the surface structure model of the present invention.

The area ratio A of the projections 13*d* is the area ratio calculated on the basis of the assumption that the square prism-shaped projections 13*d* are formed in a matrix fashion as shown in FIG. 7B. The area ratio A of the projections 13*d* is represented by the following expression 19. In the following expression 19, d represents the length of one side of each projection 13*d* and *s* represents the gap between adjacent projections 13*d*. When the upper surface of the projection 13*d* is of an elliptical shape or a polygonal shape, the equivalent diameter can be used instead of the diameter d for the projection whose upper surface has a circular shape.

The term "equivalent diameter" as used herein refers to the length represented by "4×area/total length of sides (or total perimeter)". The length of one side represents the equivalent diameter in a square.

$$A = 1 - \left(\frac{d}{d+s}\right)^2 \tag{19}$$

The area ratio A of the projections 13*d* to the solid (substrate) 10 (hereinafter simply referred to as the area ratio of the projections) is desirably 64% or less, or more desirably 40% or less. Decrease in the area ratio A of the projections 13*d* allows the frequency at which liquid contacts air to be increased, thereby increasing the apparent contact angle $\theta_f$.

It should be noted that an uneven pattern having an area ratio departing from the range of the area ratio A is less effective in increasing repellency on the surface of a lyophilic solid to be obtained in the present invention.

Hereinafter, embodiments of the present invention will be described in detail.

First Embodiment

Figure 8:
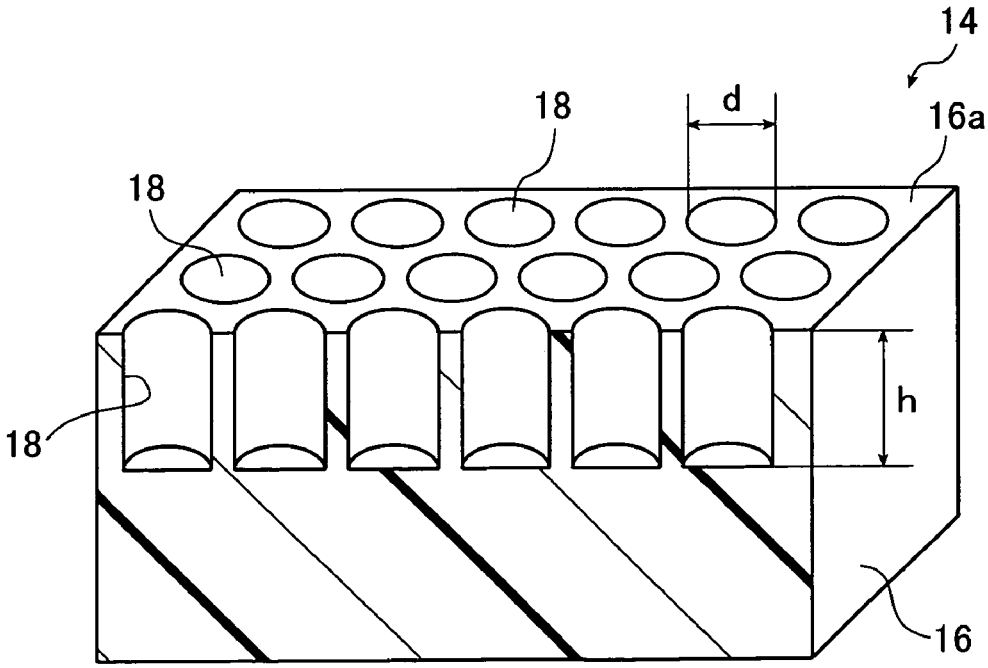
FIG. 8 is a schematic perspective view showing a repellency increasing structure according to a first embodiment of the present invention.

FIG. 8 is a schematic perspective-view showing a repellency increasing structure according to a first embodiment of the present invention.

As shown in FIG. 8, a repellency increasing structure 14 of this embodiment includes: a substrate 16 having a flat surface; and multiple recesses 18 formed on the surface of the substrate 16.

The substrate 16 has a flat surface and a uniform thickness. The substrate 16 does not exhibit repellency with respect to an organic solvent, oil, or a liquid having a surface tension of 40 mN/m or less in a flat state where nothing is formed on its surface. In this case, the substrate exhibits lyophilic property. That is, the contact angle with a liquid is less than 90°. In addition, the surface tension $\gamma_S$ of the substrate 16 is equal to or more than one fourth of the surface tension $\gamma_L$ of an organic solvent, oil, or a liquid having a surface tension of 40 mN/m or less.

Furthermore, the substrate 16 is made of, for example, a polymeric material containing fluorine, a fluororesin, an amorphous fluoropolymer, Teflon (registered trademark, polytetrafluoroethylene (PTFE)), or ethylene tetrafluoroethylene (ETFE).

Furthermore, the substrate 16 is mainly composed of, for example, a hydrocarbon-based polymeric material (hydrocarbon-based resin), glass, a metal, or an alloy, and a material containing fluorine is added in advance to the substrate.

The recesses 18 each have a substantially cylindrical shape with a substantially circular shape in plan view, and are formed in such a manner that their inner walls are substantially parallel to the thickness direction of the substrate 16. That is, in the repellency increasing structure 14, the angle α shown in FIG. 8 is 90°. The angle α is 126° or less, or desirably 115° or less.

The recesses 18 are formed as follows: When the surface tension of the substrate 16 is represented by $\gamma_S$ and the surface tension of an organic solvent, oil, or a liquid having a surface tension of 40 mN/m or less is represented by $\gamma_L$, the area ratio A of the recesses to the surface of the substrate 16 satisfies the expression 15. As described above, the area ratio A of the recesses 18 is preferably 18% or more, more preferably 40% or more, or still more preferably 60% or more. Increase of the area ratio A of the recesses 18 leads to increase of the apparent contact angle $\theta_f$.

The diameter d of each recess 18 has only to be negligibly small as compared to a droplet, and is desirably 50 μm or less, more desirably 10 μm or less, or still more desirably 5 μm or less.

In this embodiment as well, when the side wall of a recess 18 and the surface 16*a* of the substrate 16 are continuously smooth, the radius of curvature ρ is smaller than the smaller one of the diameter d of the recess 18 and the depth h of the recess 18. The radius of curvature ρ is desirably equal to or less than one half of the smaller one of the diameter d of the recess 18 and the depth h of the recess 18. The depth h of the recess 18 is desirably 1 μm or more, or more desirably 2 μm or more.

In the repellency increasing structure 14 of this embodiment, the recesses 18 are formed on the flat surface of the substrate 16 in such a manner that: their inner walls are substantially parallel to the thickness direction of the substrate 16; and, when the surface tension of the substrate 16 is represented by $\gamma_S$ and the surface tension of an organic solvent, oil, or a liquid having a surface tension of 40 mN/m or less is represented by $\gamma_L$, the area ratio A of the openings of the recesses 18 to the surface of the substrate 16 satisfies the expression 15. Thus, even with respect to a liquid having a contact angle of less than 90° in a state where nothing is formed on the substrate 16, the contact angle can be made equal to or more than 90° or can be increased. As a result, repellency can be increased with respect to a liquid having a surface tension lower than that of water such as an organic solvent, oil, or a liquid having a surface tension of 40 mN/m or less.

In this embodiment, a coating layer having such a thickness that the shape of each of the recesses 18 can be maintained may be formed on the surface of the substrate and on the whole of the inner walls of the recesses. The coating layer is made of, for example, a low-molecular-weight, fluorine-containing repellent material which is repellent by nature and has, for example, 10 or more fluorine (F) atoms.

The coating layer needs to have a sufficient thickness to maintain the shapes of the recesses 18 and the substrate 16. That is, the thickness is preferably equal to or less than one tenth of the diameter of each recess 18. The thickness of the coating layer is preferably set to be, for example, 100 nm. The thickness of the coating layer is more preferably 10 nm or less. Thus, a localized uneven surface profile of the repellency increasing structure 14 is maintained while the recesses 18 are not filled with a repellent material. As a result, two effects can be obtained: Repellency can be exhibited by a surface structure having a localized uneven surface profile and the coating layer has a repellent effect.

Next, the method of producing the repellency increasing structure 14 of this embodiment (see FIG. 9) will be described.

FIGS. 9A to 9D are sectional views showing the method of producing the repellency increasing structure according to the first embodiment of the present invention in order of steps.

Figure 9A:
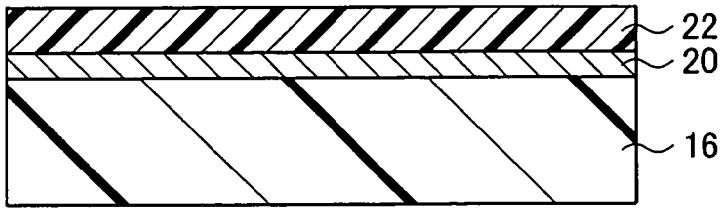
FIGS. 9A to 9D are sectional views for showing a method of producing the repellency increasing structure according to the first embodiment of the present invention in order of steps.

At first, as shown in FIG. 9A, a metal film 20 made of, for example, aluminum is formed on the surface of the substrate 16 made of a fluororesin, polyimide, or PET by, for example, vapor deposition. Next, a resist film 22 is formed on the entire surface of the metal film 20.

Figure 9B:
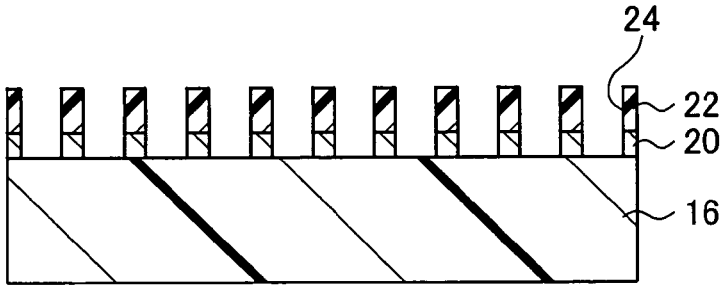
Figure 9C:
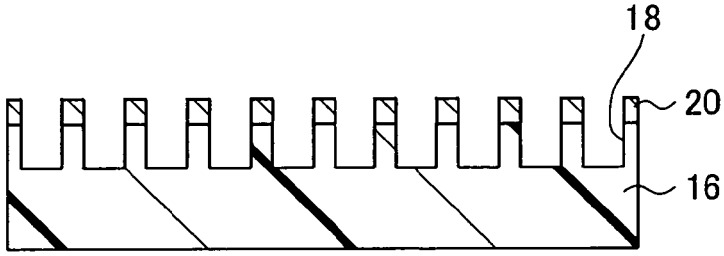

Next, as shown in FIG. 9B, a pattern 24 is formed on the resist film 22 by a photolithographic technique in such a manner that the area ratio A of regions where the recesses 18 are to be formed to the surface of the substrate 16 satisfies the expression 15. And, the metal film 20 is subjected to patterning with the aid of the patterned resist film 22 as a mask by, for example, wet etching using phosphoric acid. Then, a pattern of the metal film 20 is formed Next, as shown in FIG. 9C, the resist film 22 is removed. Then, the recesses 18 are formed in the substrate 16 with the aid of the patterned metal film 20 as a mask by, for example, dry etching in such a manner that their inner walls are substantially parallel to the thickness direction of the substrate 16. Thus, the recesses 18 having the same size are formed on the surface of the substrate 16.

Figure 9D:
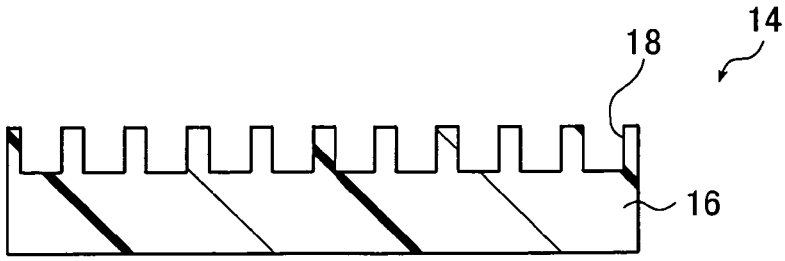

Next, as shown in FIG. 9D, the metal film 20 is removed by, for example, wet etching.

Next, the substrate 16 having formed thereon the recesses 18 is heat-treated. The heat treatment repairs the damage to the surface due to the vapor deposition of a metal or due to dry etching. Repellency is imparted by the heat treatment. In addition, the substrate 16 is preferably heat-treated in a temperature range of 100° C. to 180° C. A heat treatment temperature of lower than 100° C. may insufficiently repair the damage to the substrate 16. In addition, a heat treatment temperature in excess of 180° C. may change the shape of each recess 18, so repellency may deteriorate. Thus, the repellency increasing structure 14 can be produced.

Second Embodiment

Next, a repellency increasing structure according to a second embodiment of the present invention will be described. In this embodiment, the same reference numerals are given to the same constituents as those of the repellency increasing structure 14 according to the first embodiment shown in FIG. 8, and detailed description of the same constituents is omitted.

Figure 10:
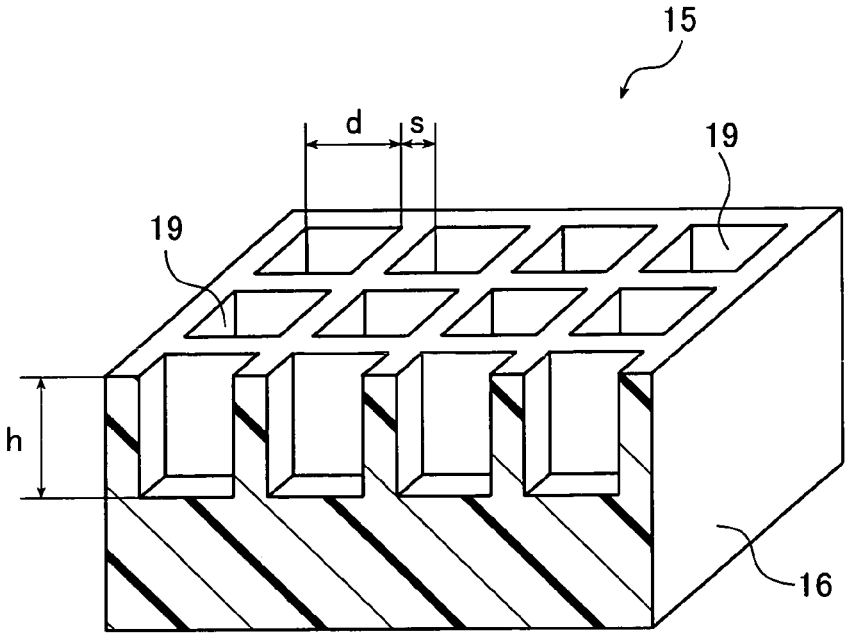
FIG. 10 is a schematic perspective view showing a repellency increasing structure according to a second embodiment of the present invention.

FIG. 10 is a schematic perspective view showing the repellency increasing structure according to the second embodiment of the present invention.

As shown in FIG. 10, a repellency increasing structure 15 of this embodiment is different from the repellency increasing structure 14 of the first embodiment (see FIG. 8) in that the shape of the opening of a recess 19 is not a circle but a square. Other features such as the size of the recess 19, an angle α, and an area ratio are the same as those of the repellency increasing structure 14 of the first embodiment.

The repellency increasing structure 15 includes: the substrate 16; and multiple recesses 19 each having a square opening formed on the substrate 16.

The method of producing the repellency increasing structure 15 of this embodiment is the same as the method of producing the repellency increasing structure 14 of the first embodiment except that a pattern to be formed on the resist film 22 by a photolithographic technique is formed in such a manner that the area ratio A of regions where the recesses 19 are to be formed to the surface of the substrate 16 satisfies the expression 18. Therefore, detailed description of the method of producing the repellency increasing structure 15 of this embodiment is omitted.

It is needless to say that the repellency increasing structure 15 of this embodiment provides the same effect as that of the repellency increasing structure 14 of the first embodiment.

Third Embodiment

Next, a repellency increasing structure according to a third embodiment of the present invention will be described. In this embodiment, the same reference numerals are given to the same constituents as those of the repellency increasing structure 14 according to the first embodiment shown in FIG. 8, and detailed description of the same constituents is omitted.

Figure 11:
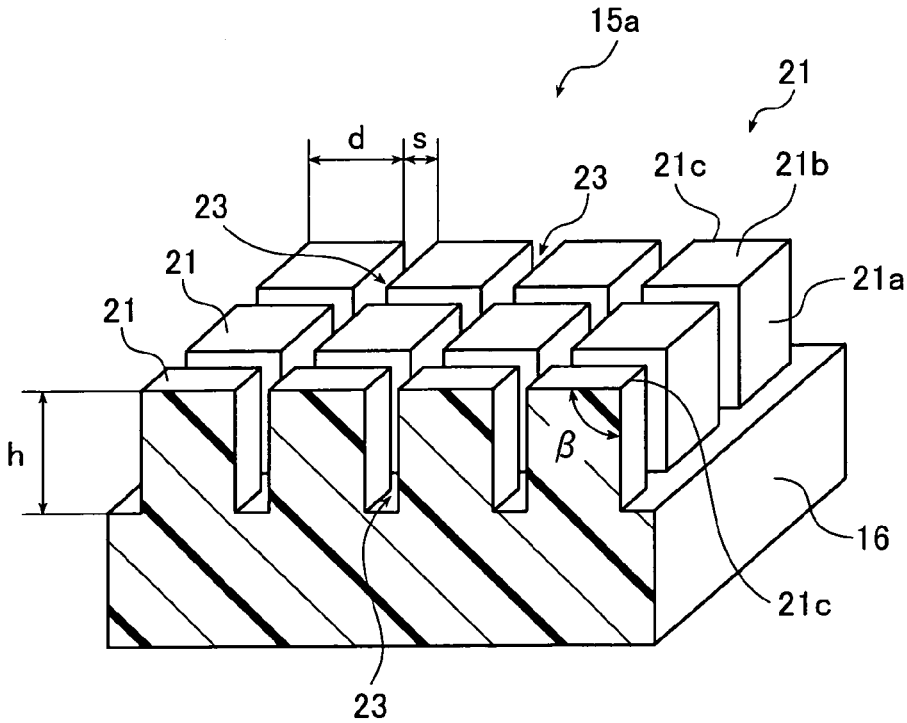
FIG. 11 is a schematic perspective view showing a repellency increasing structure according to a third embodiment of the present invention.

FIG. 11 is a schematic perspective view showing the repellency increasing structure according to the third embodiment of the present invention.

As shown in FIG. 11, a repellency increasing structure 15*a* of this embodiment is different from the repellency increasing structure 14 of the first embodiment (see FIG. 8) in that multiple square prism-shaped projections 21 are formed on the surface of the substrate 16 with gaps 23 provided therebetween. Other features are the same as those of the repellency increasing structure 14 of the first embodiment.

In the repellency increasing structure 15*a*, an angle β formed between the outer wall 21*a* and upper surface 21*b* of each projection 21 (hereinafter also referred to as the angle β of a corner 21*c*) is 126° or less, or desirably 115° or less.

In addition, the radius of curvature ρ of the corner 21*c* is smaller than the smaller one of the length d of each projection 21 and the height h of the projection 21, or desirably equal to or less than one half of the smaller one of the length d of the projection 21 and the height h of the projection 21. The height h of the projection 21 is desirably 1 μm or more, or more desirably 2 μm or more.

The length d of each projection 21 has only to be negligibly small as compared to a droplet, and is desirably 50 μm or less, more desirably 10 μm or less, or still more desirably 5 μm or less. When the projection 21 is of an elliptical shape or a polygonal shape, the equivalent diameter can be used instead of the diameter d for the circular projection as described above. The equivalent diameter in a square is the length d of one side.

The method of producing the repellency increasing structure 15*a* of this embodiment is the same as the method of producing the repellency increasing structure 14 of the first embodiment except that a pattern to be formed on the resist film 22 by a photolithographic technique is formed in such a manner that the area ratio A of regions where the projections 21 are to be formed to the surface of the substrate 16 satisfies the expression 19. Therefore, detailed description of the method of producing the repellency increasing structure 15*a* of this embodiment is omitted.

It is needless to say that the repellency increasing structure 15*a* of this embodiment provides the same effect as that of the repellency increasing structure 14 of the first embodiment.

Fourth Embodiment

Next, a repellency increasing structure according to a fourth embodiment of the present invention will be described. In this embodiment, the same reference numerals are given to the same constituents as those of the repellency increasing structure 14 according to the first embodiment shown in FIG. 8, and detailed description of the same constituents is omitted.

Figure 12:
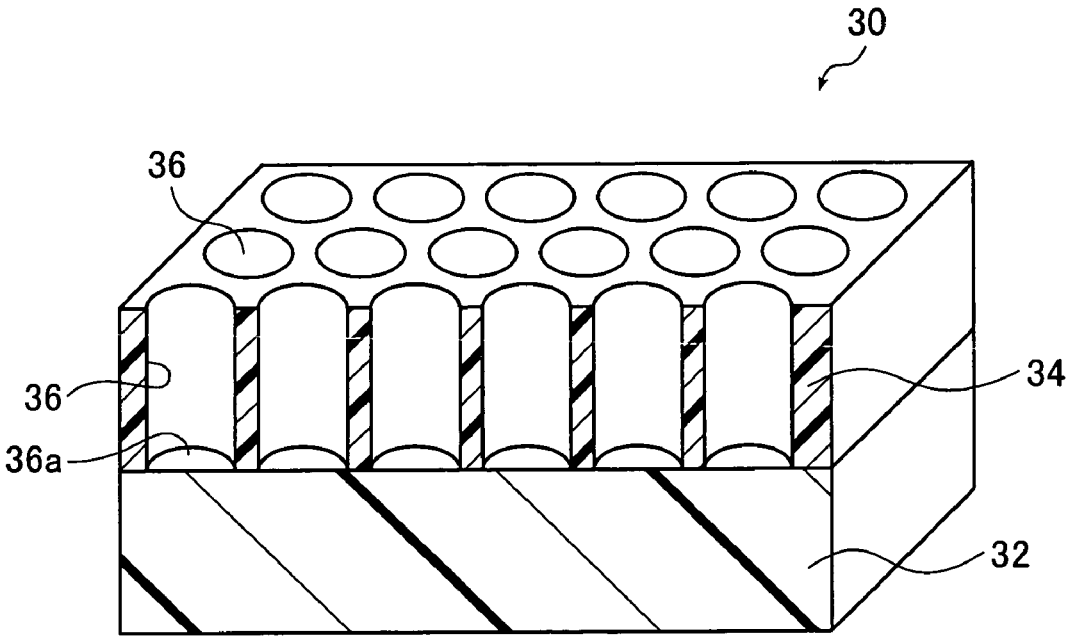
FIG. 12 is a schematic perspective view showing a repellency increasing structure according to a fourth embodiment of the present invention.

FIG. 12 is a schematic perspective view showing the repellency increasing structure according to the fourth embodiment of the present invention.

As shown in FIG. 12, a repellency increasing structure 30 of this embodiment is different from the repellency increasing structure 14 of the first embodiment (see FIG. 8) in that a lower substrate 32 is formed on the rear surface of a substrate 34 having a repellent effect. Other features are the same as those of the repellency increasing structure 14 of the first embodiment.

The repellency increasing structure 30 includes: the lower substrate 32; the substrate 34 formed on the surface of the lower substrate 32; and recesses 36 to be formed in the substrate 34.

In this embodiment, there is no particular limitation on the material of the lower substrate 32 which contacts an organic solvent, oil, or a liquid having a surface tension of 40 mN/m or less because the recesses 36 are formed in the substrate 34. Therefore, the material can be appropriately selected depending on the state of use from among a metal, an alloy, a resin, and glass.

The same constitution as that of the substrate 16 of the first embodiment (see FIG. 8) can be used for the substrate 34, and detailed description of the substrate 34 is omitted.

The recess 36 is the same as the recess 18 of the first embodiment, and detailed description thereof is omitted. The bottom face 36*a* of the recess 36 does not reach the lower substrate 32, and the surface of the lower substrate 32 is not exposed. The thickness from the bottom face 36*a* of the recess 36 to the surface of the lower substrate 32 is preferably 0.1 μm or more, or more preferably 1 μm or more.

The repellency increasing structure 30 of this embodiment has the same constitution as that of the repellency increasing structure 14 of the first embodiment except that: the recesses 36 are formed on the substrate 34 formed on the lower substrate 32; and the substrate 34 imparts a repellent effect. The repellency increasing structure 30 of this embodiment provides the same effect as that of the first embodiment.

Next, a first method of producing the repellency increasing structure 30 of this embodiment will be described.

FIGS. 13A to 13E are sectional views showing the first method of producing the repellency increasing structure according to the fourth embodiment of the present invention in order of steps.

Figure 13A:
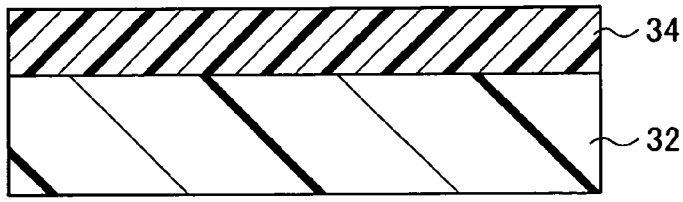
FIGS. 13A to 13E are sectional views showing a first method of producing the repellency increasing structure according to the fourth embodiment of the present invention in order of steps.

At first, as shown in FIG. 13A, the substrate 34 is formed on the lower substrate 32 by means of, for example, application. The substrate 34 is made of, for example, a fluoropolymer, PTFE, an amorphous fluoropolymer, a hydrocarbon polymer, or an inorganic sol-gel material to which a low-molecular-weight, fluorine-containing material is added. The substrate 34 can be formed to have a thickness of several micrometers to several tens of micrometers.

Figure 13B:
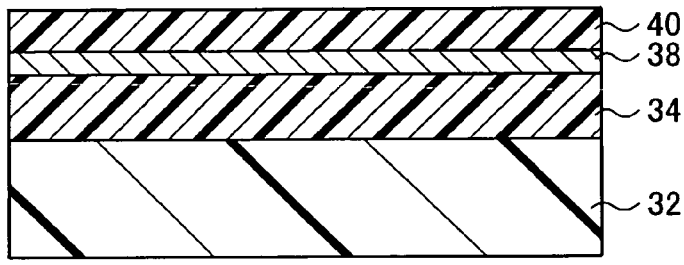

Next, as shown in FIG. 13B, a metal film 38 made of, for example, aluminum is formed on the surface of the substrate 34 by, for example, vapor deposition. Next, a resist film 40 is formed on the entire surface of the metal film 38.

Figure 13C:
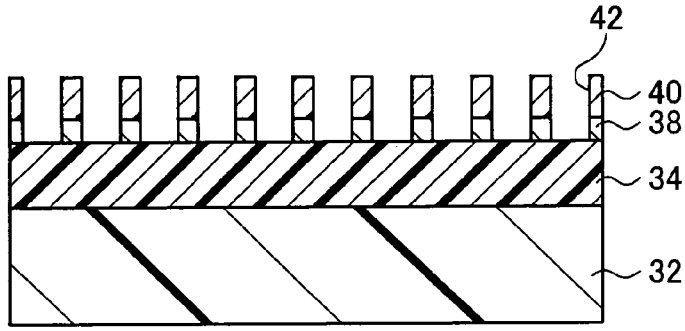

Next, as shown in FIG. 13C, a pattern 42 is formed on the resist film 40 by a photolithographic technique in such a manner that the area ratio A of regions where the recesses 36 are to be formed to the surface of the substrate 34 satisfies the expression 15. Then, a pattern is formed on the metal film 38 with the aid of the patterned resist film 40 as a mask by, for example, wet etching using phosphoric acid.

Figure 13D:
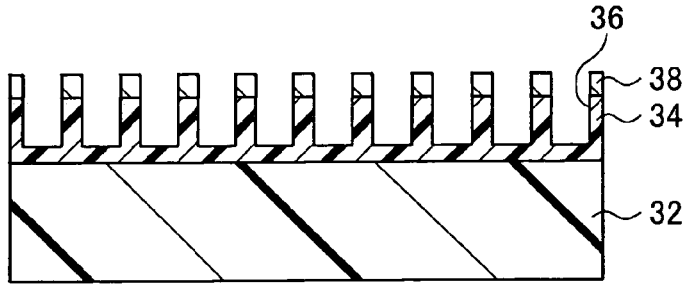

Next, as shown in FIG. 13D, the resist film 40 is removed. Then, the recesses 36 are formed on the substrate 34 with the aid of the patterned metal film 38 as a mask by, for example, dry etching. Thus, the recesses 36 having the same size are formed on the surface of the substrate 34 in such a manner that the area ratio A of the recesses 36 to the surface of the substrate 34 satisfies the expression 15.

Figure 13E:
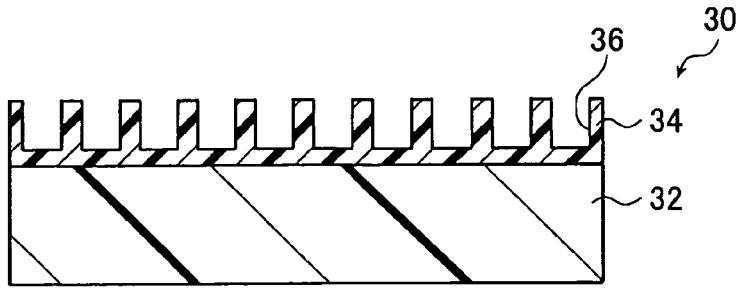

Next, as shown in FIG. 13E, the metal film 38 is removed by, for example, wet etching.

Next, the substrate 34 having formed thereon the recesses 36 is heat-treated. The heat treatment repairs the damage to the surface due to the vapor deposition of a metal or due to dry etching. Repellency is imparted by the heat treatment. In addition, the substrate 34 is preferably heat-treated in a temperature range of 100° C. to 180° C. A heat treatment temperature of lower than 100° C. may insufficiently repair the damage to the substrate 34. In addition, a heat treatment temperature in excess of 180° C. may change the shape of each recess 36, so repellency may deteriorate. Thus, the repellency increasing structure 30 can be produced.

Next, a second method of producing the repellency increasing structure 30 of this embodiment will be described.

FIGS. 14A to 14D are sectional views showing the second method of producing the repellency increasing structure according to the fourth embodiment of the present invention in order of steps.

The second production method is a method involving transferring a pattern onto the substrate 34 by means of a die 44 to form the recesses 36.

Figure 14A:
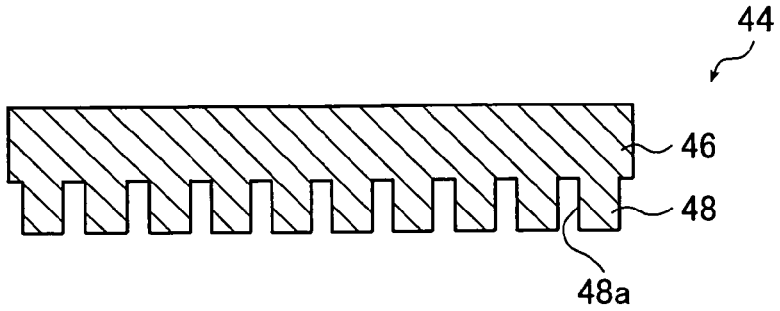
FIGS. 14A to 14D are sectional views showing a second method of producing the repellency increasing structure according to the fourth embodiment of the present invention in order of steps.

As shown in FIG. 14A, the die 44 includes: a base 46; and projections 48 formed on the base 46. The projections 48 are intended for the formation of the recesses 36 of the substrate 34. A recess 48*a* between any adjacent two of the projections 48 is a portion serving as a recess of the substrate 34. The projections 48 are formed in such a manner that the area ratio A of the recesses 36 to be formed to the surface of the substrate 34 satisfies the expression 15. In addition, the die 44 is formed of a material having high hardness such as a metal, glass, or silicon by, for example, lithography, dry etching, or plating.

Figure 14B:
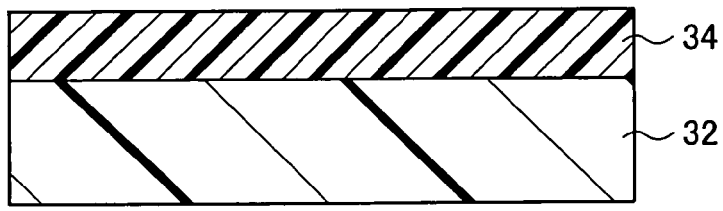

Meanwhile, as in the case of the first production method, as shown in FIG. 14B, the substrate 34 is formed on the lower substrate 32 by, for example, an application method.

Figure 14C:
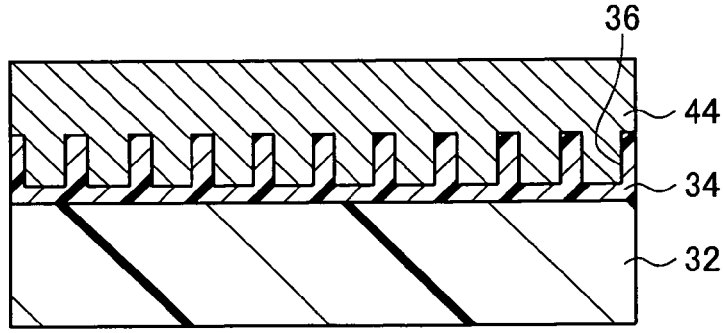

Next, as shown in FIG. 14C, the die 44 is pressed against the substrate 34 before the substrate 34 is heated, or the die 44 is pressed against the substrate 34 while the substrate 34 is heated, and then the whole is solidified. Thus, the pattern of the die 44 is transferred onto the substrate 34.

Figure 14D:
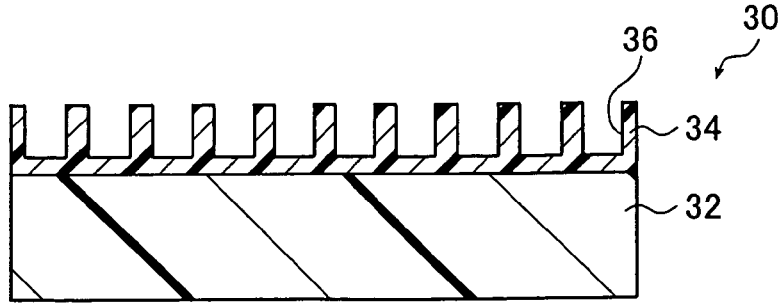

Next, as shown in FIG. 14D, the die 44 is separated from the substrate 34. Thus, the repellency increasing structure 30 can be produced.

Next, a third method of producing the repellency increasing structure 30 of this embodiment will be described.

Figure 15A:
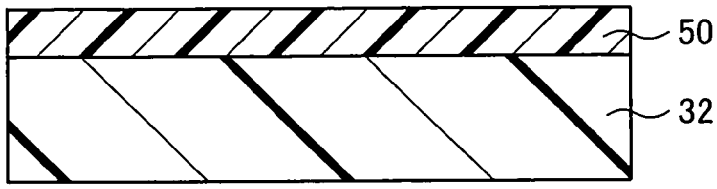
FIGS. 15A to 15C are sectional views showing a third method of producing the repellency increasing structure according to the fourth embodiment of the present invention in order of steps.
Figure 15B:
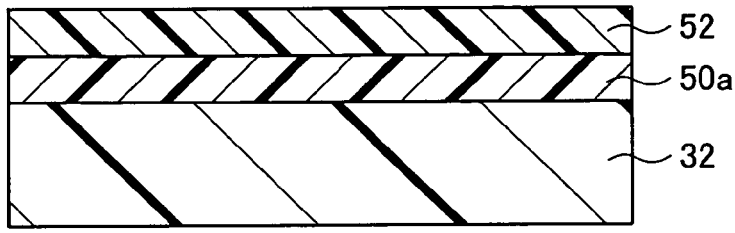
Figure 15C:
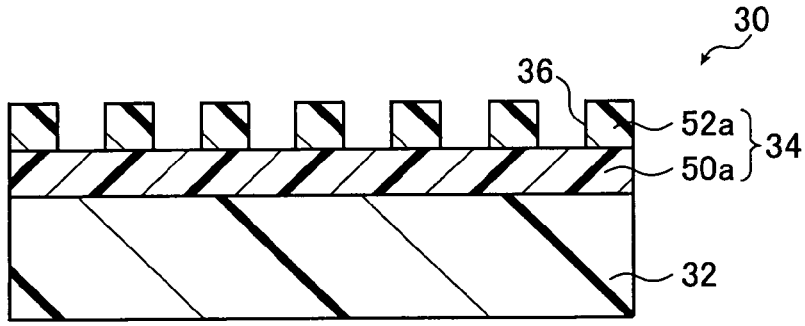

FIGS. 15A to 15C are sectional views showing the third method of producing the repellency increasing structure according to the fourth embodiment of the present invention in order of steps.

At first, as shown in FIG. 15A, a first photosensitive film 50 is formed on the lower substrate 32. Then, the first photosensitive film 50 is heat-treated for curing. Thus, a first film 50*a* is formed (see FIG. 15B).

Next, as shown in FIG. 15B, a second photosensitive film 52 made of the same material as that of the first film 50*a* (the first photosensitive film 50) is formed on the surface of the first film 50*a* (the first photosensitive film 50).

Next, as shown in FIG. 15C, the second photosensitive film 52 is exposed to light by a photolithographic technique to have such a pattern that the area ratio A of regions where the recesses 36 are to be formed to the surface of the substrate 34 satisfies the expression 15, followed by development. Thus, the second photosensitive film 52 is turned into a second film 52*a*. The second film 52*a* has the recesses 36 formed thereon. The substrate 34 includes the first film 50*a* and the second film 52*a* formed on the first film 50*a*. Thus, the repellency increasing structure 30 which includes the substrate 34 having formed therein the recesses 36 can be produced.

In this embodiment, in the case where the lower substrate 32 and the second photosensitive film 52 considerably differ from each other in surface tension, the first photosensitive film 50 (the first film 50*a*) is formed to prevent the surface of the lower substrate 32 from being exposed with a view to eliminating the difference. Therefore, any method can be employed as long as combined materials do not cause any difference in surface tension or the lower substrate 32 is not exposed. It is not absolutely necessary to form the first photosensitive film 50 (the first film 50*a*).

In this embodiment, a material that changes its chemical bond upon irradiation with light such as ultraviolet light, thereby causing a difference in etching rate upon development, and that cures to be made chemically stable through heat treatment is used for the first photosensitive film 50 and the second photosensitive film 52. For example, photosensitive polyimide, polymethyl methacrylate (PMMA), and a photosensitive fluorine-containing material are used for the first photosensitive film 50 and the second photosensitive film 52.

Fifth Embodiment

Next, a fifth embodiment of the present invention will be described. In this embodiment, the same reference numerals are given to the same constituents as those of the repellency increasing structure 30 according to the fourth embodiment shown in FIG. 12, and detailed description of the same constituents is omitted.

Figure 16:
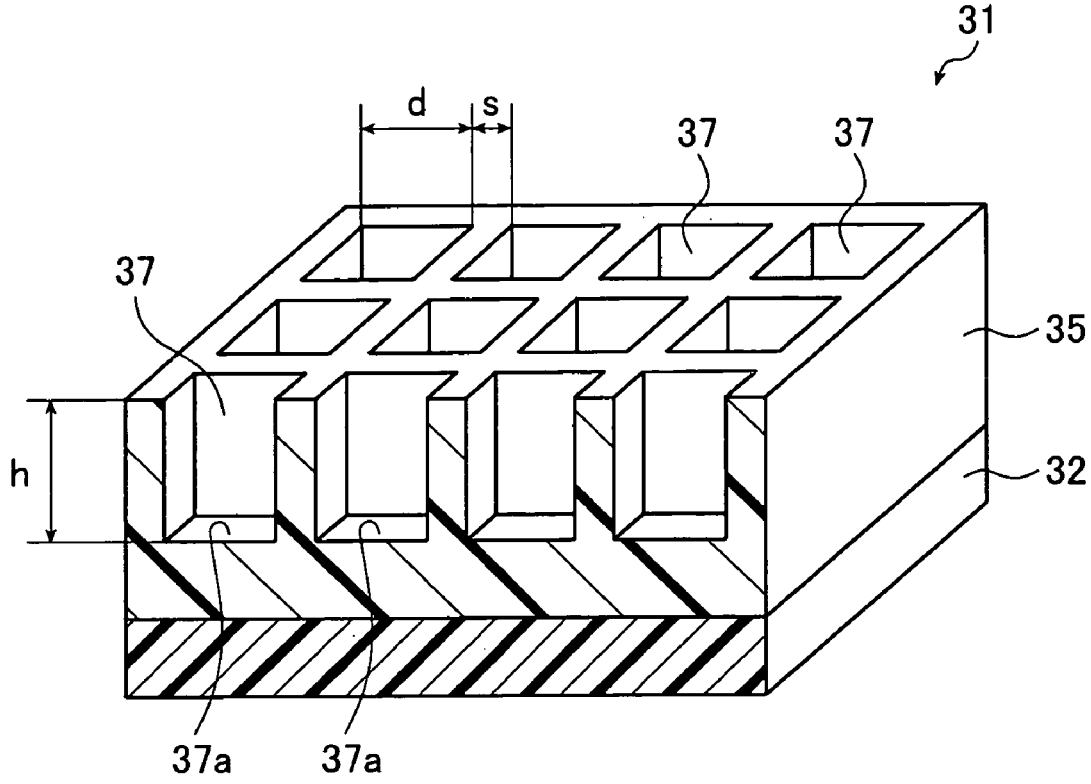
FIG. 16 is a schematic perspective view showing a repellency increasing structure according to a fifth embodiment of the present invention.

FIG. 16 is a schematic perspective view showing the repellency increasing structure according to the fifth embodiment of the present invention.

As shown in FIG. 16, a repellency increasing structure 31 of this embodiment is different from the repellency increasing structure 30 of the fourth embodiment (see FIG. 12) in that the shape of the opening of a recess 37 is not a circle but a square. Other features such as the size of the recess 37, an angle $\alpha$, and an area ratio are the same as those of the repellency increasing structure 30 of the fourth embodiment. In this embodiment as well, the bottom face 37*a* of the recess 37 does not reach the lower substrate 32.

The repellency increasing structure 31 of this embodiment can be produced by any one of the first to third methods of producing the repellency increasing structure 30 of the fourth embodiment. The method of producing the repellency increasing structure 31 of this embodiment is the same as any one of the methods of producing the repellency increasing structure 30 of the fourth embodiment except that a pattern in which the recesses 37 are to be formed has a shape such that the area ratio A of the recesses 37 to the surface of the substrate 32 satisfies the expression 18. Therefore, detailed description of the method of producing the repellency increasing structure 31 of this embodiment is omitted.

It is needless to say that the repellency increasing structure 31 of this embodiment provides the same effect as that of the repellency increasing structure 30 of the fourth embodiment.

Sixth Embodiment

Next, a sixth embodiment of the present invention will be described. In this embodiment, the same reference numerals are given to the same constituents as those of the repellency increasing structure 30 according to the fourth embodiment shown in FIG. 12, and detailed description of the same constituents is omitted.

Figure 17A:
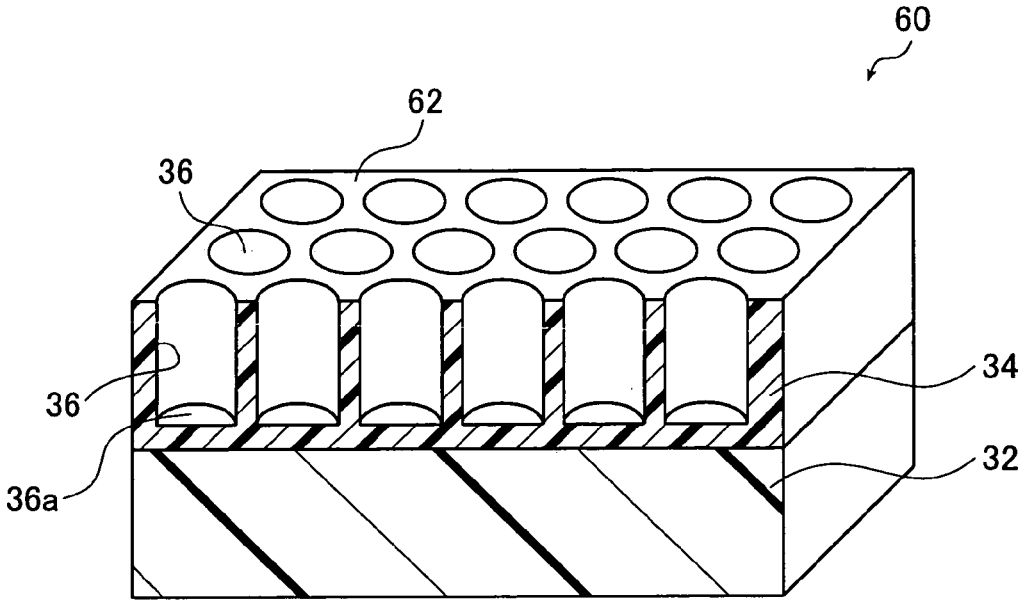
FIG. 17A is a schematic sectional view showing a repellency increasing structure according to a sixth embodiment of the present invention.
Figure 17B:
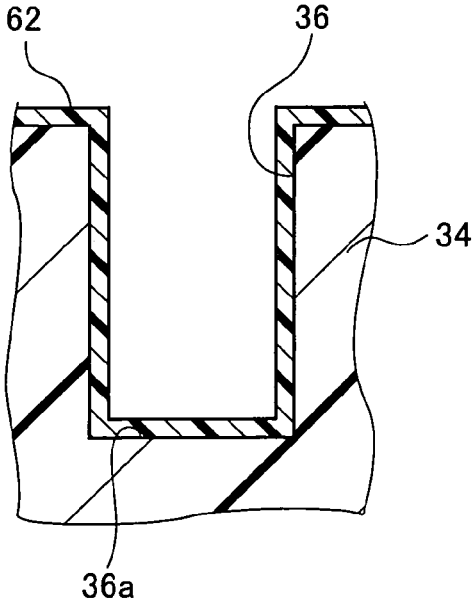
FIG. 17B is an enlarged view of a main portion of FIG. 17A.

FIG. 17A is a schematic sectional view showing a repellency increasing structure according to the sixth embodiment of the present invention and FIG. 17B is an enlarged view of a main portion of FIG. 17A.

A repellency increasing structure 60 of this embodiment has the same constitution as that of the repellency increasing structure 30 of the fourth embodiment (see FIG. 12) except that: a coating layer 62 is formed on the surface of the substrate 34; and the bottom face 36*a* of each recess 36 does not reach the lower substrate 32, and detailed description of the repellency increasing structure is omitted.

The coating layer 62 itself has repellency, and is made of, for example, fluoroalkylsilane.

In the repellency increasing structure 60 of this embodiment, the surface of the substrate 34 on which the coating layer 62 is to be formed must be cleaned before the coating layer 62 is formed. The cleaning is performed for enhancing the adhesion force of a repellent material to the substrate 34. Cleaning, especially cleaning with an oxygen plasma is needed for improving the repellency of the repellent material. A cleaning method is not particularly limited, and in addition to the above method, a primer treatment, a corona discharge treatment, a laser treatment, and irradiation with ultraviolet light can be employed.

In the repellency increasing structure 60 of this embodiment, the shape of the recesses is not particularly limited. The opening of each recess may be of a quadrangular shape, a polygonal shape, or the like. A constitution having projections instead of recesses is also available.

In this embodiment, the coating layer 62 needs to have a sufficient thickness for the shape of each of the recesses 36 and the substrate 34 to be maintained. The coating layer 62 has preferably a thickness of, for example, 100 nm and more preferably 10 nm or less. Thus, a localized uneven surface profile of the repellency increasing structure 60 is maintained while the recesses 36 are not filled with a repellent material. As a result, two effects can be obtained: Repellency can be exhibited by a surface structure having a localized surface uneven profile and the coating layer 62 has a repellent effect.

In the repellency increasing structure 60 of this embodiment, as in the case of the repellency increasing structure 30 of the fourth embodiment, repellency can be imparted by increasing the contact angle with respect to a liquid having a surface tension lower than that of water such as an organic solvent or oil.

In this embodiment, the substrate 34 of the repellency increasing structure 60 may be formed from an insulating member such as a glass member so that the repellency increasing structure 60 can serve as an insulator. Therefore, this structure can be used for an ejection substrate of, for example, an electrostatic ink-jet head.

Next, a method of producing the repellency increasing structure 60 of this embodiment will be described.

FIGS. 18A to 18F are sectional views showing the method of producing the repellency increasing structure according to the sixth embodiment of the present invention in order of steps.

Figure 18A:
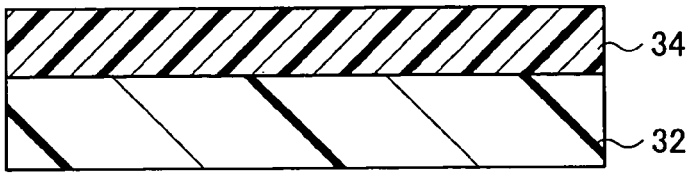
FIGS. 18A to 18F are sectional views showing a method of producing the repellency increasing structure according to the sixth embodiment of the present invention in order of steps.
Figure 18B:
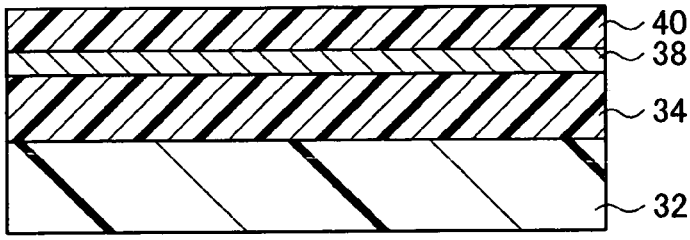
Figure 18C:
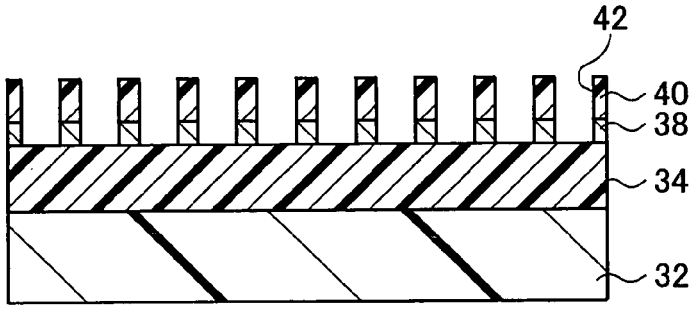
Figure 18D:
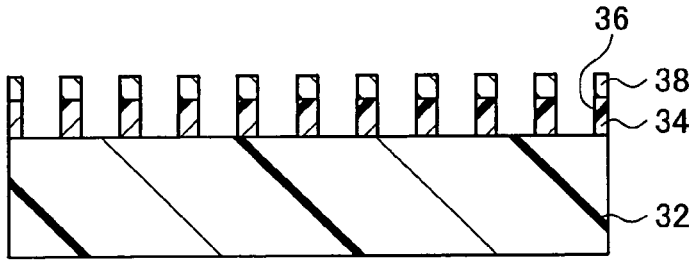
Figure 18E:
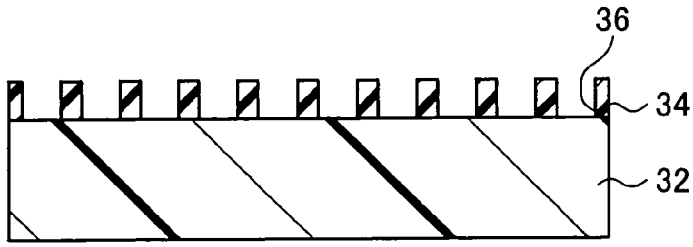
Figure 18F:
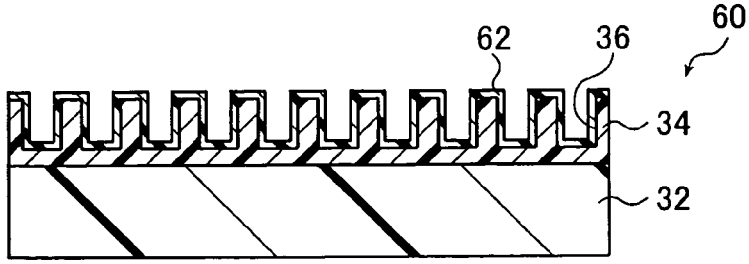

The production method of this embodiment is the same as the first production method for the repellency increasing structure of the fourth embodiment shown in FIGS. 13A to 13E except the step of forming a coating layer on the entire surface of the substrate 34 after the formation of the recesses 36 (see FIG. 18E). Therefore, detailed description of the production method of this embodiment is omitted.

According to this embodiment, after the recesses 36 have been formed (see FIG. 18E), the surfaces of the recesses 36 and the substrate 34 are cleaned with, for example, an oxygen plasma.

Next, the coating layer 62 is formed on the surfaces of the recesses 36 and the substrate 34 by, for example, spin coating, a method involving immersing in a liquid, vacuum deposition, or vapor phase adsorption. Thus, the repellency increasing structure 60 as shown in FIGS. 17A and 17B can be formed.

In the repellency increasing structure 60 of this embodiment, the bottom face of each of the recesses 36 to be formed in the substrate 34 may reach the lower substrate 32 because the structure has the coating layer 62. That is, the lower substrate 32 may be exposed.

Figure 19A:
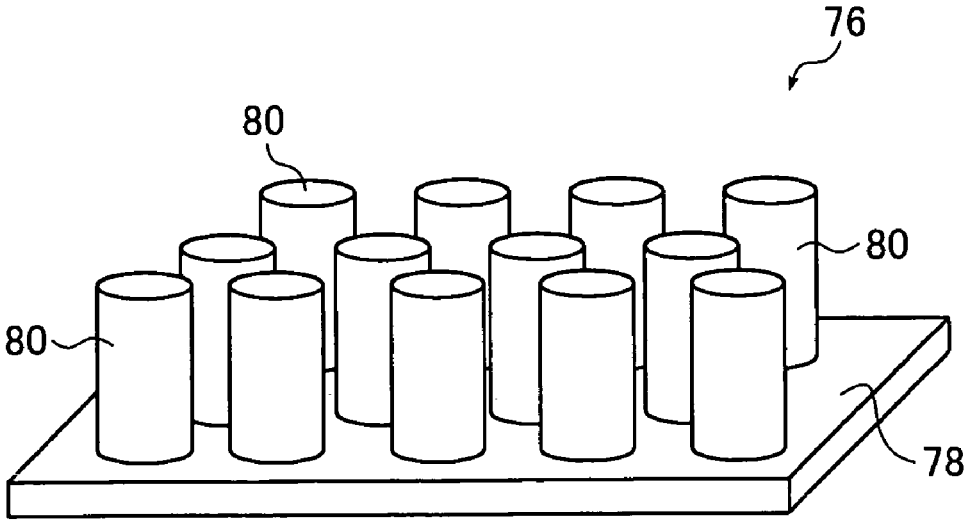
FIG. 19A is a schematic perspective view showing a first modified example of the repellency increasing structure according to the first embodiment of the present invention.

Here, the repellency increasing structure of the present invention is not limited to that constituted in any one of the above-described embodiments. For example, like a repellency increasing structure 76 shown in FIG. 19A, columnar projections 80 may be formed on the surface of a substrate 78. The projections 80 have the same height. In addition, the projections 80 are preferably arranged as densely as possible. Furthermore, the angle β of a corner of each projection 80 preferably satisfies the above-described condition (β<126°).

The projections 80 may be made of the same material as that of the substrate. Furthermore, the repellency increasing structure can be produced in the same manner as in the repellency increasing structure of any one of the first to third embodiments except that a pattern to be formed on each of a resist film and a metal film is different.

Figure 19B:
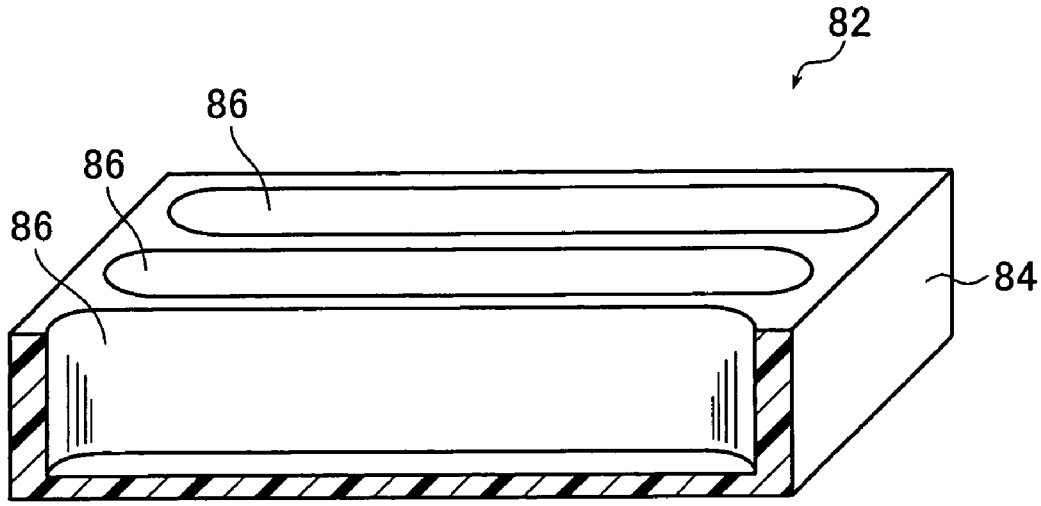
FIG. 19B is a schematic perspective view showing a second modified example of the repellency increasing structure according to the first embodiment of the present invention.

In addition, in the present invention, like a repellency increasing structure 82 shown in FIG. 19B, the shape of the opening of each recess 86 to be formed on a substrate 84 may be a long hole instead of a circle. It is needless to say that a lower substrate may be arranged on the lower surface of the substrate 84.

In the present invention, the shape of the opening of each recess 86 is not limited to a circle or a long hole. The shape is not particularly limited as long as the recess is closed except its opening. The shape is appropriately determined on the basis of, for example, the area ratio, the angle α, and the radius of curvature ρ.

When a recess whose opening has a long hole shape as in the recess 86 is long or has a asymmetric shape, if the length of the longest line inscribed in a recess is sufficiently large as compared to the size of liquid to be brought into contact with the surface and the surface of the substrate 84 is flat, all the recesses do not need to have the same size and shape.

Furthermore, in the present invention, the shape of each projection is not limited to a columnar shape or a square prism shape. The shape is not particularly limited as long as the projection is formed in such a manner that its outer wall is substantially parallel to the thickness direction of a substrate. Furthermore, the shape preferably satisfies the above-described conditions concerning the area ratio, the angle α, the radius of curvature ρ, and the like.

Seventh Embodiment

Next, a seventh embodiment of the present invention will be described.

Figure 20A:
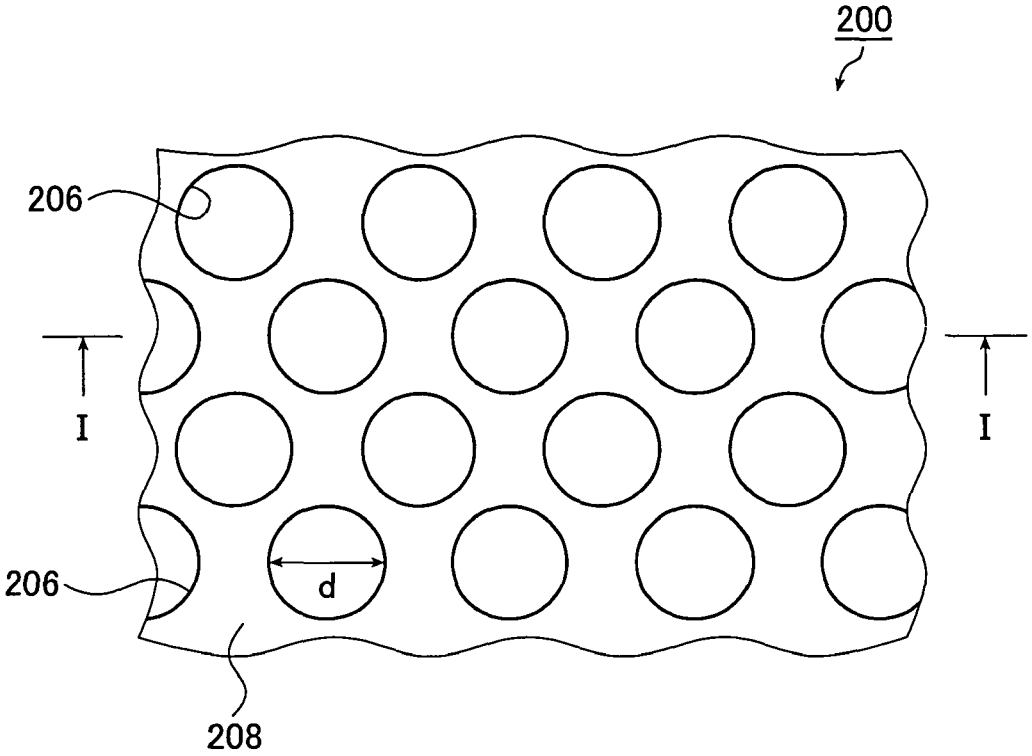
FIG. 20A is a plan view showing a repellency increasing structure according to a seventh embodiment of the present invention.
Figure 20B:
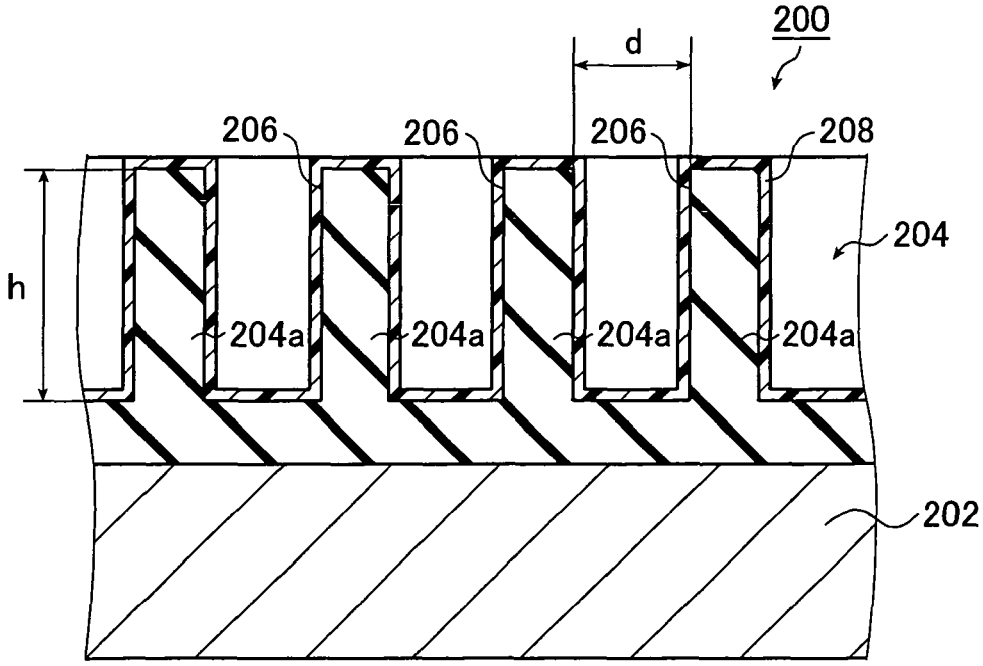
FIG. 20B is a schematic sectional view taken along the line I-I of FIG. 20A.

FIG. 20A is a plan view showing a repellency increasing structure according to the seventh embodiment of the present invention and FIG. 20B is a schematic sectional view taken along the line I-I of FIG. 20A. It should be noted that the holes in the respective embodiments of the present invention to be described below are the same as the recesses 12 shown in FIGS. 4A to 4C.

As shown in FIG. 20B, a repellency increasing structure 200 includes: a substrate 202; an anodized film 204; and a coating layer (repellent layer) 208. The surface of the structure is not flat and has recesses and projections formed thereon. In the repellency increasing structure 200, the anodized film 204 is formed on the substrate 202, and the coating layer 208 is formed on the entire surface of the anodized film 204.

The substrate 202 is made of a metal, an alloy, or an insulating member. The composition of the substrate 202 is not particularly limited as long as the anodized film 204 can be formed thereon. However, aluminum or an aluminum alloy allowing the anodized film 204 to be easily formed is preferable for the substrate 202.

An insulating member made of, for example, glass or polyimide can be used for the substrate 202. The use of an insulating member for the substrate 202 can impart insulating property to the repellency increasing structure 200. That is, the repellency increasing structure of the present invention can have conductivity or insulating property.

The anodized film 204 provides the repellency increasing structure 200 with an uneven surface profile. In general, the anodized film 204 is known to be a porous film. The anodized film 204 in this embodiment has walls 24*a* having a uniform height, and the surface of the anodized film 204 is substantially flat although it locally has an uneven profile.

The anodized film 204 can be formed by anodizing the substrate 202 when the substrate 202 is made of, for example, aluminum or an aluminum alloy.

The anodized film 204 has a flat surface and a uniform thickness. The anodized film 204 does not exhibit repellency with respect to a liquid having a surface tension lower than that of water such as an organic solvent, oil, or a liquid having a surface tension of 40 mN/m or less in a flat state where nothing is formed on its surface. In this case, the anodized film exhibits lyophilic property. That is, the contact angle with a liquid is less than 90°. In addition, the surface tension $\gamma_S$ of the anodized film 204 is preferably equal to or more than one fourth of the surface tension $\gamma_L$ of an organic solvent, oil, or a liquid having a surface tension of 40 mN/m or less.

In the anodized film 204 of the present invention, as shown in FIG. 20A, a large number of holes 206 having a uniform diameter d (size) are formed regularly at equal intervals so that the holes 206 each have a substantially circular shape in plan view. In addition, as shown in FIG. 20B, those holes 206 have a uniform depth h. Therefore, the holes 206 each have a substantially cylindrical shape in sectional view and a substantially circular shape in plan view, and are formed in such a manner that their inner walls are substantially parallel to the thickness direction of the substrate 202. That is, the angle α shown in FIG. 4A is 90°. The angle α at the corner is preferably 126° or less, or desirably 115° or less. The angle α formed is, for example, 60° to 120°.

The holes 206 are formed as follows: When the surface tension of the anodized film 204 is represented by $\gamma_S$ and the surface tension of a liquid having a surface tension lower than that of water such as an organic solvent, oil, or a liquid having a surface tension of 40 mN/m or less is represented by $\gamma_L$, the area ratio A of the holes to the surface of the anodized film 204 satisfies the expression 15. As described above, the area ratio A of the holes 206 is preferably 18% or more, more preferably 40% or more, or still more preferably 60% or more. Increasing the area ratio of the holes 206 increases the apparent contact angle $\theta_f$.

The diameter d of each hole 206 has only to be negligibly small as compared to a droplet, and is desirably 10 μm or less, more desirably 1 μm or less, or still more desirably 100 nm or less.

In this embodiment as well, when the side wall of each hole 206 and the surface of the anodized film 204 are continuously smooth, the radius of curvature ρ is smaller than the smaller one of the diameter d of the hole 206 and the depth h of the hole 206. The radius of curvature ρ is desirably equal to or less than one half, or more desirably equal to or less than one tenth, of the smaller one of the diameter d of the hole 206 and the depth h of the hole 206.

In the repellency increasing structure 200 of this embodiment, the holes 206 are formed on the flat surface of the anodized film 204 in such a manner that: their inner walls are substantially parallel to the thickness direction of the substrate 202; and, when the surface tension of the anodized film 204 is represented by $\gamma_S$ and the surface tension of an organic solvent, oil, or a liquid having a surface tension of 40 mN/m or less is represented by $\gamma_L$, the area ratio A of the openings of the holes 206 to the surface of the anodized film 204 satisfies the expression 15. Thus, even with respect to a lyophilic liquid having a contact angle of less than 90° in a state where nothing is formed on the anodized film 204, the contact angle can be made equal to or more than 90° or can be increased. As a result, the contact angle can be increased with respect to a liquid having a surface tension lower than that of water such as an organic solvent, oil, or a liquid having a surface tension of 40 mN/m or less, to thereby provide repellency.

The coating layer 208 is made of a low-molecular-weight, fluorine-containing repellent material which has repellency by nature and has, for example, 10 or more fluorine (F) atoms.

In this embodiment, the coating layer 208 has a sufficient thickness for the shape of each of the holes 206 and the anodized film 204 to be maintained. Specifically, the thickness is equal to or less than one half of the diameter of each hole 206. Thus, a localized uneven surface profile of the repellency increasing structure 200 is maintained while the holes 206 are not filled with a repellent material. The thickness of the coating layer 208 is preferably equal to or less than one tenth of the diameter d of each hole 206. The thickness of the coating layer 208 is preferably for example 100 nm. The thickness of the coating layer is more preferably 10 nm or less.

In this embodiment, the holes 206 are formed on the anodized film 204, and the coating layer 208 having a sufficient thickness for the shape of each of the holes 206 and the substrate 202 to be maintained, that is, having a thickness equal to or less than one half of the diameter of each hole 206 is formed. Thus, a localized uneven surface profile of the repellency increasing structure 200 is maintained. In this embodiment, the following two effects can be obtained. In one effect, with respect to a lyophilic liquid having a contact angle of less than 90° in a state where nothing is formed on the anodized film 204, the contact angle can be made equal to or more than 90° or be increased owing to such a surface structure having the localized uneven surface profile. The other effect is repellency imparted by the coating layer 208. Therefore, even in the anodized film 204 exhibiting lyophilic property in the flat surface portion with respect to a liquid having a surface tension lower than that of water, the contact angle can be made equal to or more than 90° or be increased. As a result, the contact angle can be increased with respect to a liquid having a surface tension lower than that of water such as an organic solvent, oil, or a liquid having a surface tension of 40 mN/m or less, to thereby provide repellency.

In this embodiment, the holes 206 are formed in such a manner that the area ratio A of the openings of the holes 206 to the surface of the anodized film 204 satisfies the expression 15. Thus, even with respect to a lyophilic liquid having a contact angle of less than 90° in a state where nothing is formed on the anodized film 204, the contact angle can be made equal to or more than 90° or be increased more easily. As a result, repellency can be further improved with respect to a liquid having a surface tension lower than that of water such as an organic solvent, oil, or a liquid having a surface tension of 40 mN/m or less.

In this embodiment, the substrate 202 of the repellency increasing structure 200 may be formed from an insulating member such as a polyimide or glass member so that the repellency increasing structure 200 can serve as an insulator. Therefore, this structure can be used for an ejection substrate of, for example, an electrostatic ink-jet head.

Next, a method of producing the repellency increasing structure of this embodiment will be described.

At first, a substrate made of, for example, aluminum is subjected to polishing with polishing cloth, buffing, and electrolytic polishing to perform a mirror finish treatment.

Next, dents serving as starting points in the formation of pores (micropores) are formed by, for example, anodization for self-ordering. In addition to the anodization, a focused ion beam method can also be used for forming dents.

Next, the substrate is immersed in an electrolyte to perform anodization, thereby forming an anodized film having a thickness of, for example, 1 μm.

Next, the substrate subjected to the anodization is immersed for 30 minutes for example in a liquid containing 50 g/l of phosphoric acid with its temperature held at 40° C. to perform pore widening. Thus, a large number of holes having a uniform size and a uniform depth are formed in a regular arrangement. In this case, the diameter of each hole is, for example, 50 nm.

Next, the substrate is impregnated with a solution prepared by dissolving a low-molecular-weight, fluorine-containing material having, for example, 10 or more fluorine (F) atoms such as fluoroalkylsilane as a repellent material in a 1 wt % isopropyl alcohol (IPA) solvent. Subsequently, the material is heat-treated, for example, at a temperature of 80° C. for 1 hour. Thus, a thin film having a thickness of, for example, less than 25 nm is formed on the entire surface of the anodized film. The thin film is referred to as a coating layer.

A method of forming the coating layer is not particularly limited as long as a layer having a thickness corresponding to the diameter of each hole of the anodized film can be formed. For example, the layer may be formed by spin coating or vacuum deposition.

Thus, the repellency increasing structure 200 having a localized uneven surface profile shown in FIGS. 20A and 20B can be formed.

Eighth Embodiment

Next, an eighth embodiment of the present invention will be described. In this embodiment, the same reference numerals are given to the same constituents as those of the repellency increasing structure 200 according to the seventh embodiment shown in FIGS. 20A and 20B, and detailed description of the same constituents is omitted.

Figure 21A:
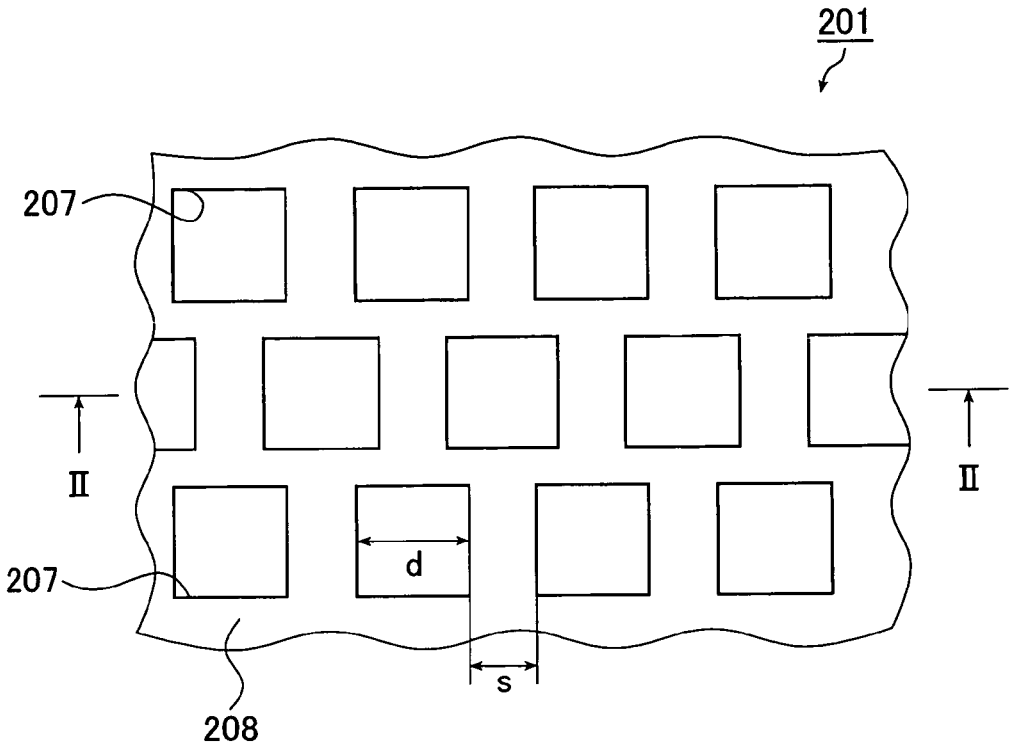
FIG. 21A is a plan view showing a repellency increasing structure according to an eighth embodiment of the present invention.
Figure 21B:
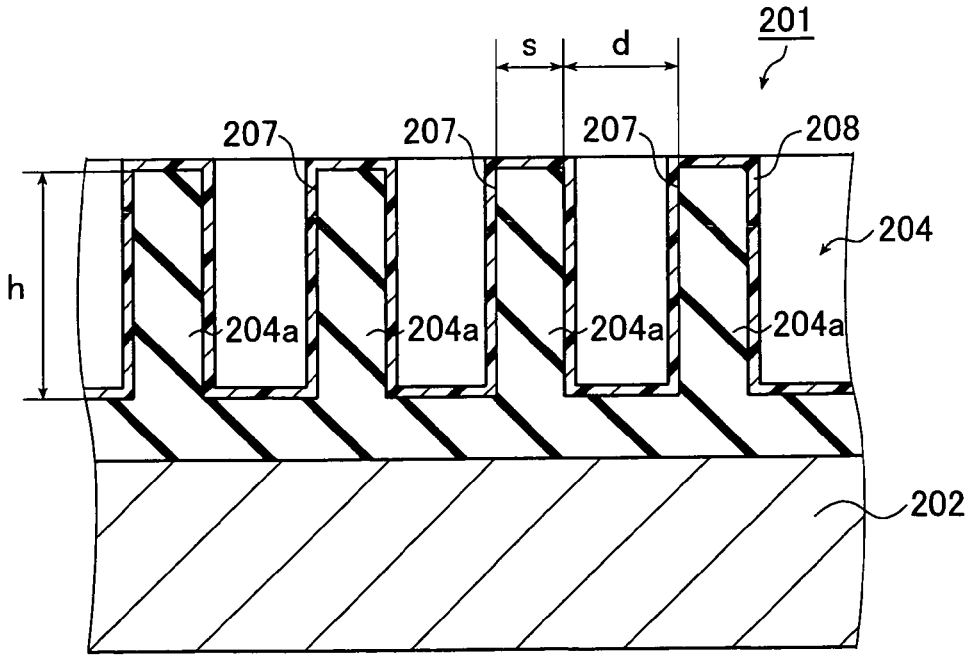
FIG. 21B is a schematic sectional view taken along the line II-II of FIG. 21A.

FIG. 21A is a plan view showing a repellency increasing structure according to the eighth embodiment of the present invention and FIG. 21B is a schematic sectional view taken along the line II-II of FIG. 21A.

As shown in FIGS. 21A and 21B, a repellency increasing structure 201 of this embodiment is different from the repellency increasing structure 200 of the seventh embodiment in that: the opening of each of holes 207 formed in the anodized film 204 has a square shape; and the holes 207 are formed at intervals of s. Other features such as the size of the opening of each hole, the angle α, and the area ratio are the same as those of the repellency increasing structure 200 of the seventh embodiment, and detailed description thereof is omitted.

In this embodiment, the opening of each hole 207 has a square (polygonal) shape. Therefore, the equivalent diameter is used instead of the diameter d for the circle to determine the area ratio.

It is needless to say that this embodiment provides the same effect as that of the repellency increasing structure 200 of the seventh embodiment.

Ninth Embodiment

Next, a ninth embodiment of the present invention will be described. In this embodiment, the same reference numerals are given to the same constituents as those of the repellency increasing structure 200 according to the seventh embodiment shown in FIGS. 20A and 20B, and detailed description of the same constituents is omitted.

Figure 22A:
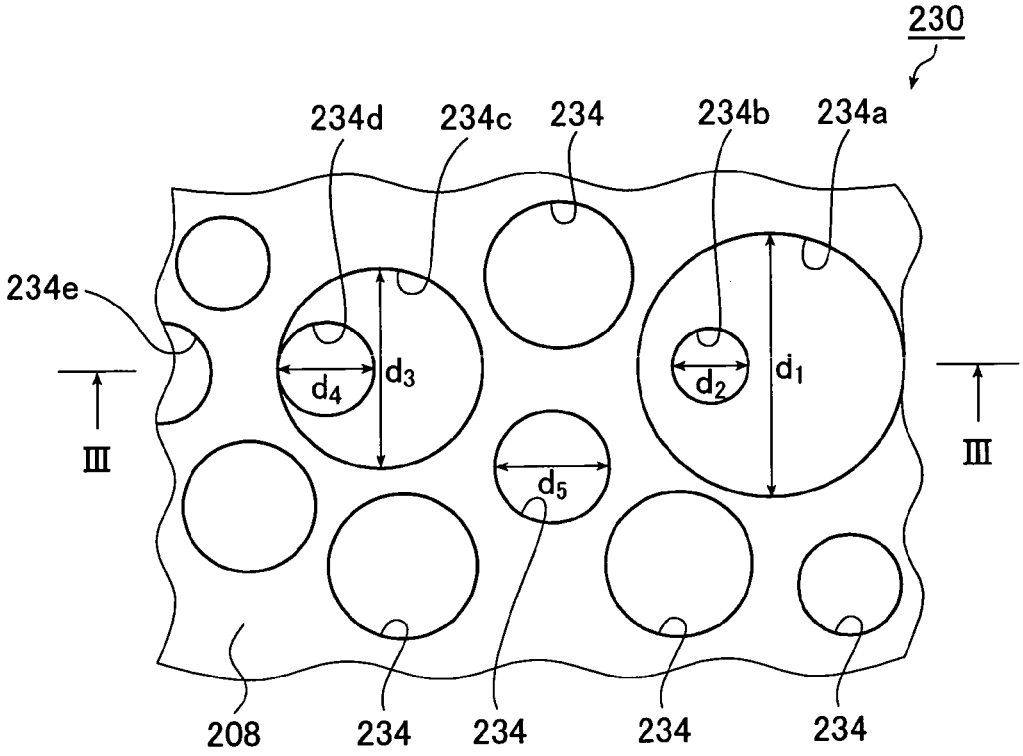
FIG. 22A is a plan view showing a repellency increasing structure according to a ninth embodiment of the present invention.
Figure 22B:
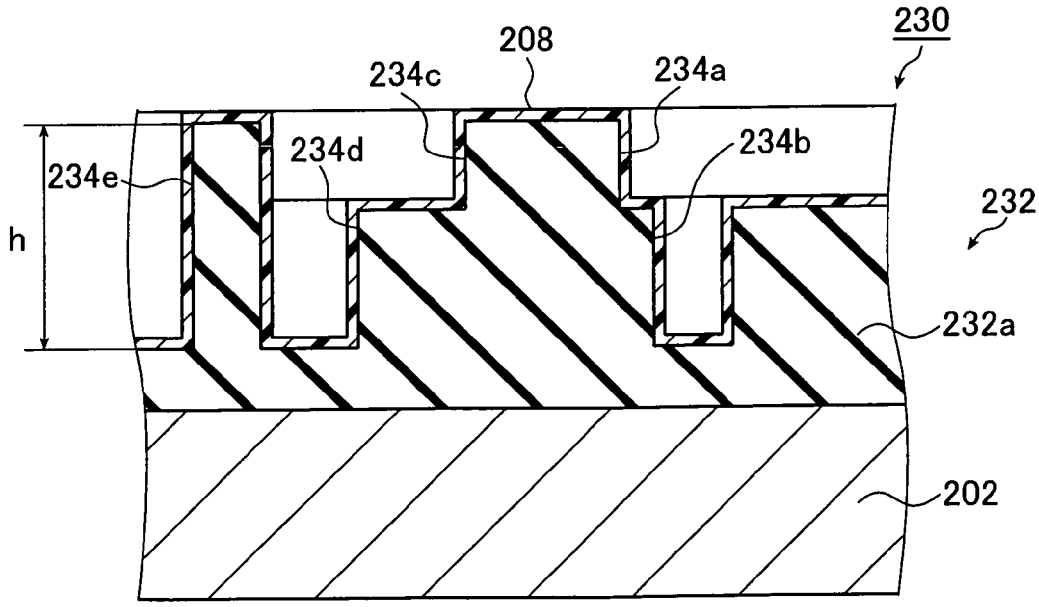
FIG. 22B is a schematic sectional view taken along the line III-III of FIG. 22A.

FIG. 22A is a plan view showing a repellency increasing structure according to the ninth embodiment of the present invention and FIG. 22B is a schematic sectional view taken along the line III-III of FIG. 22A.

As shown in FIGS. 22A and 22B, the repellency increasing structure 230 of this embodiment is different from the repellency increasing structure 200 of the seventh embodiment in that: holes 234 and 234*a* to 234*e* formed in an anodized film 232 have different diameters $d_1$ to $d_5$ and depths h; the height of the side walls 232*a* of the anodized film 232 is not uniform; and the holes 234 and 234*a* to 234*e* are not regularly arranged. Other features are the same as those of the repellency increasing structure 200 of the seventh embodiment, and detailed description thereof is omitted.

Even in the case where the holes 234 and 234*a* to 234*e* formed on the anodized film 232 have different diameters $d_1$ to $d_5$ and depths, the height of the side walls 232*a* of the anodized film 232 is not uniform, and the holes 234 and 234*a* to 234*e* are not regularly arranged as in this embodiment, the contact angle can be made equal to or more than 90° or be increased as in the case of the repellency increasing structure 200 of the seventh embodiment, by using the anodized film 232 exhibiting lyophilic property in the flat surface portion on which nothing is formed, with respect to a liquid having a surface tension lower than that of water. The repellent effect the coating layer has can also be obtained. As a result, in this embodiment, repellency can be increased with respect to a liquid having a surface tension lower than that of water such as an organic solvent, oil, or a liquid having a surface tension of 40 mN/m or less. However, the contact angle with respect to the same liquid is slightly smaller than that of the repellency increasing structure 200 of the seventh embodiment, and the transition angle also increases.

In this embodiment as well, as in the case of the holes 206 of the seventh embodiment, the diameters $d_1$ to $d_5$ of the holes 234 and 234*a* to 234*e* are each preferably 10 μm or less, more preferably 1 μm or less, or still more preferably 100 nm or less.

Furthermore, the area ratio A of the holes 234 and 234*a* to 234*e* defined by the expression 15 is preferably 18% or more. By setting the area ratio A of the holes 234 and 234*a* to 234*e* to be equal to or more than 18%, the rate at which liquid contacts air is increased, thereby increasing the contact angle. As a result, the contact angle can be made equal to or more than 90° or be increased. For example, the transition angle at which the transition from lyophilic property to repellency occurs can be less than 90°.

In this embodiment, as shown in FIG. 22B, the edges of the side walls of the holes 234 and 234*a* to 234*e* formed on the anodized film 232 have corners, and the angle α at each corner is preferably 126° or less, desirably 115° or less, or more preferably 90°. The holes are formed so as to have an angle α of, for example, 60° to 120°.

In this embodiment, by setting the angle α at each of the corners of the holes 234 and 234*a* to 234*e* to be equal to or less than 126°, air is prevented from leaking from an interface between liquid and each of the edges of the holes 234 and 234*a* to 234*e*. As a result, the ease with which the air is exchanged for the liquid on the anodized film 232 reduces, so the transition angle $\theta_t$ can be maintained at a low value.

Next, a method of producing the repellency increasing structure 230 of this embodiment will be described.

The production method of this embodiment is the same as the method of producing the repellency increasing structure 200 of the seventh embodiment except that the former has no step of forming dents. Therefore, detailed description of the production method of this embodiment is omitted.

Owing to the absence of the step of forming dents, in this embodiment, the holes 234 and 234*a* to 234*e* have different diameters $d_1$ to $d_5$ and depths, the height of the side walls 232*a* of the anodized film 232 is not uniform, and the holes 234 and 234*a* to 234*e* are not regularly arranged.

Tenth Embodiment

Next, a tenth embodiment of the present invention will be described. In this embodiment, the same reference numerals are given to the same constituents as those of the repellency increasing structure 230 according to the ninth embodiment shown in FIGS. 22A and 22B, and detailed description of the same constituents is omitted.

Figure 23A:
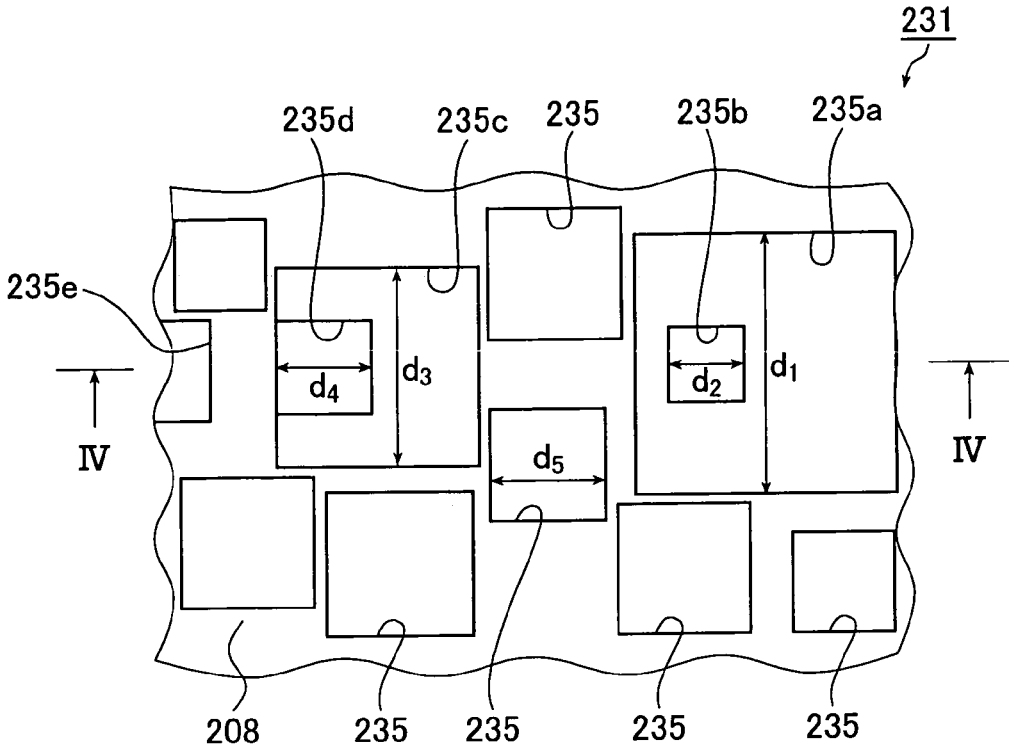
FIG. 23A is a plan view showing a repellency increasing structure according to a tenth embodiment of the present invention.
Figure 23B:
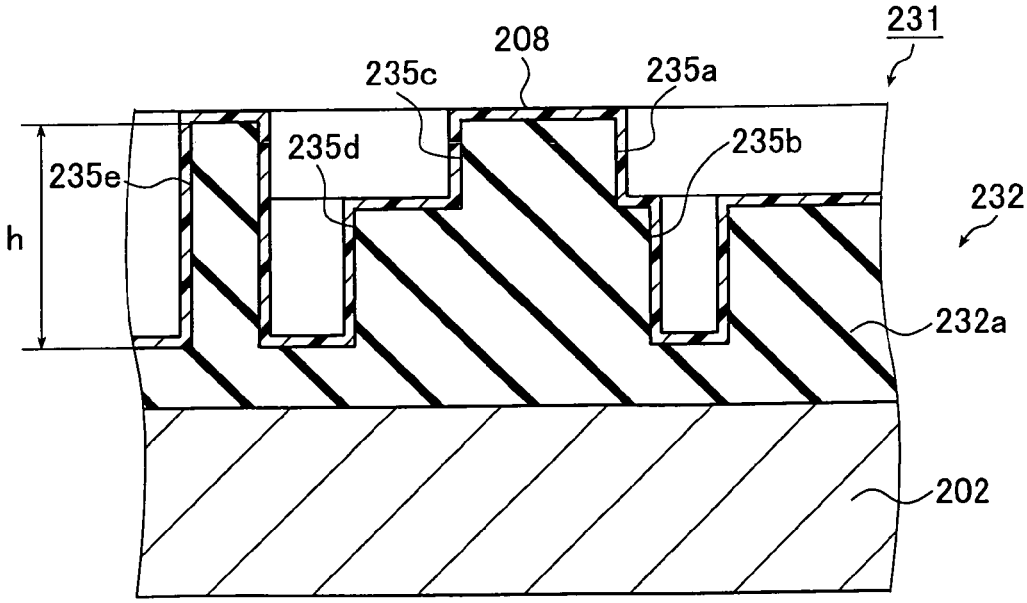
FIG. 23B is a schematic sectional view taken along the line IV-IV of FIG. 23A.

FIG. 23A is a plan view showing a repellency increasing structure according to the tenth embodiment of the present invention and FIG. 23B is a schematic sectional view taken along the line IV-IV of FIG. 23A.

As shown in FIGS. 23A and 23B, the repellency increasing structure 231 of this embodiment is different from the repellency increasing structure 230 of the ninth embodiment in that each of the openings of holes 235 and 235*a* to 235*e* formed in the anodized film 232 has a square shape. Other features such as the size of the opening of each hole, the angle α, and the area ratio are the same as those of the repellency increasing structure 230 of the ninth embodiment, and detailed description thereof is omitted.

In this embodiment, each of the openings of the holes 235 and 235*a* to 235*e* has a square (polygonal) shape. Therefore, the equivalent diameter is used instead of the diameter to determine the area ratio.

It is needless to say that this embodiment provides the same effect as that of the repellency increasing structure 230 of the ninth embodiment.

Eleventh Embodiment

Next, an eleventh embodiment of the present invention will be described. In this embodiment, the same reference numerals are given to the same constituents as those of the repellency increasing structure 200 according to the seventh embodiment shown in FIGS. 20A and 20B, and detailed description of the same constituents is omitted.

Figure 24:
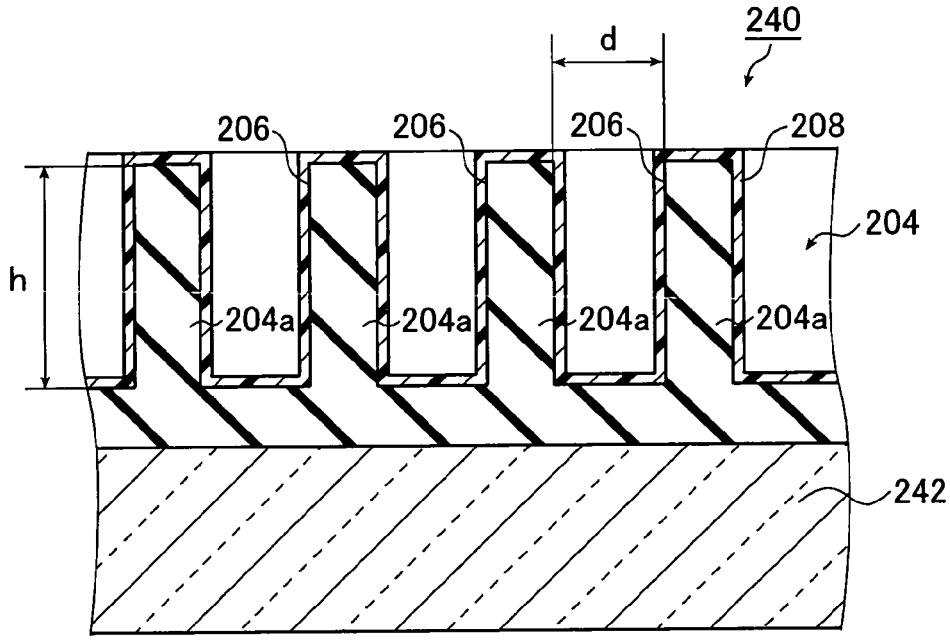
FIG. 24 is a schematic sectional view showing a repellency increasing structure according to an eleventh embodiment of the present invention.

FIG. 24 is a schematic sectional view showing a repellency increasing structure according to the eleventh embodiment of the present invention. This embodiment is not shown in plan view. When seen in plan view, a repellency increasing structure 240 of this embodiment shown in FIG. 24 is the same as the repellency increasing structure 200 of the seventh embodiment shown in FIG. 20A.

The repellency increasing structure of this embodiment is different from the repellency increasing structure 200 of the seventh embodiment in that a substrate 242 is formed from an insulating member such as a glass, polyimide, ceramic, or polyethylene terephthalate (PET) member. Other features are the same as those of the seventh embodiment, and detailed description thereof is omitted.

In this embodiment, as in the repellency increasing structure 200 of the seventh embodiment, the contact angle increased with respect to a liquid having a surface tension lower than that of water such as an organic solvent, oil, or a liquid having a surface tension of 40 mN/m or less, so the contact angle can be made equal to or more than 90° or be increased.

In this embodiment, the substrate 242 of the repellency increasing structure 240 may be formed from an insulating member such as a glass member so that the repellency increasing structure 240 serves as an insulator. Therefore, this structure can be used for an ejection substrate of, for example, an electrostatic ink-jet head.

In this embodiment, the constitution of the anodized film 204 is the same as that of the anodized film 204 in the seventh embodiment. However, the present invention is not limited thereto. The constitution may be the same as that of the anodized film in any one of the eighth to tenth embodiments. It is needless to say that this case provides the same effect as that of the repellency increasing structure of any one of the eighth to tenth embodiments.

Next, a method of producing the repellency increasing structure 240 of this embodiment will be described.

At first, an aluminum thin film having a thickness of 1 μm is formed over, for example, 23 minutes on the surface of a glass substrate having a thickness of, for example, 0.3 mm in, for example, an RF sputtering device (manufactured by ANELVA Corporation) using Ar gas (having a gas pressure of 0.67 Pa) under the conditions of power to be applied of 1 kW and a deposition rate of 43 nm/min.

Next, the substrate having formed thereon the aluminum thin film is immersed in, for example, a 26 wt % aqueous caustic soda solution containing 5 wt % of aluminum (solution temperature: 70° C.) to perform alkali etching. In this alkali etching treatment, the amount of aluminum dissolved is, for example, 3 $g/m^2$.

Next, after the alkali etching treatment, the substrate having formed thereon the aluminum thin film is immersed in, for example, a 26 wt % aqueous sulfuric acid solution containing 0.05 wt % of aluminum (solution temperature: 60° C.) for 40 seconds to perform desmutting, thereby removing an undesired substance (smut) generated in the preceding alkali etching.

Next, the substrate is subjected to anodization to form an anodized film on the surface of the substrate. The anodization involves carrying out DC electrolysis in, for example, a 15 g/l aqueous sulfuric acid solution having a solution temperature of 35° C. for, for example, 10 seconds at a current density of 30 $A/dm^2$. Thus, an anodized film having a thickness of, for example, 0.6 μm is formed.

Next, the formed anodized film is perforated with holes in the same manner as in the method of producing the repellency increasing structure 200 of the seventh embodiment or the method of producing the repellency increasing structure 230 of the eighth embodiment.

Next, a coating layer is formed on the anodized film. The coating layer is formed in the same manner as in the seventh embodiment. That is, the anodized film is impregnated with a solution prepared by dissolving a low-molecular-weight, fluorine-containing material having, for example, 10 or more fluorine (F) atoms such as fluoroalkylsilane as a repellent material in a 1 wt % isopropyl alcohol (IPA) solvent. Subsequently, the substrate is heat-treated, for example, at a temperature of 80° C. for 1 hour. Thus, a thin film having a thickness of, for example, less than 25 nm is formed on the entire surface of the anodized film. The thin film is referred to as a coating layer. Thus, the repellency increasing structure 240 shown in FIG. 24 can be formed.

In this embodiment, the method of forming the aluminum thin film is not limited to sputtering. The aluminum thin film can be formed by, for example, vapor deposition or a method involving attaching sheet-shaped aluminum foil to a substrate with an adhesive.

Twelfth Embodiment

Next, a twelfth embodiment of the present invention will be described. In this embodiment, the same reference numerals are given to the same constituents as those of the repellency increasing structure 200 according to the seventh embodiment shown in FIGS. 20A and 20B, and detailed description of the same constituents is omitted.

Figure 25:
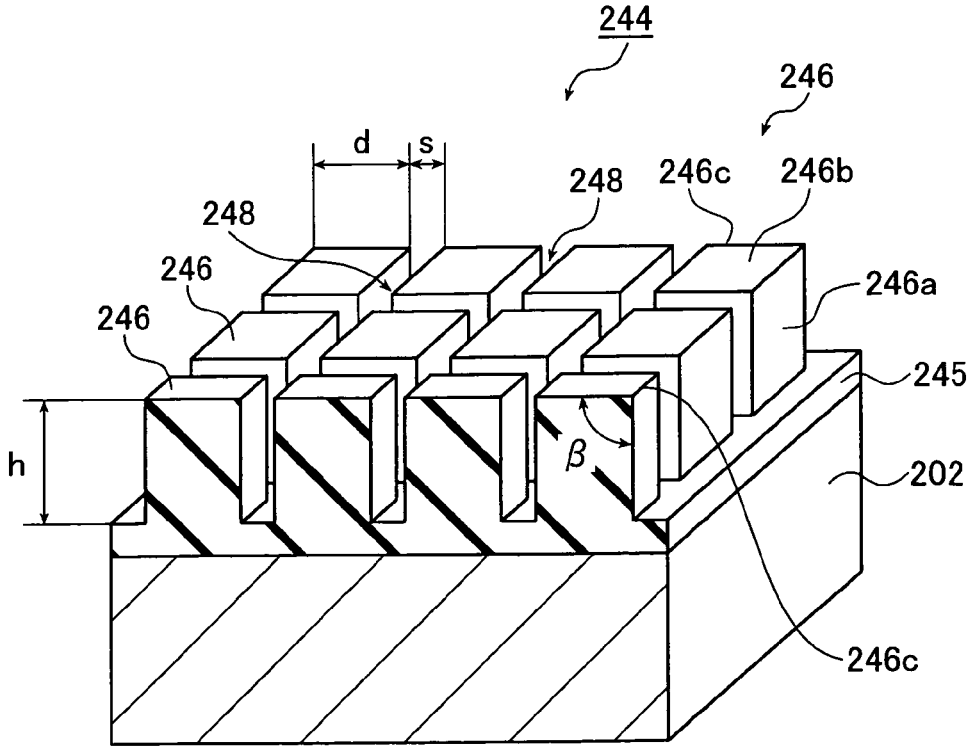
FIG. 25 is a schematic perspective view showing a repellency increasing structure according to a twelfth embodiment of the present invention.

FIG. 25 is a schematic perspective view showing a repellency increasing structure according to the twelfth embodiment of the present invention. In FIG. 25, a coating layer is not shown.

As shown in FIG. 25, a repellency increasing structure 244 of this embodiment is different from the repellency increasing structure 200 of the seventh embodiment (see FIGS. 20A and 20B) in that multiple square prism-shaped projections 246 are formed on an anodized film 245 with gaps 23 provided therebetween. Other features are the same as those of the repellency increasing structure 200 of the seventh embodiment. A coating layer (not shown) is formed on the entire surface of the anodized film 245.

In the repellency increasing structure 244, the angle β formed between the outer wall 246*a* and upper surface 246*b* of each projection 246 is 90°. The angle β is preferably 126° or less, or desirably 115° or less.

In addition, the radius of curvature ρ of a corner 246*c* is smaller than the smaller one of the length d of each projection 246 and the height h of the projection 246, or desirably equal to or less than one half, or more desirably equal to or less than one tenth, of the smaller one of the length d of the projection 246 and the height h of the projection 246. The height h of the projection 246 is desirably 1 μm or more, or more desirably 2 μm or more.

The area ratio A of the projections 246 to the surface of the anodized film 245 of this embodiment (hereinafter simply referred to as the area ratio of the projections) is desirably 64% or less, or more desirably 40% or less. Decrease in the area ratio A of the projections 246 allows the frequency at which liquid contacts air to be increased, thereby increasing the apparent contact angle $\theta_f$.

The length d of each projection 246 has only to be negligibly small as compared to a droplet, and is desirably 50 μm or less, more desirably 10 μm or less, or still more desirably 5 μm or less. When the projection 246 is of an elliptical shape or a polygonal shape, the equivalent diameter can be used instead of the diameter as described above. The equivalent diameter in a square is the length d of one side.

The method of producing the repellency increasing structure 244 of this embodiment is the same as the method of producing the repellency increasing structure 200 of the seventh embodiment except that a pattern is formed on a resist film by a photolithographic technique in such a manner that the area ratio A of regions where the projections 246 are to be formed to the surface of the substrate 202 satisfies the expression 19. Therefore, detailed description of the method of producing the repellency increasing structure 244 of this embodiment is omitted.

It is needless to say that the repellency increasing structure 244 of this embodiment provides the same effect as that of the repellency increasing structure 200 of the seventh embodiment.

It is needless to say that, even in the repellency increasing structure 244 of this embodiment, as in the repellency increasing structure 240 of the eleventh embodiment, the substrate 242 may be formed from an insulating member such as a glass, polyimide, ceramic, or polyethylene terephthalate (PET) member.

The shape of each projection 246 is not limited to a square prism shape, but may be any other prism shape. Of course, the shape may be a cylindrical shape having a elliptical or circular top surface.

Thirteenth Embodiment

Next, a thirteenth embodiment of the present invention will be described.

This embodiment is directed to an electrostatic ink-jet system in which the repellency increasing structure according to any one of the first to sixth embodiments is applied to an ejection substrate of a liquid ejection head.

Figure 26:
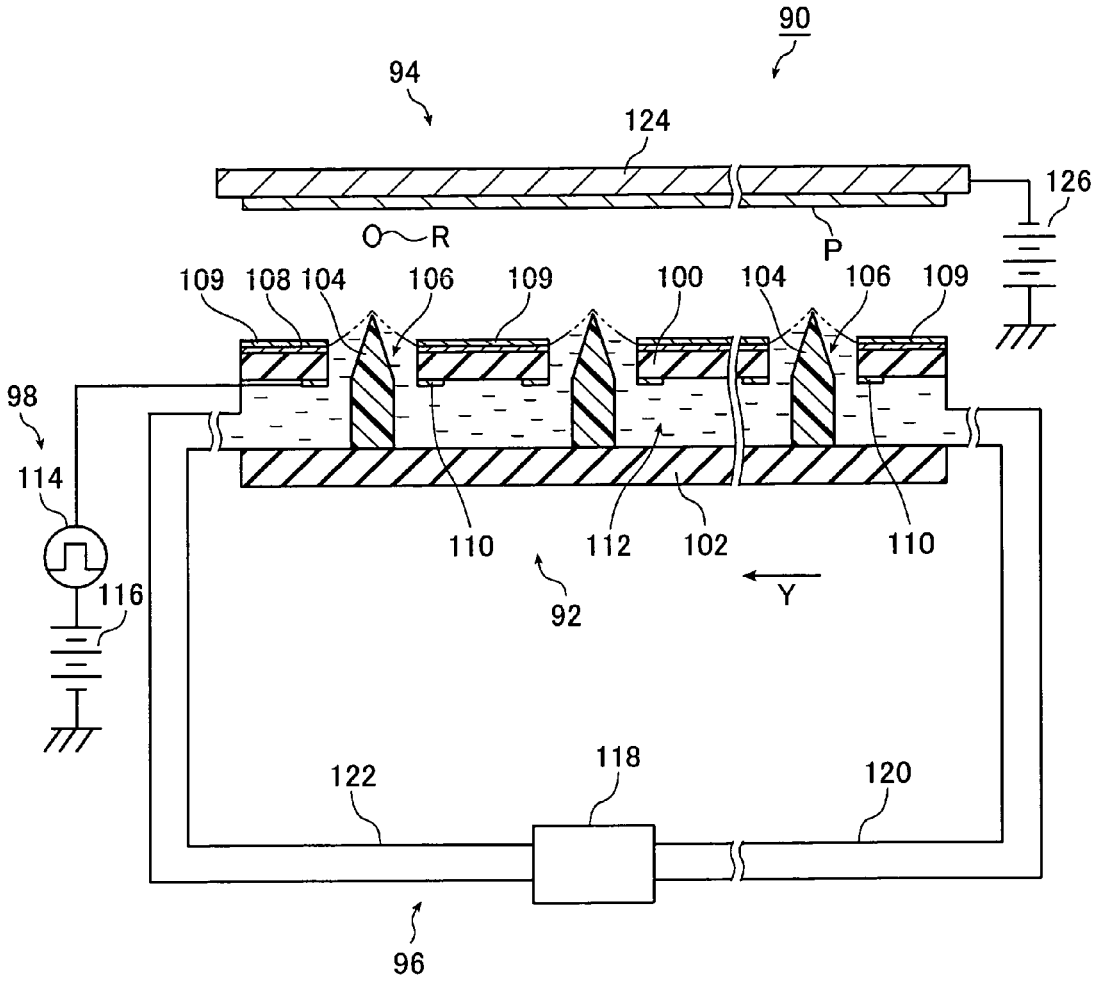
FIG. 26 is a schematic sectional view showing an ink-jet recording apparatus of an electrostatic ink-jet system in which the repellency increasing structure of the present invention is applied to an ejection substrate of a liquid ejection head.
Figure 27:
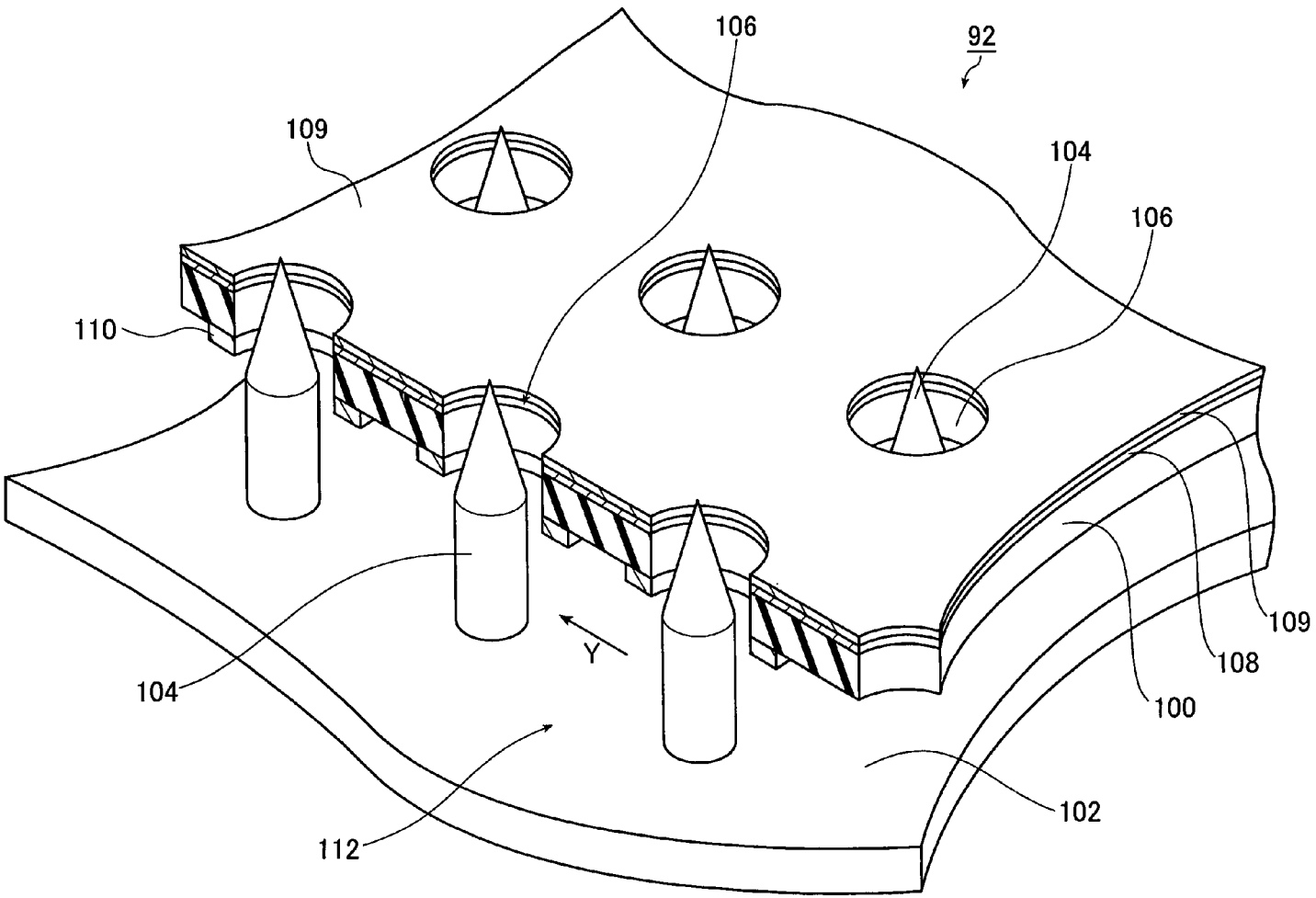
FIG. 27 is a schematic partial perspective view of the liquid ejection head shown in FIG. 26.

FIG. 26 is a schematic sectional view showing an ink-jet recording apparatus of an electrostatic ink-jet system in which the repellency increasing structure of the present invention is applied to an ejection substrate of a liquid ejection head. FIG. 27 is a schematic partial perspective view of the liquid ejection head shown in FIG. 26.

The ink-jet recording apparatus 90 shown in FIG. 26 (hereinafter referred to as the recording apparatus 90) ejects ink droplets R by an electrostatic ink-jet system to record (draw) an image on, for example, a rectangular recording medium P. The apparatus basically includes: a liquid ejection head 92 of the present invention (hereinafter referred to as the ejection head 92); means 94 for holding the recording medium P; an ink circulating system 96; and voltage applying means 98.

In the recording apparatus 90 of this embodiment, the ejection head 92 is a so-called line head having lines of ejection orifices 106 for the ink droplets R corresponding to the entire region of one side of the recording medium P (hereinafter referred to as nozzle lines).

In the recording apparatus 90, the recording medium P is held by the holding means 94, and is placed at a predetermined recording position so as to be opposed to the ejection head 92. In this state, the holding means 94 is moved (conveyed for scanning) in the direction perpendicular to the nozzle lines of the ejection head 92 to scan the entire surface of the recording medium P two-dimensionally with the nozzle lines. In synchronization with the scanning, the ink droplets R are ejected from the respective ejection orifices 106 of the ejection head 92 through modulation in accordance with an image to be recorded, whereby an image is recorded on the recording medium P in an on-demand manner.

Upon recording of the image, ink Q is circulated through a predetermined circulating path including the ejection head 92 (an ink flow path 112 to be described later) by the ink circulating system 96 to supply the ink Q to the respective ejection orifices 106.

The ejection head 92 is a liquid ejection head of an electrostatic ink-jet system for ejecting the ink Q (the ink droplets R) by virtue of an electrostatic force. As shown in FIGS. 26 and 27, the ejection head 92 basically includes: an ejection substrate 100; a support substrate 102; and ink guides (solution guides) 104.

The ejection substrate 100 is a substrate made of an insulating material such as a ceramic material (for example, $Al_2O_3$ or $ZrO_2$) or polyimide, and is perforated with a large number of ejection orifices 106 for ejecting the ink Q as the ink droplets R, the orifices penetrating through the ejection substrate 100.

The region of the upper surface of the ejection substrate 100 (droplet ejection side=surface on the side of the recording medium P (hereinafter this side is referred to as an upper side and the opposite side is referred to as a lower side)) except the areas corresponding to the ejection orifices 106 is preferably entirely coated with a shield electrode 108. A repellent layer 109 is formed on the surface of the shield electrode 108. The surface of the repellent layer 109 serves as an ink ejection surface (solution ejection surface).

The shield electrode 108 is a sheet-like electrode formed from a conductive metal plate or the like and common to all the ejection orifices 106. The electric potential of the electrode is maintained at a predetermined value. The predetermined electric potential includes 0 V through grounding. The shield electrode 108 allows an ejection orifice 106 (ejection portion) to be shielded from the electric lines of force of the adjacent ejection orifices 106 (ejection portions) to prevent electric field interference between the ejection portions, so that the ink droplets R can be consistently ejected.

Any one of the repellency increasing structures of the first to sixth embodiments is applicable to the repellent layer 109 of the electrostatic ink-jet head. Therefore, the repellent layer 109 has only to have the same structure as that of any one of the repellency increasing structures of the first to sixth embodiments.

Ejection electrodes 110 are arranged on the lower surface of the ejection substrate 100 for the respective ejection orifices 106.

In this embodiment, each of the ejection electrodes 110 is, for example, a ring-shaped electrode surrounding each ejection orifice 106, and is connected to the voltage applying means 98.

The voltage applying means 98 is connected to each ejection electrode 110. The voltage applying means 98 is obtained by connecting a driving power source 114 and a bias power source 116 in series. The side of the means having the same polarity as that of the charged colorant particles of the ink Q (for example, positive electrode) is connected to each ejection electrode 110 and the other side is grounded.

The driving power source 114 is, for example, a pulse power source, and supplies a pulsed drive voltage modulated in accordance with an image to be recorded (image data=ejection signal) to each ejection electrode 110. The bias power source 116 applies a predetermined bias voltage to each ejection electrode 110 at all times during recording of an image.

The support substrate 102 is also a substrate formed of an insulating material such as polyimide or glass.

The ejection substrate 100 is spaced apart from the support substrate 102 with a gap having a predetermined length provided therebetween, and the gap serves as the ink flow path 112 for supplying the ink Q to each ejection orifice 106.

The ink flow path 112 is connected to the ink circulating system 96 to be described later. The ink Q is circulated through a predetermined path by the ink circulating system 96. As a result, the ink Q flows in the ink flow path 112 (for example, right to left in this embodiment), so the ink is supplied to each ejection orifice 106.

The ink guides 104 are disposed on the upper surface of the support substrate 102.

The ink guides 104 are intended for facilitating the ejection of the ink droplets R by: guiding the ink Q supplied from the ink flow path 112 to the ejection orifices 106 to adjust the shape or size of a meniscus to thereby stabilize the meniscus; and focusing an electric field (electrostatic force) on each ejection orifice to focus the electric field on the meniscus. The ink guides 104 are disposed for the respective ejection orifices 106 so as to penetrate through the ejection orifices 106 to project from the surface of the ejection substrate 100 toward the recording medium P (the holding means 94).

An ejection orifice 106, an ejection electrode 110, and an ink guide 104 corresponding to one another form one ejection portion (one channel) corresponding to the ejection of ink droplet R for one dot. The tip of the ink guide 104 serves as the position at which the ink Q is ejected.

In the ejection head 92 of this embodiment, each ink guide 104 has, for example, a cylindrical portion on the lower side (base side) having a center coinciding with that of the corresponding ejection electrode 110 and a conical portion above the cylindrical portion (tip). The largest diameter of the ink guide 104 is slightly smaller than the inner diameter of the ejection electrode 110. A metal may be vapor-deposited onto the tip of the ink guide 104 to focus the electric field thereon.

The ink is supplied by the ink circulating system 96 to the ink flow path 112 formed between the ejection substrate 100 and the support substrate 102.

The ink circulating system 96 includes: ink supply means 118 having an ink tank for containing the ink Q and a pump for supplying the ink Q; an ink supply flow path 120 for connecting the ink supply means 118 and the ink inlet of the ink flow path 112 (the end on the upstream side in the Y direction of the ink flow path 112); and an ink recovery flow path 122 for connecting the ink outlet of the ink flow path 112 (the end on the downstream side in the Y direction of the ink flow path 112) and the ink supply means 118. The system may also include means for replenishing the ink tank with ink in addition to the foregoing.

The ink Q is circulated along the following route: At first, the ink is supplied from the ink supply means 118 to the ink flow path 112 of the ejection head 92 through the ink supply flow path 120. Then, the ink flows in the ink flow path 112 in the Y direction. Then, the ink returns from the ink flow path 112 to the ink supply means 118 through the ink recovery flow path 122. Thus, the ink is supplied from the ink flow path 112 to the respective ejection orifices 106 (nozzles).

Various types of ink (solutions) which is used for an electrostatic ink-jet printing and is prepared by dispersing charged fine particles in a dispersion medium, as exemplified by the ink prepared by dispersing charged particles containing a colorant in a dispersion medium can be used for the ink Q to be ejected from the ejection head 92 of the present invention. The ink Q is, for example, a liquid having a surface tension of 40 mN/m or less, and hence has a surface tension lower than that of water.

The holding means 94 holds the recording medium P, and scans and conveys the medium in the direction perpendicular to the direction in which the nozzle lines of the ejection head 92 are arranged (hereinafter referred to as the scanning direction).

The holding means 94 includes: a counter electrode 124 serving also as a platen for holding the recording medium P while being opposed to the upper surface (solution ejection surface) of the ejection head 92 (the ejection substrate 100); a counter bias power source 126; and scanning-conveying means (not shown) for scanning and conveying the recording medium P in the scanning direction by moving the counter electrode 124 in the scanning direction. The entire surface of the recording medium P is scanned two-dimensionally by the ejection orifices 106 (nozzle lines) of the ejection head 92 through the conveyance for scanning. Thus, an image is recorded by the ink droplets R ejected through modulation from the respective ejection orifices 106.

The method of holding the recording medium P with the counter electrode 124 is not particularly limited. Conventional methods such as a method involving the use of static electricity, a method involving the use of a jig, and a method based on suction are employable.

The counter bias power source 126 applies a bias voltage opposite in polarity to each ejection electrode 110 (=colorant particles) to the counter electrode 124. The opposite side of the counter bias power source 126 is grounded.

Hereinafter, the recording of an image with the recording apparatus 90 will be described.

Upon recording of an image, the ink Q is circulated by the ink circulating system 96. The circulation causes ink to be supplied to each ejection orifice 106.

Upon recording of an image, the bias power source 116 applies, for example, a bias voltage of 100 V to each ejection electrode 110. Furthermore, the recording medium P is held by the counter electrode 124, and the counter bias power source 126 applies, for example a bias voltage of −1,000 V to the counter electrode 124. Accordingly, a bias voltage corresponding to 1,100 V is applied between the ejection electrode 110 and the counter electrode 124 (the recording medium P), and an electric field (static electricity) corresponding to the bias voltage is generated between them.

The meniscus of the ink Q is formed in each ejection orifice 106 by virtue of, for example, the circulation of the ink Q, static electricity generated by the bias voltage, the surface tension and the capillary action of the ink Q, and the action of each ink guide 104. In addition, colorant particles (positively charged particles in this example) migrate toward each ejection orifice 106 (meniscus) to concentrate the ink Q. The concentration causes the meniscus to further grow. When a balance is established between the surface tension of the ink Q and, for example, static electricity, the meniscus is stabilized.

In this embodiment, the repellent layer 109 is formed on the surface of the shield electrode 108. As a result, the ink Q whose surface tension is lower than that of water like an organic solvent, oil, or a liquid having a surface tension of 40 mN/m or less can exhibit repellency. Therefore, the meniscus can be further stabilized.

In this state, when the driving power source 114 applies, for example, a drive voltage of 200 V to each ejection electrode 110, static electricity acting on the ink Q and its meniscus increases and the concentration of the ink Q at the meniscus is promoted. As a result, the meniscus abruptly grows, and the ink Q having concentrated colorant particles are ejected as the ink droplets R at the time when the growing power of the meniscus, the moving power of the colorant particles to the meniscus, and the suction force from the counter electrode 124 exceed the surface tension of the ink Q.

The ejected ink droplets R fly owing to the momentum at the time of ejection and the attraction by the counter electrode 124, and then impinge on the recording medium P to form an image.

The ejection head 92 of this embodiment has an ink ejection surface constituted by the repellent layer 109 having the repellency increasing structure of the present invention. As a result, the contact angle can be made equal to or more than 90° or can be increased even with respect to the ink Q whose surface tension is lower than that of water like an organic solvent, oil, or a liquid having a surface tension of 40 mN/m or less, and the meniscus shape is stabilized. Therefore, the direction in which an ink droplet R flies becomes constant, and the ink droplet R always impinges on the recording medium P at the position corresponding to the center of the projecting tip of each ink guide, so the ink droplet R is allowed to impinge on the recording medium P at the correct position. As a result, a high-quality image can be recorded on the recording medium P. Furthermore, the stabilization of the meniscus shape allows an ink droplet R having a predetermined size (predetermined amount) to be reliably ejected, whereby a good image with a stabilized density can be recorded on the recording medium P.

In this embodiment, the electrostatic ink-jet recording apparatus in which the repellency increasing structure according to any one of the first to sixth embodiments is applied to an ejection substrate of a liquid ejection head has been described. However, the present invention is not limited thereto, and the structure is applicable to any liquid ejection head. The present invention is applicable to one having droplet ejection means of a piezoelectric system or a thermal system, as exemplified by an ink-jet recording apparatus of a piezoelectric system or an ink-jet recording apparatus of a thermal system.

Fourteenth Embodiment

Next, a fourteenth embodiment of the present invention will be described.

This embodiment is directed to an electrostatic ink-jet recording apparatus in which the repellency increasing structure according to any one of the seventh to twelfth embodiments is applied to an ejection substrate of a liquid ejection head.

The constitution of the ink-jet recording apparatus of this embodiment is the same as that of the ink-jet recording apparatus 90 of the thirteenth embodiment shown in FIGS. 26 and 27, and description will be made with reference to FIGS. 26 and 27.

This embodiment has the same constitution as that of the ink-jet recording apparatus 90 of the thirteenth embodiment shown in FIGS. 26 and 27 except for the constitution of the ejection substrate 100 of the liquid ejection head 92, and detailed description thereof is omitted.

In this embodiment, the repellent layer 109 having the repellency increasing structure according to any one of the seventh to ninth embodiments is formed on the surface of the shield electrode 108.

The ejection head 92 of this embodiment has an ink ejection surface constituted by the repellent layer 109 having the repellency increasing structure according to any one of the seventh to ninth embodiments of the present invention. As a result, the contact angle can be made equal to or more than 90° or can be increased even with respect to the ink Q whose surface tension is lower than that of water like an organic solvent, oil, or a liquid having a surface tension of 40 mN/m or less, and the meniscus shape is stabilized. Therefore, the direction in which an ink droplet R flies becomes constant, and the ink droplet R always impinges on the recording medium P at the position corresponding to the center of the projecting tip of each ink guide, so the ink droplet R is allowed to impinge on the recording medium P at the correct position. As a result, a high-quality image can be recorded on the recording medium P. Furthermore, the stabilization of the meniscus shape allows an ink droplet R having a predetermined size (predetermined amount) to be reliably ejected, whereby a good image with a stabilized density can be recorded on the recording medium P.

In this embodiment as well, the electrostatic ink-jet recording apparatus in which the repellency increasing structure according to any one of the seventh to twelfth embodiments is applied to an ejection substrate of a liquid ejection head has been described. However, the present invention is not limited thereto, and the structure is applicable to any liquid ejection head. The present invention is applicable to one having droplet ejection means of a piezoelectric system or a thermal system, as exemplified by an ink-jet recording apparatus of a piezoelectric system or an ink-jet recording apparatus of a thermal system.

Next, an embodiment of a method of producing the liquid ejection head according to the eleventh or twelfth aspect of the present invention will be described in detail.

It is well known that, when liquid is dropped on the surface of a substrate, the liquid attempts to minimize its surface area. The liquid attempts to have a spherical shape or a shape comparable thereto in order to minimize its surface area.

Figure 28A:
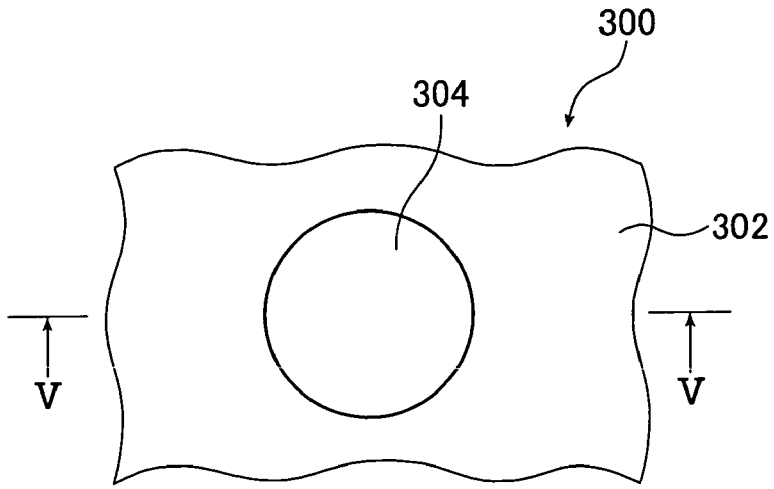
FIG. 28A is a plan view showing the state of a liquid droplet dropped on the surface of a substrate.
Figure 28B:
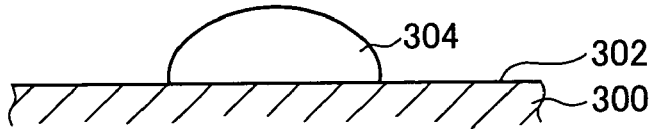
FIG. 28B is a sectional view taken along the line V-V of FIG. 28A.

FIG. 28A is a plan view showing the state of a liquid droplet dropped on the surface of a substrate and FIG. 28B is a sectional view taken along the line V-V of FIG. 28A.

As shown in FIG. 28A, when a liquid droplet 304 is dropped on a surface 302 of a substrate 300, the liquid droplet 304 is of a circular shape when viewed from above, and its section is of an arc shape as shown in FIG. 28B. Three-dimensionally, the liquid droplet 304 has the shape of a sphere from which part is cut out.

When the substrate 300 is highly repellent, the angle of the arc increases and the liquid is nearly of a circular (spherical) shape. Each ejection hole of an ink-jet recording head has preferably a circular shape in consideration of the properties of the liquid that attempts to minimize its surface area and the properties of an ink-jet recording apparatus (a liquid ejection head) such as the stabilization of ejection, the ease with which a droplet is divided into small portions, and the stabilization of the meniscus.

Meanwhile, it is important for the properties of the liquid that attempts to minimize its surface area to be considered for the structure of a repellent film to be formed on an ink ejection surface. Therefore, if the repellent structure promotes the minimization of the surface area of the liquid, the repellent structure leads to the stabilization of droplets and the improvement of repellency.

In view of the foregoing, the inventors have found that the repellent structure found by them is suitable for the solution ejection surface (ink ejection surface) of a liquid ejection head such as an ink-jet recording head, thereby achieving the present invention.

Fifteenth Embodiment

Figure 29:
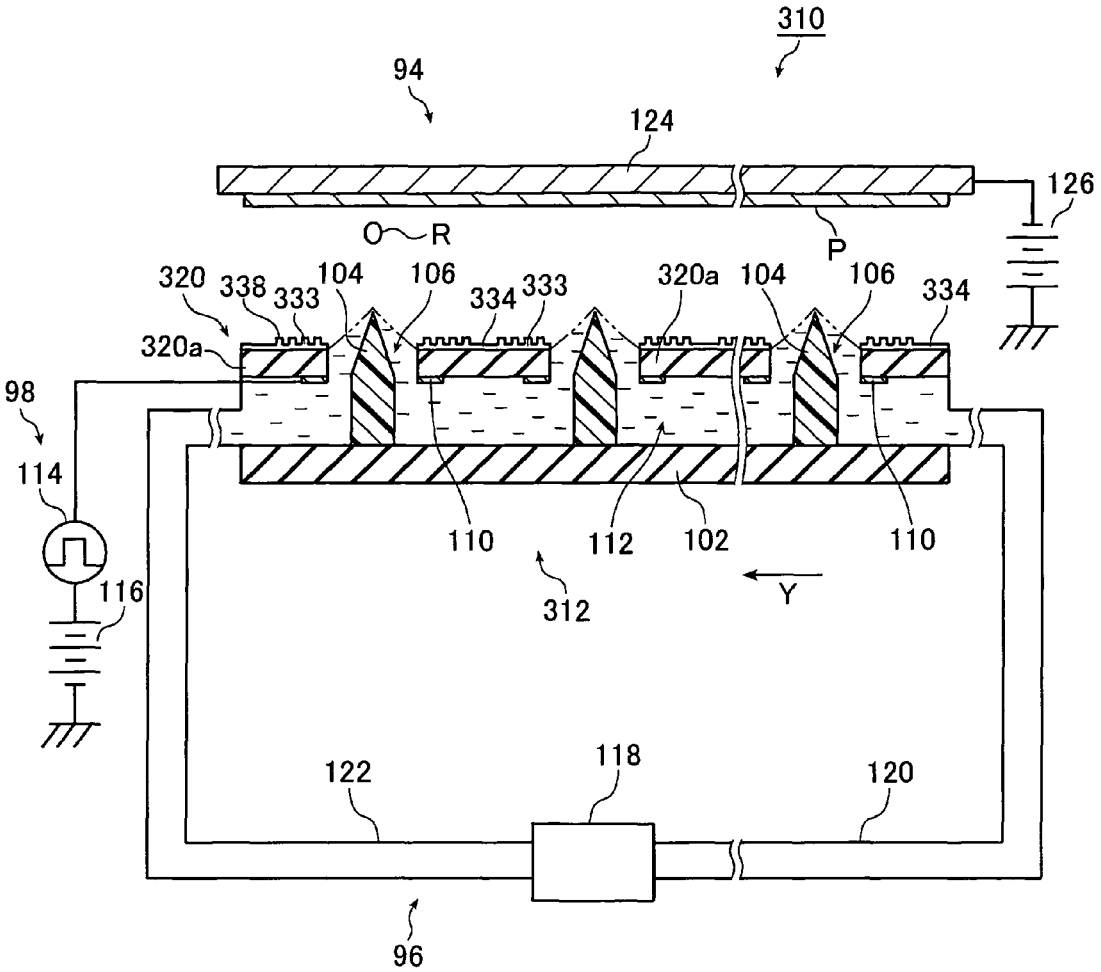
FIG. 29 is a schematic sectional view showing an ink-jet recording apparatus to which a liquid ejection head according to a fifteenth embodiment of the present invention is applied.
Figure 30:
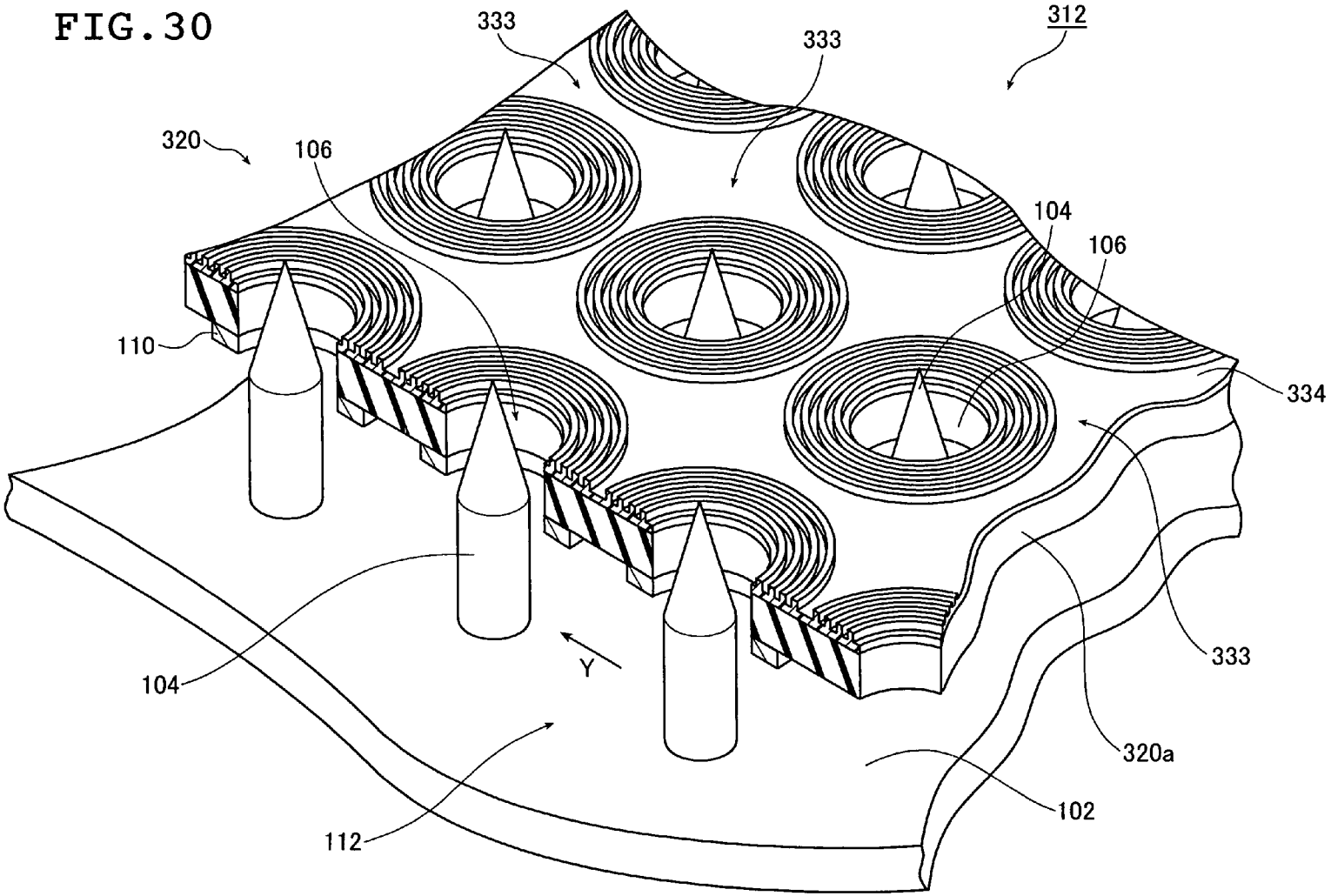
FIG. 30 is a schematic partial perspective view of the liquid ejection head shown in FIG. 29.

FIG. 29 is a schematic sectional view showing an ink-jet recording apparatus to which a liquid ejection head according to a fifteenth embodiment of the present invention is applied and FIG. 30 is a schematic partial perspective view of the liquid ejection head shown in FIG. 29. This embodiment refers to a case in which the liquid ejection head of the present invention is applied to an electrostatic ink-jet recording apparatus.

In an ink-jet recording apparatus 310 of this embodiment shown in FIGS. 29 and 30 (hereinafter referred to as the recording apparatus 310), the same reference numerals are given to the same constituents as those of the recording apparatus 90 according to the thirteenth embodiment shown in FIGS. 26 and 27, and detailed description of the same constituents is omitted.

The recording apparatus 310 of this embodiment is an electrostatic ink-jet recording apparatus that ejects ink droplets R to record (draw) an image on, for example, a rectangular recording medium P. The apparatus basically includes: a liquid ejection head 312 (hereinafter referred to as the ejection head 312); means 94 for holding the recording medium P; an ink circulating system 96; and voltage applying means 98.

The recording apparatus 310 of this embodiment ejects ink Q having a surface tension of, for example, 40 mN/m or less in the form of the ink droplets R.

The ejection head 312 of the recording apparatus 310 of this embodiment has the same constitution as that of the ejection head 92 of the thirteenth embodiment shown in FIGS. 26 and 27 except for the constitution of an ejection substrate 320. Therefore, a difference between the ejection head 312 and the ejection head 92 of the thirteenth embodiment shown in FIGS. 26 and 27 will be described in detail.

The ejection substrate 320 of the ejection head 312 of this embodiment includes: a support 320*a*; a base 334 formed on the surface of the support 320*a*; an uneven portion 333 formed on the base 334; and a repellent layer 338 formed on the surface of the base 334. The ejection substrate 320 is perforated with multiple ejection orifices 106 for ejecting the ink Q as the ink droplets R, the orifices penetrating through the support 320*a* and the base 334. Each ejection orifice 106 has a circle sectional shape.

The support 320*a* is made of an insulating material such as a ceramic material (for example, $Al_2O_3$ or $ZrO_2$), glass, or polyimide.

The base 334 is formed on the surface of the support 320*a* and has the uneven portion 333 formed thereon. The base 334 is not necessarily limited to one having repellency with respect to water, and may be lyophilic with respect to water.

The uneven portion 333 has projections 334*a* to 334*d* and recesses 336*a* to 336*c*, each of which has a shape in plan view substantially similar to that of each ejection orifice 106, alternately formed in a radial direction from the center of the ejection orifice 106 so that they surround the ejection orifice 106.

The projections 334*a* to 334*d* are identical, for example, in height, and in width in the radial direction from the center of the ejection orifice 106. Similarly, the recesses 336*a* to 336*c* are identical, for example, depth and in width in the radial direction from the center of the ejection orifice 106. It should be noted that the recesses 336*a* to 336*c* are preferably identical in depth in the present invention. However, in the present invention, even when the recesses 336*a* to 336*c* have different depths, the effect of the present invention can be achieved, although the effect is inferior to that in the case where the recesses 336*a* to 336*c* are identical in depth. Furthermore, the area ratio of the recesses 336*a* to 336*c* to the uneven portion 333 is preferably 40% or more, or more preferably 60% or more.

In this embodiment, each ejection orifice 106 is of a circular sectional shape. Therefore, with respect to the diameter direction of each ejection orifice 106, the ring-shaped projections 334*a* to 334*d* and the ring-shaped recesses 336*a* to 336*c*, each of which has a shape in plan view substantially similar to that of the ejection orifice 106, are alternately formed so as to draw four concentric circles about the center of the ejection orifice 106.

Each interval at which the projections 334*a* to 334*d* and the recesses 336*a* to 336*c* are repeatedly formed is shorter than the diameter of each ejection orifice 106.

The repellent layer 338 is formed on the surface of the base 334 (the uneven portion 333), and is made of a material having repellency. The repellent layer 338 is formed to have such a thickness that its surface profile can be maintained while the recesses 336*a* to 336*c* of the uneven portion 333 are not filled with a repellent material. The repellent layer 338 is made of, for example, a fluorine-containing organic substance or a low-molecular-weight, fluorine-containing repellent material and having, for example, 10 or more fluorine (F) atoms such as fluoroalkylsilane.

Next, the ejection substrate 320 of the liquid ejection head 312 in this embodiment will be described in detail.

Figure 31A:
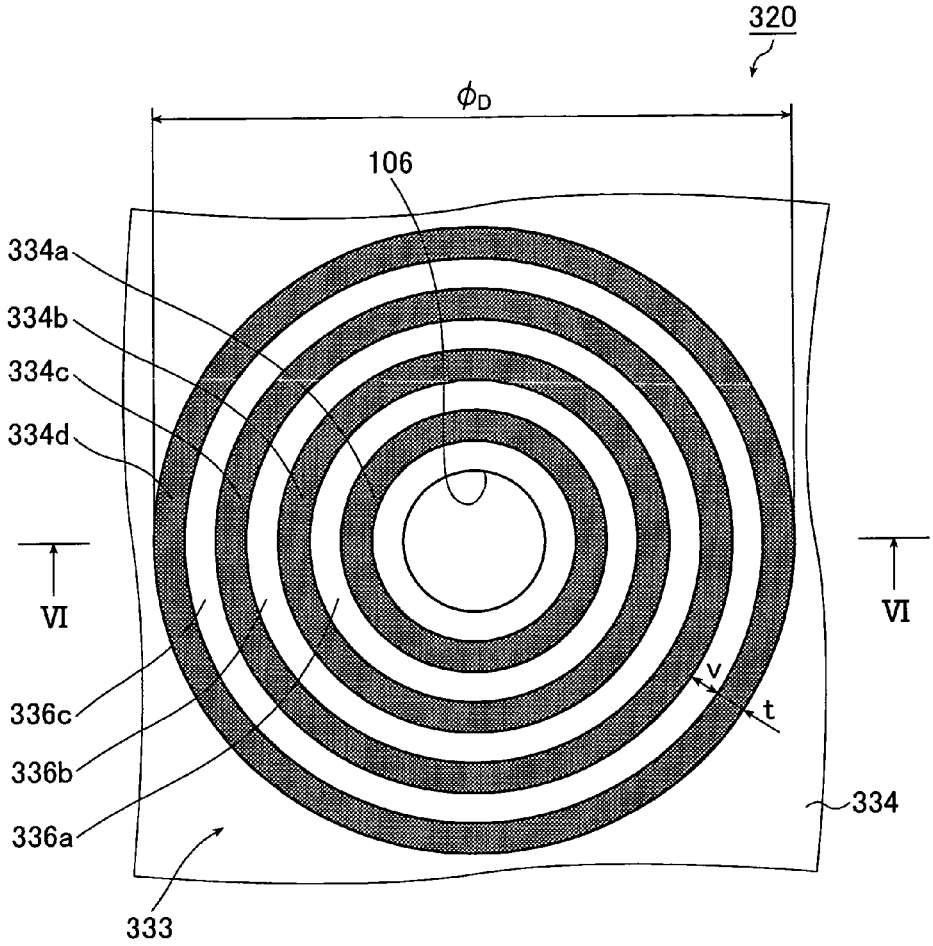
FIG. 31A is a schematic plan view including one ejection orifice in an ejection substrate of the liquid ejection head in the fifteenth embodiment.
Figure 31B:
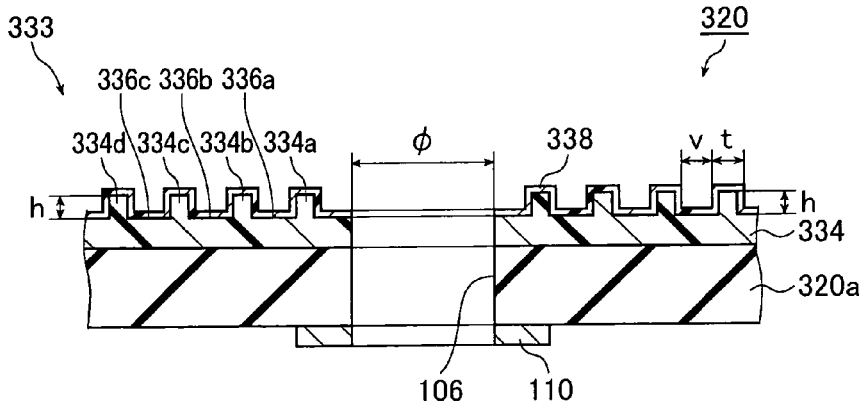
FIG. 31B is a sectional view taken along the line VI-VI of FIG. 31A.

FIG. 31A is a schematic plan view of one ejection orifice in the ejection substrate of the liquid ejection head in this embodiment and FIG. 31B is a sectional view taken along the line VI-VI of FIG. 31A. In FIG. 31A, the repellent layer 338 is not shown.

As shown in FIG. 31A, in the ejection substrate 320, the uneven portion 333 is formed on the surface of the support 320*a* so as to surround the ejection orifice 106. In addition, as shown in FIG. 31B, the repellent layer 338 is formed on the surface of the uneven portion 333. The repellent layer 338 is thin, and the surface of the uneven portion 333 substantially serves as an ink ejection surface.

The repellent layer 338 has preferably a sufficient thickness for the shape of each of the projections 334*a* to 334*d* and the recesses 336*a* to 336*c* to be maintained. That is, the thickness of the repellent layer 338 is preferably equal to or less than one half, or more preferably equal to or less than one tenth, of the length of each of the recesses 336*a* to 336*c* in the radial direction from the center of the ejection orifice 106. Thus, the uneven profile of the uneven portion 333 is maintained while the recesses 336*a* to 336*c* are not filled with a repellent material. The thickness of the repellent layer 338 is preferably equal to or less than one tenth of the diameter of each ejection orifice 106.

As shown in FIG. 31A, the recesses 336*a* to 336*c* are present between the projections 334*a* to 334*d*, and the recesses 336*a* to 336*c* are independent of one another. The recesses 336*a* to 336*c* do not communicate with the outside except their openings, so the uneven portion 333 has a closed structure. The uneven portion 333 with a closed structure as mentioned above causes air present in the recesses 336*a* to 336*c* to contact the ink Q, so the contact angle with respect to the ink Q can be increased (in other words, the transition angle can be reduced). As a result, spreading of the ink Q is suppressed, and hence the ink Q can be consistently ejected.

Furthermore, the repellent layer 338 is formed on the surface of the uneven portion 333, so the repellent effect owing to the repellent layer 338 can also be achieved. As described above, the contact angle can be increased even with respect to a liquid having a surface tension lower than that of water such as ink by two effects: repellency imparted by the structure of the uneven portion 333 and repellency imparted by the repellent layer 338. In addition, the ink Q can be collected in a circular fashion in the ejection orifices 106 by virtue of the pattern of the uneven portion 333. Thus, the meniscus of the ink Q can be stabilized without being changed with time. In this embodiment, each ejection orifice 106 has a circular shape, so the ink Q can be maintained in a state having a substantially circular shape in plan view as shown in FIG. 28A.

In this embodiment, the diameter Φ of each ejection orifice 106 is, for example, 130 μm, the width t of each of the projections 334*a* to 334*d* in the radial direction from the center of the ejection orifice 106 is, for example, 2 μm, and the width v of each recess in the radial direction from the center of the ejection orifice 106 is, for example, 5 μm. In addition, the outer diameter $\Phi_D$ of the ring formed by the outermost projection 334*d* is, for example, 508 μm. In this embodiment, the outer diameter $\Phi_D$ of the ring formed by the outermost projection 334*d* has desirably such a size that the projection 334*d* contacts the outermost projection (not shown) of the adjacent ejection orifice (not shown), or the entire surface of the ejection substrate 320 has desirably the uneven profile.

The width t of each of the projections 334*a* to 334*d* is preferably equal to or less than one tenth of the diameter Φ of each ejection orifice 106. Furthermore, the ejection orifices are formed so that the interval (pitch) between the centers of adjacent ejection orifices 106 is 508 μm.

In this embodiment, a total of, for example, 50×24 (that is, 1,200) ejection orifices 106 may be arranged in a staggered manner.

Furthermore, in this embodiment, the angle formed at each corner of each of the projections 334*a* to 334*d* (corresponding to the angle α shown in FIG. 4A) is 90°. The angle α is preferably 60° to 120°.

When the side walls and the upper surfaces of the projections 334*a* to 334*d* are continuously smooth, the radius of curvature ρ (see FIG. 4C) is smaller than the smaller one of the width v of each of the recesses 336*a* to 336*c* and the depth h of each of the recesses 336*a* to 336*c*. The radius of curvature ρ is desirably equal to or less than one tenth of the smaller one of the width v of each of the recesses 336*a* to 336*c* and the depth h of each of the recesses 336*a* to 336*c*.

Next, a method of producing the ejection substrate of the liquid ejection head in this embodiment will be described.

FIGS. 32A to 32E are sectional views showing the method of producing the ejection substrate of the liquid ejection head in this embodiment in order of steps. In the method of producing the ejection substrate of the liquid ejection head of this embodiment, the step of forming the ejection electrodes 110 is not shown.

Figure 32A:
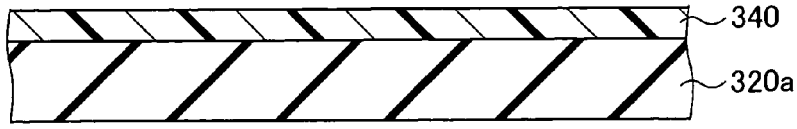
FIGS. 32A to 32E are schematic sectional views showing a method of producing the ejection substrate of the liquid ejection head in the fifteenth embodiment in order of steps.

As shown in FIG. 32A, at first, a repellent support layer 340 made of, for example, polyimide is formed on the surface of the support 320*a* made of, for example, polyimide. The support 320*a* is produced as a film by, for example, roll coating.

Next, a resist (not shown) is applied to the surface of the repellent support layer 340 to form a resist film 342.

Figure 32B:
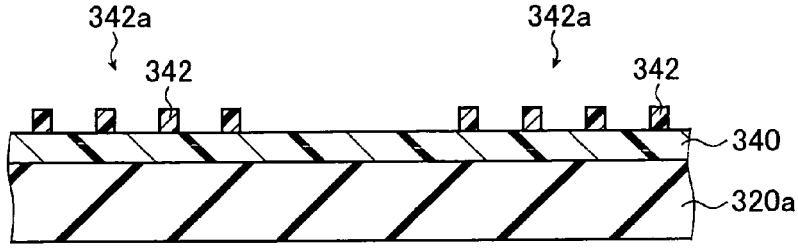

Next, as shown in FIG. 32B, a pattern 342*a* of the uneven portion 333 is formed by a photolithographic technique on the resist film 342 around regions where the ejection orifices 106 are to be formed (not shown).

As described above, in the resist film 342 having formed thereon the pattern 342*a*, for example, the width of a region serving as any one of the projections 334*a* to 334*d* is 2 μm and the width of a region serving as any one of the recesses 336*a* to 336*c* (a gap between projections) is 5 μm. In the pattern 342*a* of the resist film 342, the ring-shaped projections 334*a* to 334*d* and the ring-shaped recesses 336*a* to 336*c*, each of which has a shape in plan view substantially similar to that of the ejection orifice 106, are alternately formed to draw in the diameter direction of the ejection orifice 106, for example, four circles concentric about the center of the ejection orifice 106.

Next, the uneven portion 333 (including the projections 334*a* to 334*d* and the recesses 336*a* to 336*c*) is formed on the surface of the repellent support layer 340 by, for example, dry etching with the resist film 342 having the pattern 342*a* formed thereon as a mask.

Figure 32C:
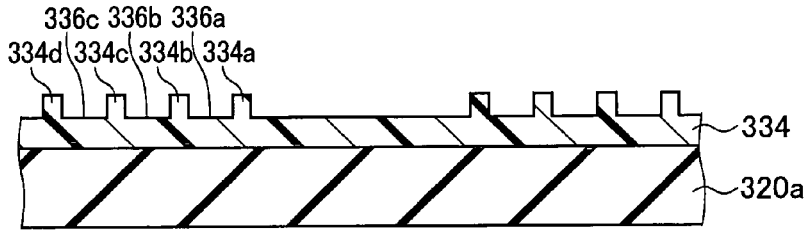

Next, the resist film 342 is removed. As a result, as shown in FIG. 32C, the uneven portion 333 having the ring-shaped projections 334*a* to 334*d* and the ring-shaped recesses 336*a* to 336*c* is formed. In the uneven portion 333, the ring-shaped projections 334*a* to 334*d* and the ring-shaped recesses 336*a* to 336*c* are alternately arranged to draw four concentric circles.

Figure 32D:
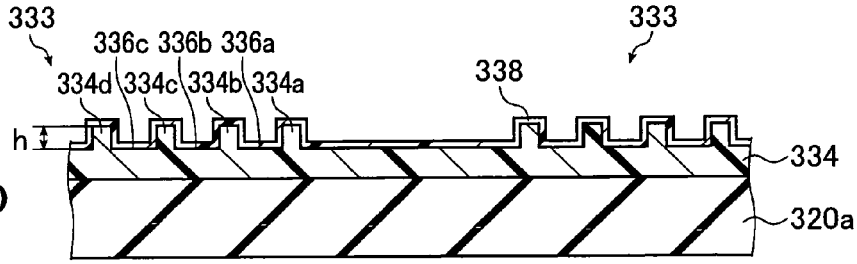

Next, as shown in FIG. 32D, a fluorine-containing organic material or a material having repellency such as fluoroalkylsilane is applied to the surface of the uneven portion 333 to form the repellent layer 338.

Figure 32E:
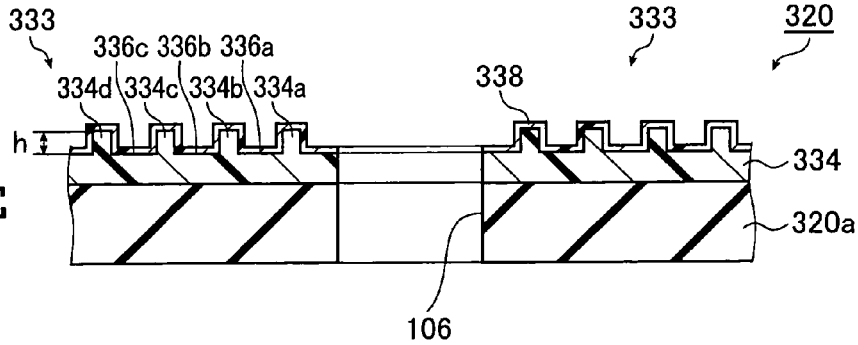

Next, as shown in FIG. 32E, the ejection orifices 106 are formed in the regions where the ejection orifices 106 are to be formed (not shown) by, for example, dry etching. Thus, the ejection substrate 320 of this embodiment is formed.

In this embodiment, the repellent support layer 340 may be formed of a material having repellency without the formation of the repellent layer 338. That is, the base 334 (the uneven portion 333) may be formed of a material having repellency with respect to water.

The recording apparatus 310 of this embodiment can record an image in the same manner as in the recording apparatus 90 of the thirteenth embodiment shown in FIGS. 26 and 27.

In the ejection head 312 of this embodiment, the uneven portion 333 having a pattern and a profile based on the inventors' findings is formed on the surface of the ejection substrate 320. As a result, the contact angle can be made equal to or more than 90° or can be increased even with respect to the ink Q having a surface tension lower than that of water, and the shape of the ink Q can be made closer to a circle. Therefore, the solution of the ink Q can be collected in a substantially circular fashion near the ejection orifices 106. Thus, a change in meniscus with time can be suppressed, and the shape of the meniscus can be stabilized. Therefore, the direction in which an ink droplet R flies becomes constant, and the ink droplet R always impinges on the recording medium P at the position corresponding to the center of the projecting tip of each ink guide, so the ink droplet R is allowed to impinge on the recording medium P at the correct position. As a result, a high-quality image can be recorded on the recording medium P. Furthermore, the stabilization of the shape of the meniscus allows an ink droplet R having a predetermined size (predetermined amount) to be reliably ejected, whereby a good image with a stabilized density can be recorded on the recording medium P.

Furthermore, the ink Q is collected in a substantially circular fashion in the ejection orifices 106 by virtue of the uneven portion 333 of the substrate 320. Thus, a meniscus is fixed at a predetermined position. As a result, the integration of the meniscus with ink in any adjacent ejection orifice 106 is prevented, so no interference between channels occurs. As mentioned above, no interference between channels occurs, so the disturbance of ink droplets in the direction of their ejection due to cross-linking of ink and the disturbance of the ejection frequency can be prevented.

Sixteenth Embodiment

Next, a sixteenth embodiment of the present invention will be described.

Figure 33:
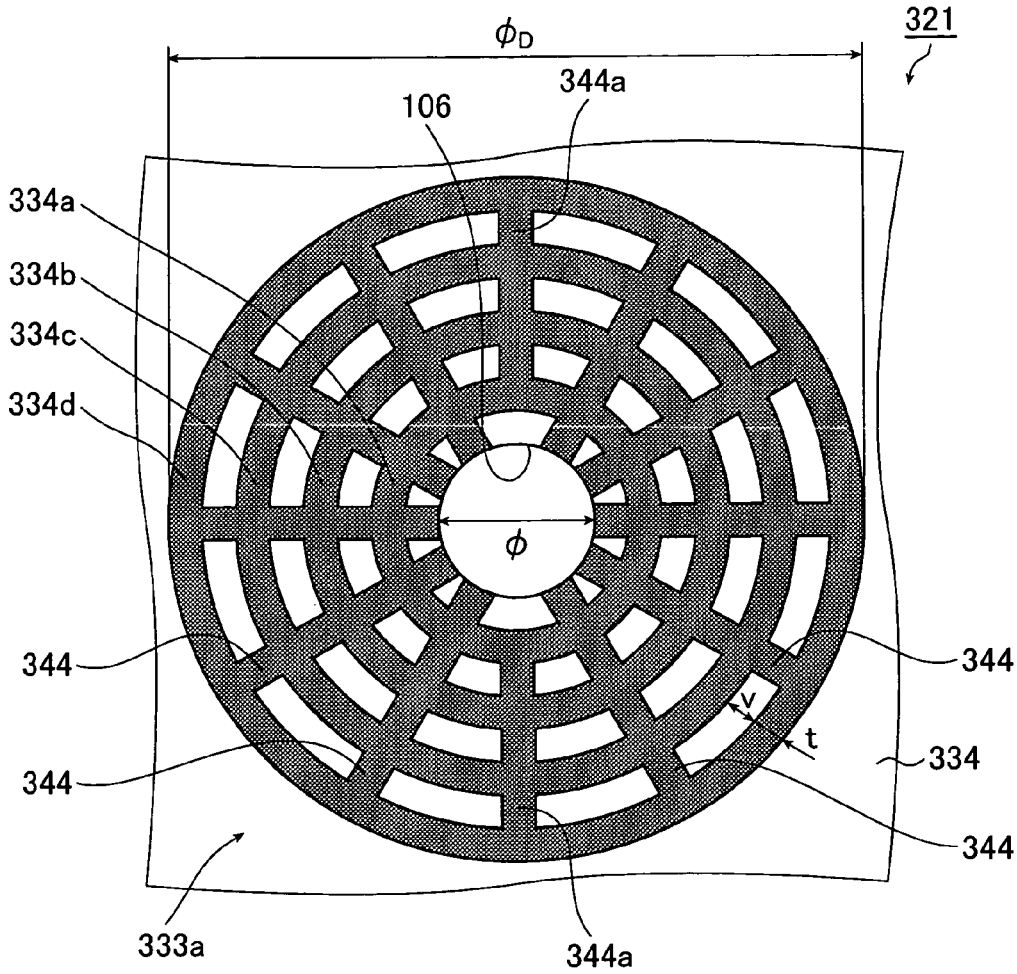
FIG. 33 is a schematic plan view showing one ejection orifice in an ejection substrate according to a sixteenth embodiment of the present invention.

FIG. 33 is a schematic plan view showing one ejection orifice in an ejection substrate according to the sixteenth embodiment of the present invention. In this embodiment, the same reference numerals are given to the same constituents as those of the ejection substrate 320 according to the fifteenth embodiment shown in FIGS. 29 to 31B, and detailed description of the same constituents is omitted. In addition, in FIG. 33, the repellent layer 338 is not shown.

As shown in FIG. 33, an ejection substrate 321 of this embodiment has the same constitution as that of the ejection substrate 320 of the fifteenth embodiment except for the constitution of an uneven potion 333*a*, and detailed description thereof is omitted.

As shown in FIG. 33, the uneven portion 333*a* of the ejection substrate 321 of this embodiment has, for example, twelve straight line portions 344 and 344*a* extending radially from the center of the ejection orifice 106 as a center.

The straight line portions 344*a* extend over the projections 334*a* to 334*d*, and, for example, two straight line portions 344*a* are formed in an axisymmetric manner with respect to the diameter direction of the ejection orifice 106. In addition, the straight line portions 344 extend from the edge of the ejection orifice 106 to the projection 334*d*, and, for example, five straight line portions 344 are formed in an axisymmetric manner with respect to the axis of symmetry formed by the straight line portions 344*a*.

By providing the uneven portion 333*a* with the straight line portions 344 and 344*a* as described above, abrasion resistance on an ink ejection surface (the surface of the uneven portion 333*a*) can be improved at the time of, for example, wiping of the ink Q. In this embodiment as well, the recesses do not communicate with the outside except their openings and are independent of each other, so the uneven portion 333*a* has a closed structure.

The method of producing the ejection substrate 321 of this embodiment is the same as the method of producing the ejection substrate 320 of the fifteenth embodiment (see FIGS. 32A to 32E) except for the pattern of the resist film 342 (see FIG. 32B), and detailed description thereof is omitted.

Furthermore, a liquid ejection head equipped with the ejection substrate 321 of this embodiment imparts the same effect as that of the fifteenth embodiment and improves abrasion resistance on the ink ejection surface (the surface of the uneven portion 333*a*). Thus, the effect of further consistent ejection of the ink Q can be achieved.

In each of the ejection substrate 320 of the fifteenth embodiment and the ejection substrate 321 of the sixteenth embodiment, the uneven portion has such a pattern that recesses do not communicate with the outside except their openings. However, the present invention is not limited thereto. For example, a vertical pattern which has a shape in plan view substantially similar to that of an ejection orifice and is formed by rotating around the center of the ejection orifice, is also permitted.

As described above, in the present invention, ink and air present in a recess are allowed to contact each other to reduce the transition angle (in other words, increase the contact angle). The ease with which air in recesses is exchanged for ink (solution) reduces as long as the recesses do not communicate with the outside except their openings in an uneven portion. Therefore, the pattern of an uneven portion is not particularly limited as long as the recesses do not communicate with the outside except their openings in the uneven portion.

Figure 34:
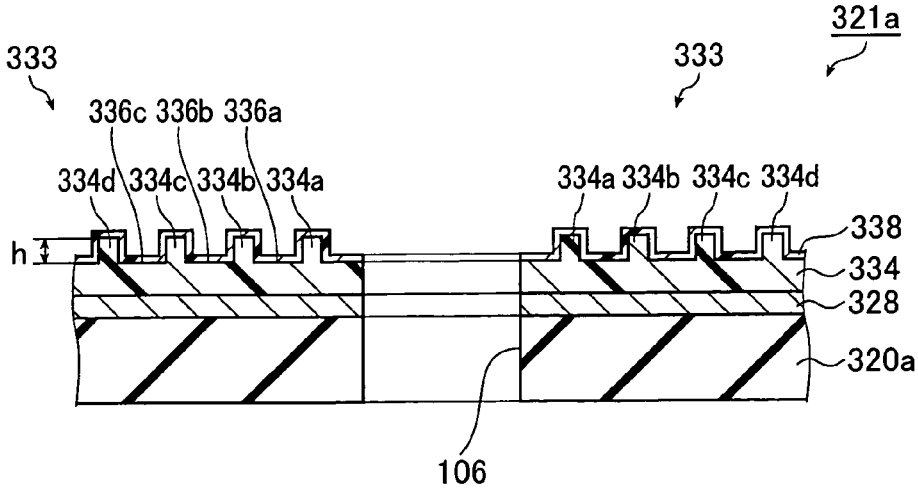
FIG. 34 is a schematic sectional view showing a modified example of each of the ejection substrate of the fifteenth embodiment of the present invention and the ejection substrate of the sixteenth embodiment of the present invention.

In each of the ejection substrate 320 of the fifteenth embodiment and the ejection substrate 321 of the sixteenth embodiment, like an ejection substrate 321*a* of a modified example of each of the fifteenth embodiment and the sixteenth embodiment as shown in FIG. 34, the region of the ejection substrate 321*a* except the ejection orifices 106 is preferably entirely coated with a shield electrode 328. In this case, the shield electrode 328 is formed between the support 320*a* and the uneven portion 333. That is, the uneven portion 333 is formed on the surface of the shield electrode 328, and the surface of the shield electrode 328 is subjected to an ink repellency treatment.

The shield electrode 328 is a sheet-shaped electrode formed from a conductive metal plate or the like and common to all the ejection orifices 106. The electric potential of the electrode is maintained at a predetermined value. The predetermined electric potential includes 0 V through grounding. The shield electrode 328 allows an ejection orifice 106 (ejection portion) to be shielded from the electric lines of force of the adjacent ejection orifices 106 (ejection portions) to prevent electric field interference between the ejection orifices, so that the ink droplets R can be consistently ejected.

Furthermore, in the ejection substrate 321*a* of this modified example, a cubic barrier (not shown) is preferably arranged on the upper surface of the shield electrode 328. The cubic barriers surround the individual uneven portions 333 on the peripheries of the ejection orifices 106 so that the uneven portions 333 are separated from each other to prevent the ink Q in one ejection orifice 106 from being mixed with the ink Q in other ejection orifices 106, that is, to assure that the meniscuses of the ink Q in the respective ejection orifices 106 (ejection portions) are separated from each other.

For example, lattice-shaped walls may be formed for the cubic barrier so as to separate the ejection orifices 106 form each other. However, the present invention is not limited thereto. For example, cylindrical cubic barriers individually surrounding the ejection orifices 106 may also be available as long as the respective ejection orifices 106 can be separated from each other.

In addition, the surface of the cubic barrier is preferably made repellent with respect to ink in order to surely prevent the ink from climbing up the wall surface of the cubic barrier to separate the meniscuses of the ink in the ejection orifices 106 from each other.

In the fifteenth embodiment and the sixteenth embodiment, there is no particular limitation on the shape of each ejection orifice 106, and each ejection orifice 106 may have, for example, an elliptical or quadrangular sectional shape.

In the fifteenth and sixteenth embodiment, the uneven portion 333 and 333*a* are formed on the base 334. However, the present invention is not limited thereto. For example, only projections may be formed on the support 320*a*, or a support and a base may be integrated to form an uneven portion.

In each of the fifteenth and sixteenth embodiments, an electrostatic ink-jet recording apparatus has been described. However, in the present invention, the ink ejection method is not particularly limited as long as a liquid ejection head for ejecting a solution is used. For example, the present invention is applicable to an ink-jet recording apparatus of a piezoelectric system or an ink-jet recording apparatus of a thermal system.

Seventeenth Embodiment

Next, a seventeenth embodiment of the present invention will be described.

Figure 35A:
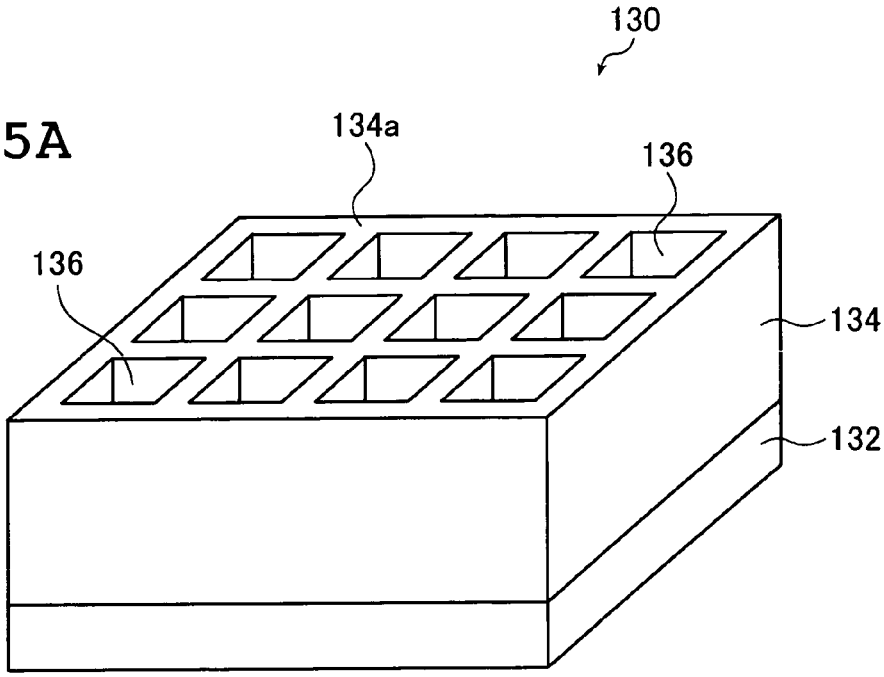
FIG. 35A is a schematic perspective view showing a stain-resistant film in which the repellency increasing structure of the present invention is applied to a stain-resistant layer.
Figure 35B:
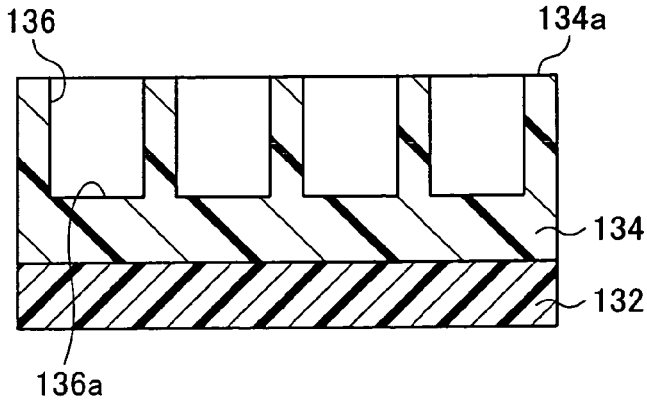
FIG. 35B is a schematic partial sectional view of the stain-resistant film shown in FIG. 35A.

FIG. 35A is a schematic perspective view showing a stain-resistant film in which the repellency increasing structure of the present invention is applied to a stain-resistant layer and FIG. 35B is a schematic partial sectional view of the stain-resistant film shown in FIG. 35A.

A stain-resistant film 130 of this embodiment is obtained by applying the repellency increasing structure according to any one of the first to twelfth embodiments of the present invention to a stain-resistant layer 134.

A stain-resistant film 130 shown in FIG. 35 includes: a support 132; and the stain-resistant layer 134 formed on the surface of the support 132.

The support 132 is formed from, for example, a transparent plastic film. Examples of the material that can be used for the support 132 include: cellulose ethers such as triacetylcellulose, diacetylcellulose, and propionylcellulose; and polyolefins such as polypropylene, polyethylene, and polymethylpentene.

The stain-resistant layer 134 has multiple recesses 136 each having a square sectional shape. The bottom 136*a* of each recess 136 does not reach the support 132.

The repellency increasing structure according to any one of the first to twelfth embodiments is applicable to the stain-resistant layer 134 of this embodiment. Therefore, the stain-resistant layer 134 has only to have the same structure as that of the repellency increasing structure according to any one of the first to twelfth embodiments.

In the stain-resistant film 130 of this embodiment, the stain-resistant layer 134 can have a contact angle of 90° or more, or can increase the contact angle with respect to a liquid having a surface tension lower than that of water such as an organic solvent, oil, or a liquid having a surface tension of 40 mN/m or less. Therefore, the contact angle of, for example, oil of which contamination is mainly composed can be increased. As a result, oil hardly adheres to a surface 134*a* of the stain-resistant layer 134. In addition, the contact angle with respect to oil can be increased, so oil or the like can be easily removed. As a result, contamination due to the adhesion of a fingerprint, sebum, sweat, cosmetics, and the like can be prevented, and contamination can be easily removed.

As described above, the stain-resistant film 130 of this embodiment can prevent contamination due to a fingerprint, sebum, sweat, cosmetics, and the like, so the film can be suitably used for, for example, a touch panel or a filter to be attached to the surface of any one of various monitors.

The repellency increasing structure and the method of producing the same, the liquid ejection head and the method of producing the same, and the stain-resistant film of the present invention have been described above. However, the present invention is not limited to the above embodiments. It is needless to say that various modifications or alterations may be made without departing from the gist of the present invention.

EXAMPLE 1

Hereinafter, the present invention will be described in more detail by way of specific examples of the repellency increasing structure of the present invention. It is needless to say that the present invention is not limited to the following examples. At first, Example 1 will be described.

In Example 1, repellency increasing structures of Example Nos. 1 to 10 and a repellency increasing structure of Comparative Example No. 1 were produced, and they were evaluated for repellency.

At first, the constitutions and production methods of Example Nos. 1 to 6, 9 and 10 will be specifically described.

Example Nos. 1 to 6, 9 and 10 each had the same constitution as that of the repellency increasing structure according to the sixth embodiment of the present invention (see FIG. 17A). In each of those Example Nos. 1 to 6, 9 and 10, silicon was used for the lower substrate and polyimide having a thickness of 4 μm was used for the substrate.

In Example No. 8, silicon was used for the lower substrate and silicon was used for the substrate.

Example Nos. 1 to 4 and 7 to 9 each used a recess pattern having recesses. Example Nos. 5, 6 and 10 each used a projection pattern having projections. Recesses and projections formed on the substrates each had a substantially square shape in plan view. Those recesses and projections each had a length of 15 μm.

In Example No. 1, each recess portion had a rectangular sectional shape, and the angle α at the corner of each recess was 90°. In Example No. 1, each recess had a length of 15 μm, the gap between adjacent recesses was 2 μm, and the area ratio was 78%.

In Example No. 2, the angle α was 100°. In Example No. 8, the angle α was 1260. In Example No. 8, the angle was controlled through anisotropic etching of silicon.

In Example No. 3, the radius of curvature was 1 μm, which was smaller than the smaller one of the width and depth of each recess, in this case the depth of 4 μm. In Example No. 9, the radius of curvature was 2.5 μm, and was larger than the depth of each recess (1.4 μm). In each of Example No. 3 and Example No. 9, conditions at the time of etching were controlled to allow the circumference of each recess to have a curved surface, thereby changing the radius of curvature.

In Example No. 4, the width of each recess was 15 μm, the width of a side wall was 20 μm, and the area ratio was 18%.

In each of Example Nos. 5, 6 and 10, the area ratio in a surface structure having projections was changed. In Example Nos. 5, 6 and 10, the width of each projection (the length of one side) was 15 μm. The gap between adjacent projections was 2 μm in Example No. 5, 5 μm in Example No. 6, or 10 μm in Example No. 10. The area ratio in Example No. 5 was 22%. The area ratio in Example 6 was 46%. The area ratio in Example 10 was 64%.

In all examples and comparative example except Example No. 7, a coating layer having a thickness of about 10 nm was formed on the entire surface of the substrate on which recesses or projections were formed.

The coating layer was made of fluoroalkylsilane ($CF_3(CF_2)_7CH_2CH_2Si(OCH_3)$) (TSL 8233 manufactured by GE Toshiba Silicones)).

Figure 36A:
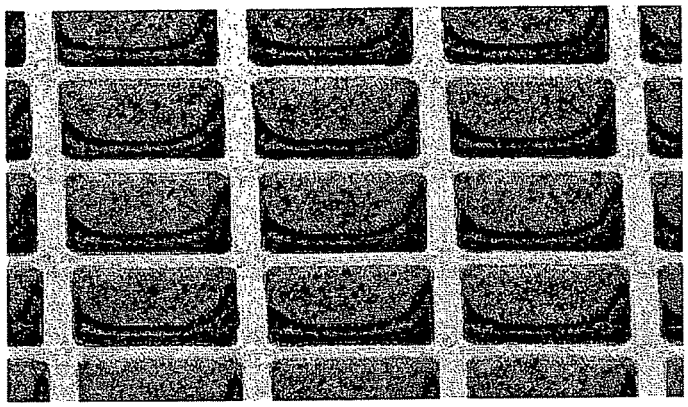
FIG. 36A is an image of a repellency increasing structure of Example No. 1 taken with a scanning electron microscope (SEM)
Figure 36B:
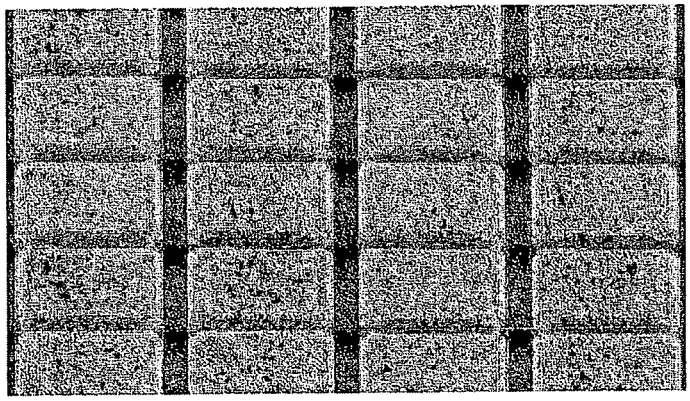
FIG. 36B is an SEM image of a repellency increasing structure of Example No. 2.

Table 2 shows the constitutions of the repellency increasing structures of Example Nos. 1 to 10 and the repellency increasing structure of Example No. 8. FIG. 36A shows an image taken with a scanning electron microscope (SEM) in Example No. 1 and FIG. 36B shows an SEM image of Example No. 4.

In Example No. 7, silicon was used for the lower substrate and a fluoropolymer (Cytop (registered trademark)) was used for the substrate. Example No. 7 had exactly the same structure as that of Example No. 1 except for the composition of the substrate.

In Comparative Example No. 1, an $SiO_2$ film was formed on the surface of a silicon substrate by plasma CVD. A coating layer made of fluoroalkylsilane ($CF_3(CF_2)_7CH_2CH_2Si(OCH_3)$) (TSL 8233 manufactured by GE Toshiba Silicones)) was formed on the surface of the $SiO_2$ film as described above. The coating layer had a thickness of 10 nm. In Comparative Example No. 1, a silicon oxide film had recesses and projections formed during the growth period and its surface had a fractal structure.

Figure 36C:
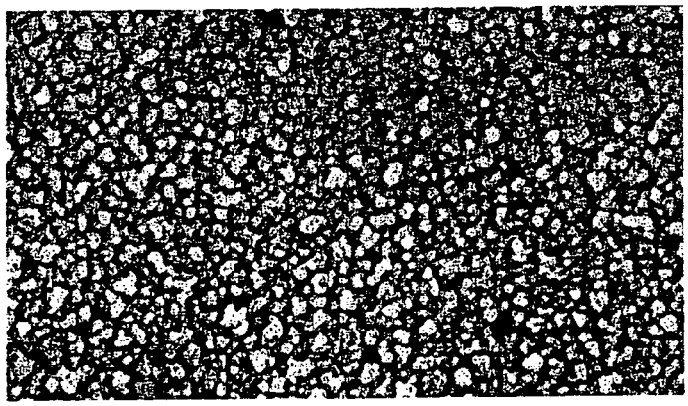
FIG. 36C is an SEM image of a repellency increasing structure of Comparative Example No. 1.

FIG. 36C shows an SEM image of Comparative Example No. 1. As shown in FIG. 36C, the recesses and projections in Comparative Example No. 1 each have a round shape unlike Example No. 1.

TABLE 2

| | Material | Pattern | Sectional profile | Area ratio |
|---|---|---|---|---|
| Example NO. 1 | Fluorine-containing material on polyimide surface | Recess | 90° | 78% |
| Example NO. 2 | Fluorine-containing material on polyimide surface | Recess | 100° | 78% |
| Example NO. 3 | Fluorine-containing material on polyimide surface | Recess | Small radius of curvature | 78% |
| Example NO. 4 | Fluorine-containing material on polyimide surface | Recess | 90° | 18% |
| Example NO. 5 | Fluorine-containing material on polyimide surface | Projection | 90° | 22% |
| Example NO. 6 | Fluorine-containing material on polyimide surface | Projection | 90° | 46% |
| Example NO. 7 | Fluoropolymer | Recess | 90° | 78% |

TABLE 2-continued

| | Material | Pattern | Sectional profile | Area ratio |
|---|---|---|---|---|
| Example NO. 8 | Fluorine-containing material on silicon substrate | Recess | 126° | 78% |
| Example NO. 9 | Fluorine-containing material on polyimide surface | Recess | Large radius of curvature | 78% |
| Example NO. 10 | Fluorine-containing material on polyimide surface | Projection | 90° | 64% |
| Comparative Example NO. 1 | Fluorine-containing material on $SiO_2$ porous film surface | Fractal structure | — | — |

In Example 1, repellency was evaluated with a contact angle meter manufactured by Kyowa Interface Science Co., Ltd. Table 3 shows the results of the evaluation.

In addition, in Example 1, the liquids used were water (having a surface tension of 72 mN/m), a 7 wt % aqueous IPA solution (having a surface tension of 44 mN/m), a 30 wt % aqueous IPA solution (having a surface tension of 27 mN/m), an aqueous decane solution (having a surface tension of 23 mN/m), and silicone oil (having a surface tension of 18 mN/m). Hereinafter, the 7 wt % aqueous IPA solution is referred to as the 7% aqueous IPA solution, and the 30 wt % aqueous IPA solution is referred to as the 30% aqueous IPA solution.

For comparison, flat surfaces with no recesses or projections were used for the evaluation of the contact angle in a flat state. That is, a flat silicon substrate coated with fluoroalkylsilane or Cytop was used. The contact angles of the respective coated substrates were measured for all liquids used for the evaluation of repellency. The column "Contact angle (Flat)" in Table 3 below shows the results obtained by coating the flat surfaces as described above.

Fluoroalkylsilane and Cytop had surface tensions of 10 mN/m and 19 mN/m, respectively. Fluoroalkylsilane and Cytop are solid materials each having a surface tension equal to or more than one fourth of a liquid having a surface tension of 40 mN/m or less of the present invention.

As shown in Table 3, in Example Nos. 1 to 10, the contact angle could be increased even when it was less than 90° on a flat surface.

In Example No. 1, the angle α of each recess was 90°. In Example No. 2, the angle α of each recess was 100°. In Example No. 8, the angle α of each recess was 126°.

In Example No. 1, the contact angle increased as compared to a flat case with respect to any liquid, and repellency having an angle α of 90° or more was obtained. In Example No. 1, the contact angle in a flat case was 60° with respect to decane, but was increased to 115° as a result of pattern formation.

In Example No. 2, the angle α was 100°. The contact angle with respect to a liquid having a surface tension of 40 mN/m or less was slightly smaller than that of Example No. 1, but increased as compared to a flat case.

In Example No. 8, the angle α was 126°. The contact angle with respect to the 30% aqueous IPA solution having a surface tension of 40 mN/m or less increased even when it was less than 90° on a flat surface. However, the contact angle did not increase with respect to decane and silicone oil each having a surface tension lower than that of the 30% aqueous IPA solution.

Accordingly, in the present invention, the angle α at each corner was related to an increase in contact angle. In the case where the angle α was 126° or less, the effect of increasing the contact angle was reduced even when the contact angle was less than 90° in a flat state. As described above, the angle α is important for an increase in repellency.

In Example No. 3, the contact angle increased with respect to all liquids used for the evaluation of repellency, so repellency was increased. In Example No. 3, the contact angle could increase even when it was less than 90° on a flat surface.

On the other hand, in Example No. 9, an increase in contact angle was observed with respect to the 30% aqueous IPA solution, but no increase was observed with respect to decane and silicone oil each having a surface tension lower than that of the 30% aqueous IPA solution. Accordingly, in the present invention, when the circumference of each recess has a curved surface, repellency can be further increased if the radius of curvature is smaller than the smaller one of the width and depth of each recess.

In Example No. 4, the contact angle was smaller than that of Example No. 1, but increased in all liquids used for the evaluation of repellency, so repellency increased. As shown in

TABLE 3

| | Water (72 mN/m) | | 7% aqueous IPA solution (44 mN/m) | | 30% aqueous IPA solution (27 mN/m) | | Decane (23 mN/m) | | Silicone oil (18 mN/m) | |
|---|---|---|---|---|---|---|---|---|---|---|
| | Contact angle (Flat) | Contact angle (With pattern) | Contact angle (Flat) | Contact angle (With pattern) | Contact angle (Flat) | Contact angle (With pattern) | Contact angle (Flat) | Contact angle (With pattern) | Contact angle (Flat) | Contact angle (With pattern) |
| Example NO. 1 | 105° | 115° | 93° | 126° | 72° | 119° | 60° | 115° | 48° | 95° |
| Example NO. 2 | 105° | 140° | 93° | 139° | 72° | 116° | 60° | 97° | 48° | 82° |
| Example NO. 3 | 105° | 137° | 93° | 137° | 72° | 119° | 60° | 97° | 48° | 71° |
| Example NO. 4 | 105° | 115° | 93° | 110° | 72° | 121° | 60° | 73° | 48° | 60° |
| Example NO. 5 | 105° | 166° | 93° | 130° | 72° | 119° | 60° | 103° | 48° | 58° |
| Example NO. 6 | 105° | 141° | 93° | 135° | 72° | 113° | 60° | 94° | 48° | 70° |
| Example NO. 7 | 115° | 143° | 99° | 134° | 68° | 115° | 37° | 86° | 16° | 26° |
| Example NO. 8 | 105° | 130° | 93° | 116° | 72° | 83° | 60° | 56° | 48° | 19° |
| Example NO. 9 | 105° | 134° | 93° | 116° | 72° | 87° | 60° | 61° | 48° | 43° |
| Example NO. 10 | 105° | 144° | 93° | 139° | 72° | 97° | 60° | 79° | 48° | 47° |
| Comparative Example NO. 1 | 105° | 160° | 93° | 135° | 72° | 0° | 60° | 0° | 48° | 0° |

Table 3, the contact angle with respect to decane increased to 73° even though it was 60° on a flat surface. Therefore, in a surface structure having recesses, the effect of increasing repellency can be surely achieved as long as the area ratio is 18% or more.

In Example Nos. 5, 6 and 10, the area ratio in a surface structure having projections was changed.

In Example Nos. 5 and 6, the contact angle increased in each of all liquids used for the evaluation of repellency, so repellency increased. In Example Nos. 5 and 6, the contact angle could be increased even when it was less than 90° on a flat surface.

On the other hand, in Example No. 10, the contact angle with respect to each of the 30% aqueous IPA solution having a surface tension of 40 mN/m or less and decane increased even when it was less than 90° on a flat surface. However, the contact angle did not increase with respect to silicone oil having a surface tension lower than that of decane.

Example Nos. 5, 6 and 10 had projections, so its tendency for the contact angle increase was different from that in examples having recesses. This corresponds to a difference between a case in which air-including regions are individually separated from each other like a recess pattern and a case in which air is shared like a projection pattern. The presence of projections assures the effect of increasing repellency when the area ratio is 64% or less.

In Example No. 7, the contact angle increased in all liquids used for the evaluation of repellency, so repellency increased. The contact angle in Example No. 7 was smaller than that of Example No. 1 because the surface tension of a fluoropolymer (19 mN/m) was lower than that of fluoroalkylsilane used in Example No. 1 (10 mN/m).

In Comparative Example No. 1, the contact angle could not be increased when it was less than 90° on a flat surface. When the contact angle was 90° or more on a flat surface, the contact angle was larger than that on the flat surface owing to a surface structure. In addition, when the contact angle was 90° or less on a flat surface, the contact angle became 0°, that is, reduced. This shows a tendency coinciding with that of a conventional model.

EXAMPLE 2

Next, Example 2 of the present invention will be described.

For Example Nos. 2, 8, and 3 of Example 1 described above, the contact angle was measured by using various liquids having different surface tensions (water, an aqueous IPA solution (having a concentration of 0.5 to 30 wt %), hexadecane, decane, heptane, octane, silicone oil, and a mixed liquid for the adhesion tension test (manufactured by Wako Pure Chemical Industries, Ltd.)) to examine the effect of the surface structure of the present invention.

FIGS. 37A, 37B, 38A and 38B show the results.

Figure 37A:
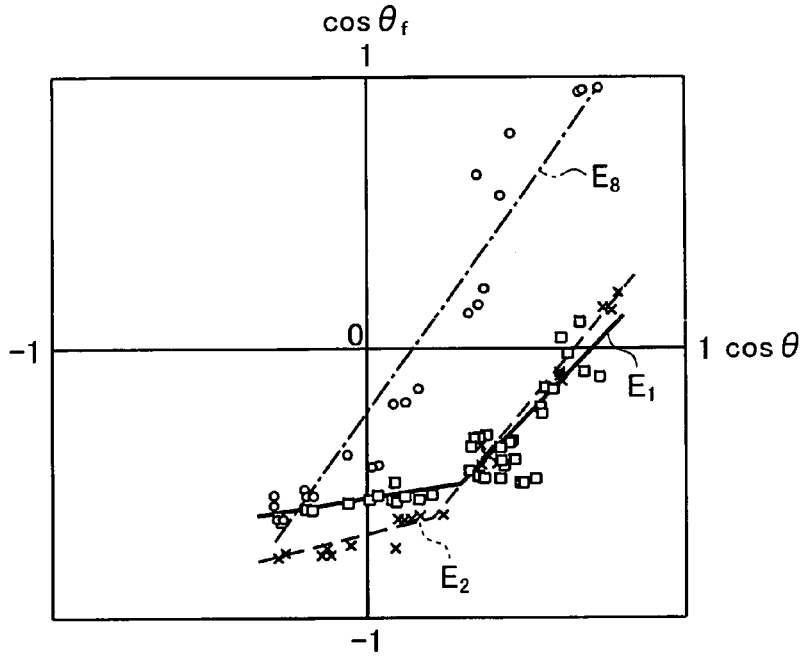
FIG. 37A is a graph showing the dependence of the angle $\alpha$ in recesses in Example Nos. 1, 2, and 8 in which the axis of ordinates indicates cos $\theta_f$ and the axis of abscissas indicates cos $\theta$.
Figure 37B:
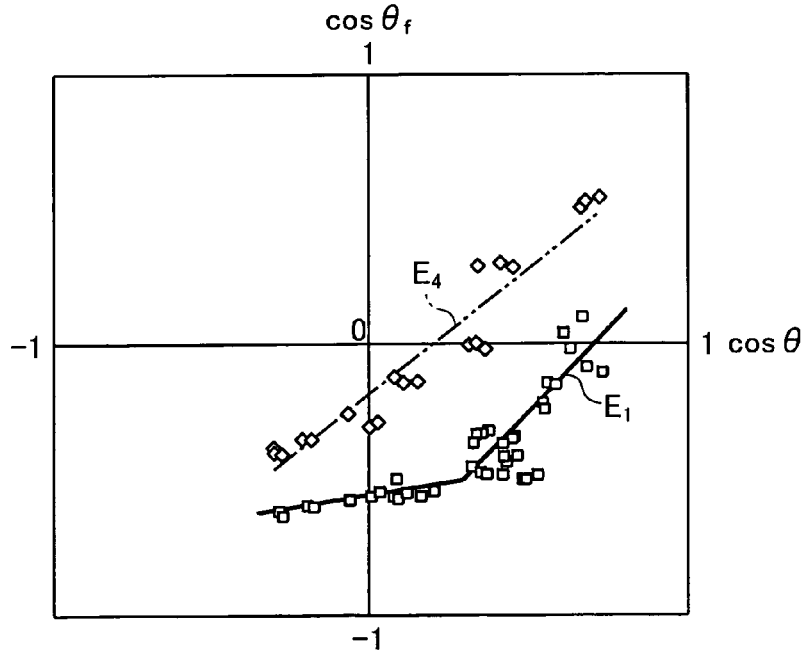
FIG. 37B is a graph showing the area ratio dependence in a recess pattern having recesses formed therein in Example Nos. 1 and 4 in which the axis of ordinates indicates cos $\theta_f$ and the axis of abscissas indicates cos $\theta$.

FIG. 37A is a graph showing the results of Example Nos. 1, 2, and 8, and shows the dependence of the angle α of each recess. FIG. 37B is a graph showing the results of Example Nos. 1 and 4, and shows the area ratio dependence in a recess pattern having recesses formed therein.

Figure 38A:
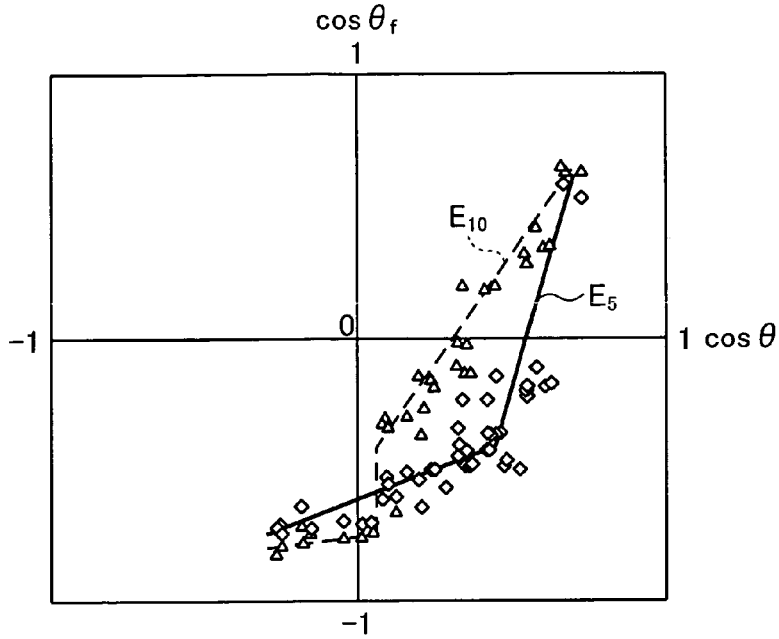
FIG. 38A is a graph showing the area ratio dependence in a projection pattern having projections formed therein in Example Nos. 5 and 10 in which the axis of ordinates indicates cos $\theta_f$ and the axis of abscissas indicates cos $\theta$.
Figure 38B:
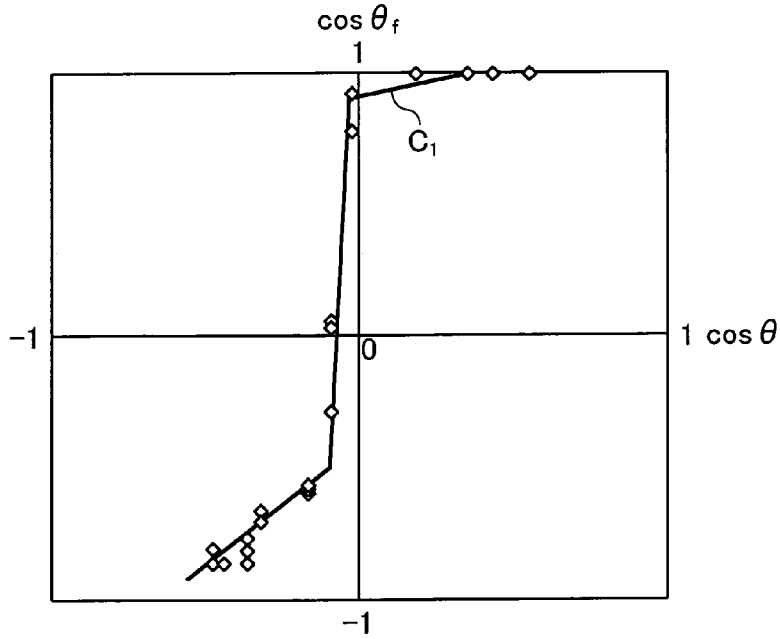
FIG. 38B is a graph showing a relationship between the contact angle $\theta$ and the apparent contact angle $\theta_f$ in Comparative Example No. 1 in which the axis of ordinates indicates cos $\theta_f$ and the axis of abscissas indicates cos $\theta$.

FIG. 38A is a graph showing the results of Example Nos. 5 and 10, and shows the area ratio dependence in a projection pattern having projections formed therein. FIG. 38B is a graph showing the results of Comparative Example No. 1.

FIG. 37A shows the angle dependence of the angle α of each recess. In Example No. 1 represented by the polygonal line $E_1$, the angle α of each recess is 90°. The region represented by the polygonal line widely distributes in the fourth quadrant and can be divided into two gradients of a Cassie model and a Wentzel model at the transition angle as a boundary. In each of Example No. 2 represented by the polygonal line $E_2$ and Example No. 8 represented by the polygonal line $E_8$, the transition angle increases as the angle α increases. That is, the transition angle shifts toward the third quadrant. Therefore, as the angle α increases, the effect of increasing repellency reduces.

FIG. 37B shows the area ratio dependence in a recess pattern having recesses formed therein.

In Example No. 1 represented by the polygonal line $E_1$, the area ratio is 78%. As described above, the region represented by the polygonal line widely distributes in the fourth quadrant and can be divided into two gradients of a Cassie model and a Wentzel model at the transition angle as a boundary. In Example No. 4 represented by the straight line $E_4$, the area ratio is 18%. The transition angle increases as the area ratio reduces. That is, the transition angle shifts toward the third quadrant. Therefore, as the area ratio reduces, the effect of increasing repellency reduces.

FIG. 38A shows the area ratio dependence in a projection pattern having projections formed therein.

In Example No. 5 represented by the polygonal lines $E_5$, the area ratio is 22%. As described above, the region represented by the polygonal line widely distributes in the fourth quadrant and can be divided into two gradients of a Cassie model and a Wentzel model at the transition angle as a boundary.

In addition, as the area ratio increases, like Example No. 10 represented by the polygonal line $E_{10}$ (having an area ratio of 64%), a tendency different from that of each of the conventional model described above and the model obtained in the present invention is observed. That is, with the origin roughly set as a boundary, when the contact angle is larger than that of the origin, a tendency similar to that of the Cassie model is observed. When the contact angle is smaller than that of the origin, a tendency similar to that of the Wentzel model is observed. The behavior has the same tendency as that of the conventional model, that is, a tendency in which lyophilic property increases and repellency increases. This is because increase of the area ratio, that is, widening of the gap between projections facilitates the penetration of a liquid into the gap and rapidly spreads the locally penetrated liquid over the entire surface. Such tendency has been reported in a similar projection pattern (published by de Gennes, Quere, and Brochard Wyart, translated by Kou Okumura "Hyomen Choryoku no Butsurigaku" (Physiques of Surface Tension), Yoshioka Shoten, p. 224). The tendency is not observed in a recess pattern having recesses, and a recess pattern and a projection pattern are different from each other in tendency in which repellency increases.

As shown in FIG. 38B, Comparative Example No. 1 represented by the polygonal line $C_1$ shows a tendency coinciding well with that of a Cassie-Wentzel integrated model (see FIG. 50).

As described above, comparison between surface structures in Example 2 shows the following: In the present invention, the sectional angle, the radius of curvature, and the area ratio in the recesses and projections are related to one another. Therefore, the selection of an optimum condition allows the effect of increasing repellency to be achieved (the surface properties to be changed from lyophilic to repellent) as shown in the present invention unlike the conventional model.

EXAMPLE 3

Next, Example 3 of the present invention will be described.

In this example, repellency increasing structures of Example Nos. 20 and 21 and a structure of Comparative Example No. 22 described below were produced, and they were evaluated for repellency. For comparison, a smooth surface was also evaluated for repellency.

At first, the constitutions and production methods of Example Nos. 20 and 21 will be specifically described.

Example No. 20 had the same constitution as that of the repellency increasing structure according to the seventh embodiment of the present invention (see FIGS. 20A and 20B).

Next, the method of producing the repellency increasing structure of Example No. 20 will be described.

In Example No. 20, a high-purity aluminum member having a thickness of 0.4 mm manufactured by Wako Pure Chemical Industries, Ltd. (having a purity of 99.99 wt %) was used as a substrate.

The production method includes five steps: (1) mirror finish, (2) formation of dents, (3) anodization, (4) pore widening, and (5) formation of a fluoropolymer coating.

(1) Mirror Finish

At first, a substrate was subjected to polishing with polishing cloth, buffing, and electrolytic polishing to perform mirror finish.

A grinder (Strueres Abramin, manufactured by Marumoto) and water-resistant polishing cloth were used for the polishing with polishing cloth. The polishing was performed while the yarn count of the water-resistant polishing cloth was sequentially changed from #200 to #500, #800, #1000, and #1500. The buffing was performed with slurry-like abrasives (FM No. 3 (having an average particle size of 1 μm) and FM No. 4 (having an average particle size of 0.3 μm) each manufactured by Fujimi Incorporated).

The electrolytic polishing was performed in an electrolyte (a mixed solution of 660 ml of 85 wt % phosphoric acid (manufactured by Wako Pure Chemical Industries, Ltd.), 160 ml of pure water, 150 ml of sulfuric acid, and 30 ml of ethylene glycol) at a temperature of 70° C. for 2 minutes with a constant current of 130 mA/m$^2$ by using the substrate as an anode and a carbon electrode as a cathode. A GP0110-30R (manufactured by TAKASAGO LTD.) was used as a power source.

(2) Formation of Dents

Next, dents were formed on the substrate by anodization for self-ordering after the mirror finish had been performed. The term "dent" refers to a hole serving as a starting point of a porous film.

In order to obtain dents, the anodization for self-ordering was performed on the substrate using 0.5 mol/l oxalic acid at a temperature of 16° C. for 5 hours at a constant voltage of 40 V and a current density of 1.4 A/dm$^2$ to form an anodized film having a thickness of about 40 μm. A NeoCool BD36 (manufactured by Yamato Scientific Co., Ltd.) was used as a cooling device, a pair stirrer PS-100 (manufactured by EYELA) was used as a stirring-heating device, and a GP0650-2R (manufactured by TAKASAGO LTD.) was used as a power source.

Next, the temperature of a treatment solution containing 118 g of 85 wt % phosphoric acid, 30 g of chromic anhydride $CrO_3$, and 1,500 g of pure water was held at 50° C., and the substrate having formed thereon the anodized film was immersed in the treatment solution for 12 hours or longer to perform a film removing treatment for dissolving the anodized film. Each anodized film after the film removing treatment had a thickness of 0.1 μm or less.

(3) Anodization

Next, the substrate having formed thereon dents as a result of removal of a film produced by anodization for self-ordering was subjected to the anodization. The substrate was immersed in an electrolyte to perform the anodization in a 0.5 mol/l oxalic acid solution at a temperature of 25° C. and a voltage of 40 V. At the time of the anodization, the electrolytic treatment was performed five times in accordance with the procedure described below.

The electrolytic treatment was repeated multiple times according to the following procedure: In a first electrolytic treatment, electrolysis was stopped when the constant voltage reached the initial set value Vo. In a second electrolytic treatment, electrolysis was stopped when the constant voltage reached the initial set value of 0.9×Vo [V]. In a third electrolytic treatment, electrolysis was stopped when the constant voltage reached the initial set value of 0.8×Vo [V]. Similarly, in an n-th electrolytic treatment, electrolysis was stopped when the constant voltage reached the initial set value of $\{1-0.1\times(n-1)\}\times Vo$. The resultant anodized film had a thickness of about 1 μm.

(4) Pore Widening

Next, the substrate subjected to the anodization was immersed for 30 minutes in a solution containing 50 g/l of phosphoric acid with its temperature held at 40° C. to perform pore widening.

(5) Fluoropolymer Coating (Coating Layer (Repellent Layer))

Next, a solution of fluoroalkylsilane in 1 wt % isopropyl alcohol (IPA) was applied to a porous film by spin coating to form a thin film having a thickness of 10 nm. After that, the thin film was heat-treated in a baking furnace at 80° C. for 1 hour to form a fluoropolymer coating (coating layer). Thus, the repellency increasing structure of Example No. 20 was produced.

Next, Example No. 21 will be described. Example No. 21 had the same constitution as that of the repellency increasing structure according to the tenth embodiment of the present invention (see FIGS. 23A and 23B).

Next, the method of producing the repellency increasing structure of Example No. 21 will be described.

In Example No. 21, as in Example No. 20, a high-purity aluminum member having a thickness of 0.4 mm manufactured by Wako Pure Chemical Industries, Ltd. (having a purity of 99.99 wt %) was used as a substrate.

The production method includes four steps: (1) mirror finish, (2) anodization, (3) pore widening, and (4) formation of a fluoropolymer coating. The production method and production conditions of Example No. 21 are the same as those of Example No. 20 except that Example No. 21 has no step of (2) formation of dents in Example No. 20.

Figure 39A:
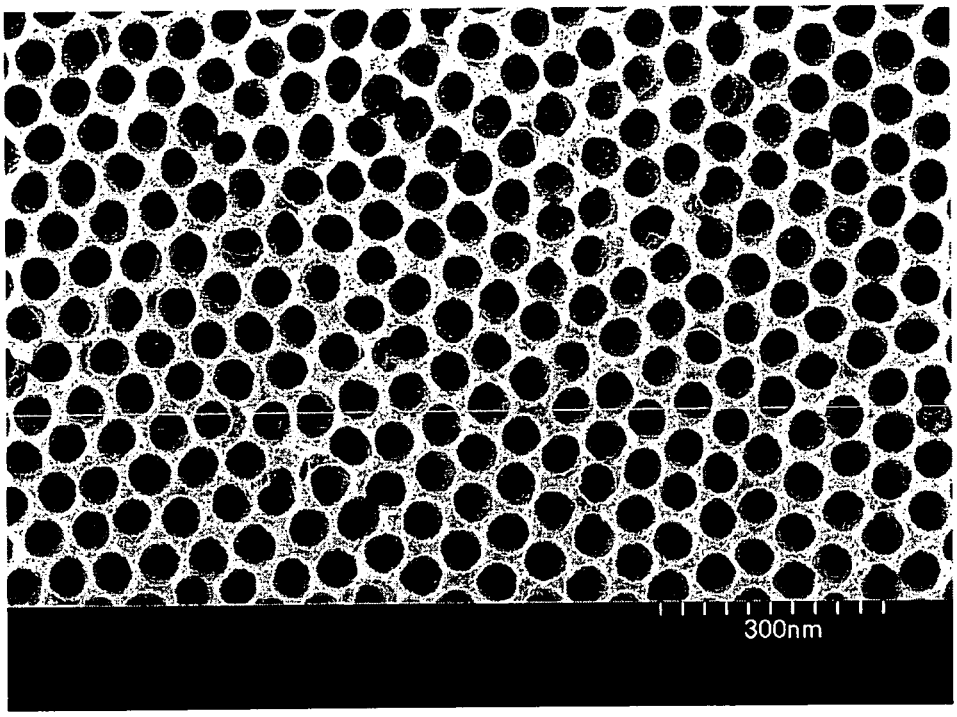
FIG. 39A is an SEM image of a repellency increasing structure of Example No. 20.
Figure 39B:
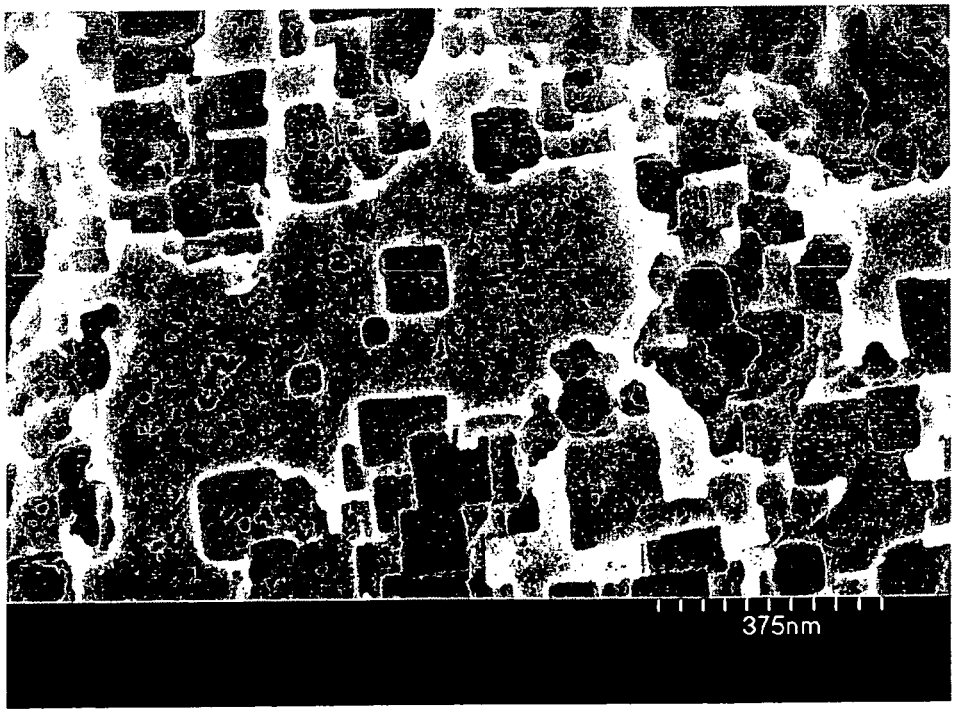
FIG. 39B is an SEM image of a repellency increasing structure of Example No. 21.

FIG. 39A shows an SEM image of the repellency increasing structure of Example No. 20 and FIG. 39B is an SEM image of the repellency increasing structure of Example No. 21.

In Example No. 20, the diameters and arrangement of holes were uniform, whereas in Example No. 21, the diameters and arrangement of holes were not uniform.

The SEM image of the repellency increasing structure of Example No. 20 shown in FIG. 39A was obtained under photographing conditions including a photographing magnification of 100,000 and an accelerating voltage of 2 kV, and the average hole diameter was 50 nm. The SEM image of the repellency increasing structure of Example No. 21 shown in FIG. 39B was obtained under photographing conditions including a photographing magnification of 80,000 and an accelerating voltage of 2 kV, and the average hole diameter was 100 nm.

Next, the method of producing the repellency increasing structure of Comparative Example No. 22 will be described.

Figure 40:
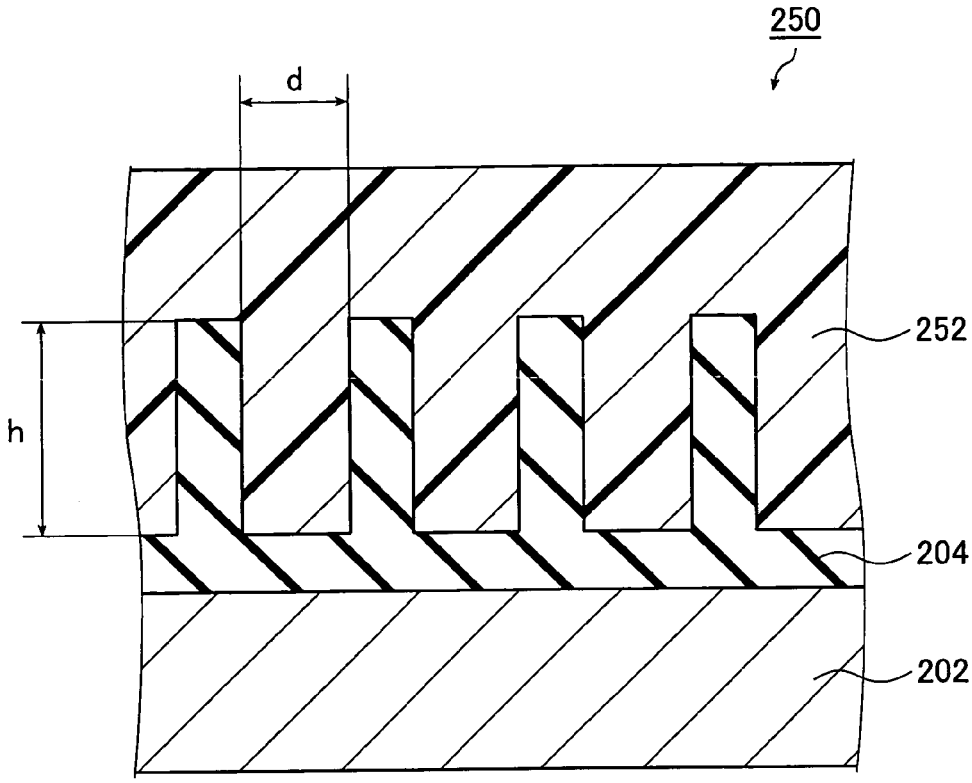
FIG. 40 is a schematic sectional view showing the constitution of a structure of Comparative Example No. 22.
Figure 43:
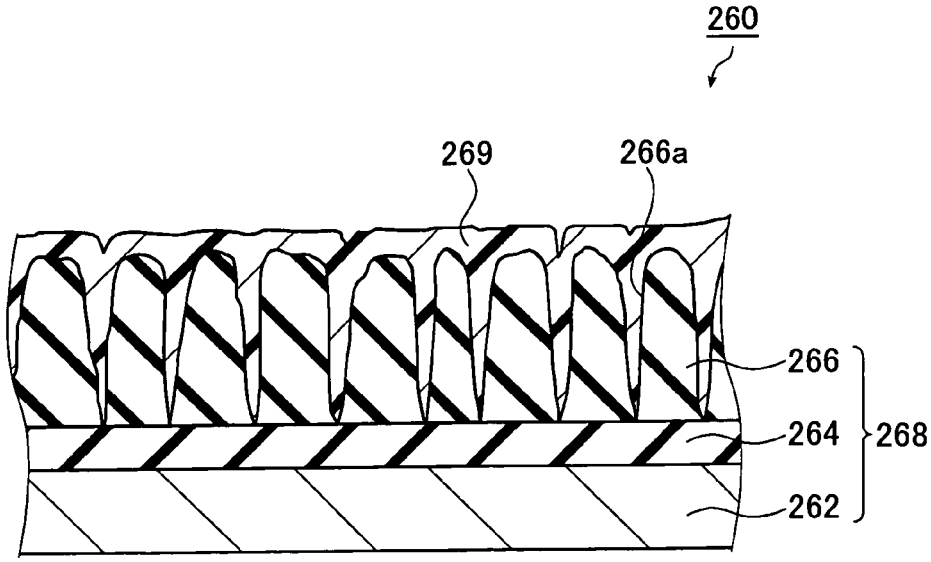
FIG. 43 PRIOR ART
FIG. 43 is a schematic sectional view showing an aluminum or aluminum alloy sheet disclosed in JP 3239137 B.

FIG. 40 is a schematic sectional view showing the constitution of the structure of Comparative Example No. 22 in Examples of the present invention. A structure 250 of Comparative Example No. 22 shown in FIG. 40 has the same constitution as that of Example No. 20 except that a coating layer 252 is thicker than the coating layer of Example No. 20 and is 1 μm in thickness.

The production method in Comparative Example No. 22 is the same as that in Example No. 20 except for the method of forming a coating layer. In Comparative Example No. 22, an SF-Coat manufactured by SEIMI CHEMICAL Co., Ltd. was applied to form a coating layer having a thickness of 1 μm. When the SF-Coat manufactured by SEIMI CHEMICAL Co., Ltd. is applied to a smooth surface, the contact angle of the smooth surface with respect to decane is 60°. In Comparative Example No. 22, the coating layer was as thick as 1 μm, so the coating layer covered the holes and the surface was flat.

The smooth surface as a reference was prepared by forming a fluoropolymer film on the surface of a smooth glass substrate having no surface structure. The fluoropolymer film formed was made of fluoroalkylsilane used in Example Nos. 20 and 21. The fluoropolymer film had a thickness of 10 nm.

In this example, the repellency increasing structures of Example Nos. 20 and 21, the structure of Comparative Example No. 22, and the smooth surface were evaluated for repellency by the contact angle with respect to decane having a surface tension of 23 mN/m (one third of that of water). Table 4 below shows the results.

TABLE 4

| | Example NO. 20 | Example NO. 21 | Comparative Example No. 22 | Smooth surface |
|---|---|---|---|---|
| Contact angle | 104° | 94° | 60° | 60° |

As shown in Table 4, in Example No. 20, the contact angle was 104°, which indicated the presence of repellency. This shows that a porous structure formed by anodization exerts an effect of air inclusion useful for an increase in contact angle, so a lyophilic material can be turned into a repellent material by the surface structure. In Example No. 20, repellency could be further improved by making the hole sizes (diameters) uniform and regularly arranging the holes.

In Example No. 21, the contact angle was 94°, which indicated the presence of repellency. This shows that, in Example No. 21, even a material exhibiting lyophilic property on a smooth surface can be turned into a repellent material by the surface structure of the present invention. Thus, a structure having repellency was obtained even when the hole sizes (diameters) were not uniform and the holes were irregularly arranged.

On the other hand, in Comparative Example No. 22, the contact angle was 60°, which indicated the absence of repellency. In Comparative Example No. 22, the surface was flattened as a result of the formation of a thick coating layer having a thickness of 1 μm, so the surface no longer had a porous structure having recesses and projections. As a result, the surface showed no repellency, and showed the same properties as those of a smooth surface. The contact angle on the smooth surface was 60°, which indicated the absence of repellency.

EXAMPLE 4

Hereinafter, Example 4 of the present invention will be described.

In this example, a substrate having the uneven portion 333 of the ejection substrate according to the fifteenth embodiment of the present invention (see FIGS. 31A and 31B), a substrate of Comparative Example No. 31, and a substrate of Comparative Example No. 32 were produced, and were evaluated for repellency. For comparison, a smooth surface was also evaluated for repellency. None of the substrates of Example No. 30, Comparative Example No. 31, and Comparative Example No. 32 had ejection orifices formed thereon.

As shown in FIG. 32D, ejection orifices 106 are not yet formed on the substrate of Example No. 30. In Example No. 30, the base and the uneven portion were each made of polyimide, the width of each projection was 2 μm, the width of each recess was 5 μm, and the diameter $\Phi_D$ of the ring formed by the outermost projection of the uneven portion was 508 μm. In addition, a repellent layer made of fluoroalkylsilane was formed.

Figure 41:
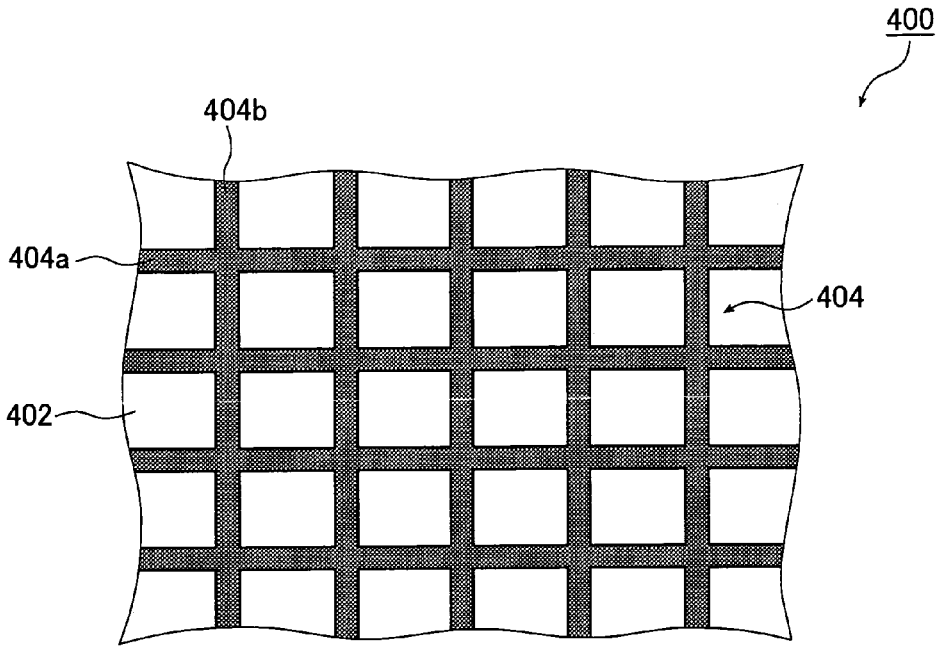
FIG. 41 is a schematic plan view showing the constitution of a substrate of Comparative Example No. 31.

As shown in FIG. 41, a substrate 400 of Comparative Example No. 31 was obtained by forming, on the surface of a base 402, an uneven portion 104 having formed therein a lattice-like pattern which includes straight line portions 404*a* and 404*b* arranged so as to be orthogonal to each other. The number of the straight line portions 404*a* formed is four and the number of the straight line portions 404*b* formed is five. In Comparative Example No. 31, the width and length of each of the straight line portions 404*a* and 404*b* were 2 μm and 508 μm, respectively. Polyimide was used for each of the base 402 and the straight line portions 404*a*. Furthermore, a repellent layer made of fluoroalkylsilane was formed on the surface of each of the base 402 and the straight line portions 404*a*.

Figure 42A:
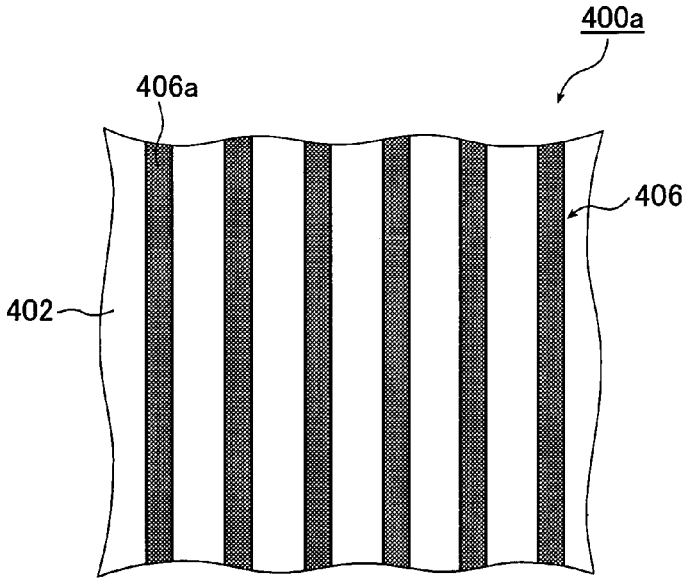
FIG. 42A is a schematic plan view showing the constitution of a substrate of Comparative Example No. 32.

In addition, as shown in FIG. 42A, a substrate 400*a* of Comparative Example No. 32 was obtained by forming, on the surface of the base 402, an uneven portion 106 having formed therein a straight line-like pattern which includes six straight line portions 406*a* arranged parallel to each other. In Comparative Example No. 32, the width and length of each of the straight line portions 406*a* were 2 μm and 508 μm, respectively. Polyimide was used for each of the base 402 and the straight line portions 406*a*. Furthermore, a repellent layer made of fluoroalkylsilane was formed on the surface of each of the base 402 and the straight line portions 406*a*.

Each of the substrates of Example No. 30, Comparative Example No. 31, and Comparative Example No. 32 had a pattern forming region of the same size.

In this example, the substrates of Example No. 30, Comparative Example No. 31, and Comparative Example 32, and the smooth surface were evaluated for repellency by the contact angle with respect to decane having a surface tension of 23 mN/m (one third of that of water). Table 5 below shows the results.

The smooth surface was prepared by forming a fluoropolymer film on the surface of a smooth glass substrate having no surface structure. The fluoropolymer film made of fluoroalkylsilane was formed. The fluoropolymer film had a thickness of 10 nm.

TABLE 5

| | Example NO. 30 | Example NO. 31 | Comparative Example No. 32 | Smooth surface |
|---|---|---|---|---|
| Contact angle | 104° | 94° | 60° | 60° |

As shown in Table 5, in Example No. 30, the contact angle was 130°, which indicated the presence of repellency. In addition, the stability of a droplet was good, and the shape of the droplet was stable as shown in FIGS. 28A and 28B and showed no change with time.

On the other hand, in Comparative Example No. 31, the contact angle was 114°. In other words, Comparative Example No. 31 was less effective than Example No. 30, and could not obtain a sufficiently large contact angle.

Figure 42B:
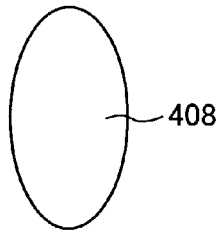
FIG. 42B is a plan view showing the state of a liquid droplet dropped on the surface of the substrate of Comparative Example 32.
Figure 44:
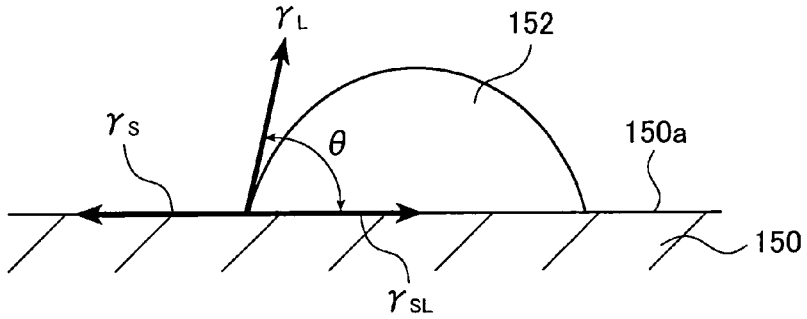
FIG. 44 PRIOR ART
FIG. 44 is a schematic view showing a relationship among the surface tension of a liquid droplet dropped on a flat surface, the surface tension of a solid, the interfacial tension between the solid and the liquid droplet, and the contact angle.
Figure 45:
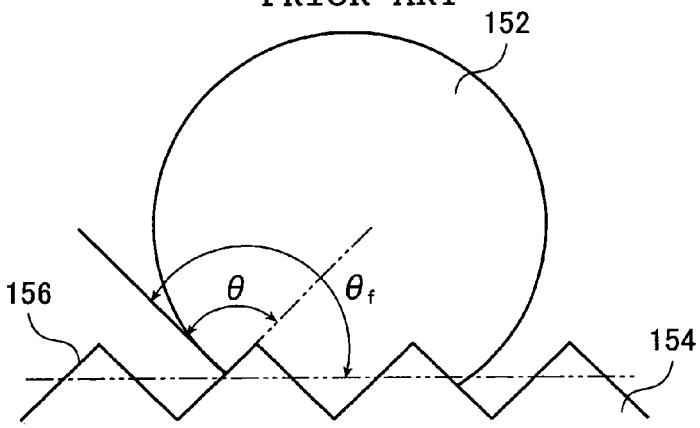
FIG. 45 PRIOR ART
FIG. 45 is a schematic view showing a Wentzel model.

In Comparative Example No. 32, a droplet 408 had an elliptical sectional shape as shown in FIG. 42B, and the contact angle showed anisotropy. In Comparative Example No. 32, the contact angle was as high as 128° in the direction in which the straight line portions 406*a* were arranged. In addition, the contact angle was 63° in the direction parallel to the direction in which the straight line portions 406*a* extended. Furthermore, in Comparative Example No. 32, a droplet tended to spread with time in the direction parallel to the direction in which the straight line portions 406*a* extended, so the contact angle lacked stability.

It should be noted that the contact angle on the smooth surface was 60°, which indicated the absence of repellency.

What is claimed is:

1. A liquid ejection head for ejecting droplets of a solution, comprising:

an ejection substrate in which multiple through-holes through which said droplets are ejected are formed; and droplet ejection means for allowing said droplets to eject through at least one of said multiple through-holes, wherein said ejection substrate includes a repellency increasing structure that comprises:

a substrate having a flat surface which shows lyophilic property with respect to a liquid having a surface tension lower than that of water; and multiple recesses and/or multiple projections each having a diameter or equivalent diameter of 50 μm or less and that are formed in said surface of said substrate, wherein inner walls of said multiple recesses and/or outer walls of said multiple projections are substantially parallel to a thickness direction of said substrate, and wherein said repellency increasing structure is arranged in such a manner that a solution ejection surface of said ejection substrate around said multiple through-holes corresponds to said surface of said substrate of said repellency increasing structure in which said multiple recesses and/or said multiple projections are formed.

2. The liquid ejection head according to claim 1, wherein said solution is mainly composed of an organic solvent, oil, or a liquid having a surface tension of 40 mN/m or less.

3. The liquid ejection head according to claim 1, wherein said solution is prepared by dispersing charged particles, and wherein said droplet ejection means comprises:

ejection electrodes for exerting an electrostatic force on said solution, said ejection electrodes being arranged in correspondence with the respective multiple through-holes, and a solution guide passing through each of the multiple through-holes and extending toward a droplet ejection side of said ejection substrate, wherein said droplets are ejected by said electrostatic force generated by said ejection electrodes.

4. The liquid ejection head according to claim 1, wherein said droplet ejection means comprises a droplet ejection unit of a piezoelectric system or a thermal system for ejecting said droplets from said multiple through-holes of said ejection substrate, and said droplets are ejected by said droplet ejection unit.

* * * * *